US005946012A

United States Patent [19]

Courian et al.

[11] Patent Number: 5,946,012

[45] **Date of Patent: *Aug. 31, 1999**

[54] RELIABLE HIGH PERFORMANCE DROP GENERATOR FOR AN INKJET PRINTHEAD

[75] Inventors: Kenneth J. Courian; John L. Stoffel; Richard A. Sader, all of San Diego; Keshava A. Prasad, San Marcos, all of Calif.; Steven L. Webb, Loveland, Colo.; David H. Donovan, San Diego, Calif.; Jules G. Moritz, III, Corvallis, Oreg.; Brian J. Keefe, La Jolla, Calif.; Steven W. Steinfield; Winthrop D. Childers, both of San Diego, Calif.

[73] Assignee: Hewlett-Packard Co., Palo Alto, Calif.

[ * ] Notice: This patent is subject to a terminal disclaimer.

[21] Appl. No.: 09/090,968

[22] Filed: Jun. 4, 1998

Related U.S. Application Data

[63] Continuation of application No. 08/608,376, Feb. 28, 1996, which is a continuation-in-part of application No. 08/319,896, Oct. 6, 1994, Pat. No. 5,648,805, which is a continuation-in-part of application No. 08/179,866, Jan. 11, 1994, Pat. No. 5,625,396, which is a continuation of application No. 08/862,086, Apr. 2, 1992, Pat. No. 5,278,584.

[51] Int. Cl.[6] ..... B41J 2/05

[52] U.S. Cl. ..... 347/63

[58] Field of Search ..... 347/63, 65, 1, 347/11, 12, 13, 57

[56] References Cited

U.S. PATENT DOCUMENTS

| | | | |
|---|---|---|---|
| 4,367,480 | 1/1983 | Kotoh | 346/140 |
| 4,380,771 | 4/1983 | Takatori | 346/140 |
| 4,490,728 | 12/1984 | Vaught et al. | 346/1.1 |
| 4,611,219 | 9/1986 | Sugitani et al. | 346/140 |
| 4,683,481 | 7/1987 | Johnson | 346/140 |
| 4,719,477 | 1/1988 | Hess et al. | 346/140 |
| 4,723,129 | 2/1988 | Endo et al. | 346/1.1 |
| 4,761,180 | 8/1988 | Askeland et al. | 106/22 |
| 4,794,410 | 12/1988 | Taub et al. | 346/140 |
| 4,853,037 | 8/1989 | Johnson et al. | 106/22 |
| 4,882,595 | 11/1989 | Trueba et al. | 346/140 |

(List continued on next page.)

FOREIGN PATENT DOCUMENTS

| | | | |
|---|---|---|---|
| 0461939A2 | 6/1990 | European Pat. Off. | B41J 2/05 |
| 0564120 | 10/1993 | European Pat. Off. | B41J 2/16 |
| 0566249A1 | 10/1993 | European Pat. Off. | B41J 2/05 |

*Primary Examiner*—Benjamin R. Fuller
*Assistant Examiner*—Michael S. Brooke

[57] ABSTRACT

An inkjet drop ejection system comprises a combination of printhead components and ink, mutually tuned to maximize operating characteristics of the printhead and print quality and dry time of the ink. Use of a short shelf (distance from ink source to ink firing element), on the order of 55 microns, provides a very high speed refill. However, it is a characteristic of high speed refill that it has a tendency for being over-damped. To provide the requisite damping, the ink should have a viscosity greater than about 2 cp. In this way, the ink and architecture work together to provide a tuned system that enables stable operation at high frequencies. One advantage of the combination of a pigment and a dispersant in the ink is the resultant higher viscosity provided. The high speed would be of little value if the ink did not have a fast enough rate of drying. This is accomplished by the addition of alcohols or alcohol(s) and surfactant(s) to the ink. Fast dry times are achieved with a combination of alcohols, such as iso-propyl alcohol with a 4 or 5 carbon alcohol or with iso-propyl alcohol plus surfactant(s). One preferred embodiment of a short shelf (90 to 130 microns), ink viscosity of about 3 cp, and surface tension of about 54 provides a high speed drop generator capable of operating at about 12 KHz. Reducing the shelf length to about 55 microns, in combination with rotating the substrate at an angle to the scan direction, permits maximum drop generator operation as high as about 20 KHz. As a consequence of employing pigment-based inks, high optical densities are realized, along with excellent permanence (no fade and better waterfastness), and good stability. The combination of preferred ink and pen architecture provides good drop generator stability.

44 Claims, 39 Drawing Sheets

U.S. PATENT DOCUMENTS

| | | | |
|---|---|---|---|
| 4,894,664 | 1/1990 | Pan | 346/1.1 |
| 4,896,171 | 1/1990 | Ito | 346/140 |
| 4,926,197 | 5/1990 | Childers et al. | 346/140 |
| 4,942,408 | 7/1990 | Braim | 346/140 |
| 4,963,189 | 10/1990 | Hindagolla et al. | 106/22 |
| 4,994,110 | 2/1991 | Stoffel et al. | 106/22 |
| 5,026,427 | 6/1991 | Mitchell et al. | 106/22 |
| 5,062,893 | 11/1991 | Adamic et al. | 106/22 |
| 5,069,718 | 12/1991 | Kappele | 106/22 |
| 5,085,698 | 2/1992 | Ma et al. | 106/20 |
| 5,122,812 | 6/1992 | Hess et al. | 346/1.1 |
| 5,143,547 | 9/1992 | Kappele | 106/22 |
| 5,145,519 | 9/1992 | Kappele | 106/22 |
| 5,159,353 | 10/1992 | Fasen et al. | 346/140 |
| 5,160,370 | 11/1992 | Suga et al. | 106/20 |
| 5,169,438 | 12/1992 | Matrick | 106/22 |
| 5,180,425 | 1/1993 | Matrick et al. | 106/22 |
| 5,185,034 | 2/1993 | Webb et al. | 106/22 |
| 5,273,573 | 12/1993 | Kappele | 106/22 |
| 5,274,400 | 12/1993 | Johnson et al. | 346/140 |
| 5,278,584 | 1/1994 | Keefe et al. | 346/140 |
| 5,302,197 | 4/1994 | Wickramanayake et al. | 106/22 |
| 5,401,303 | 3/1995 | Stoffel et al. | 106/20 |
| 5,428,383 | 6/1995 | Shields et al. | 347/96 |
| 5,455,613 | 10/1995 | Canfield et al. | 347/65 |
| 5,563,642 | 10/1996 | Keefe et al. | 347/84 |

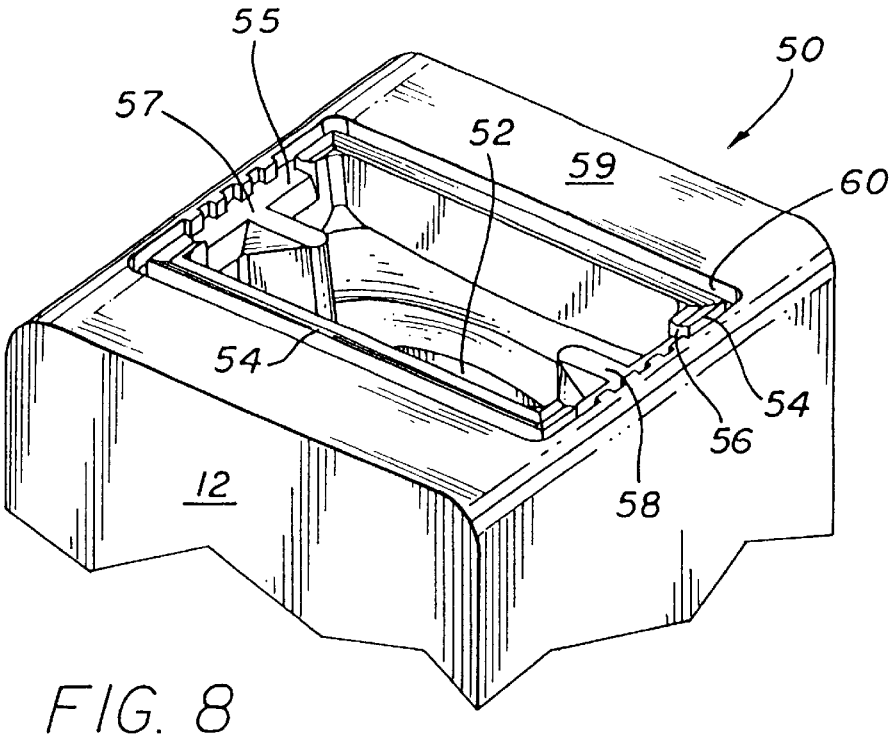
FIG. 8
FIG. 10
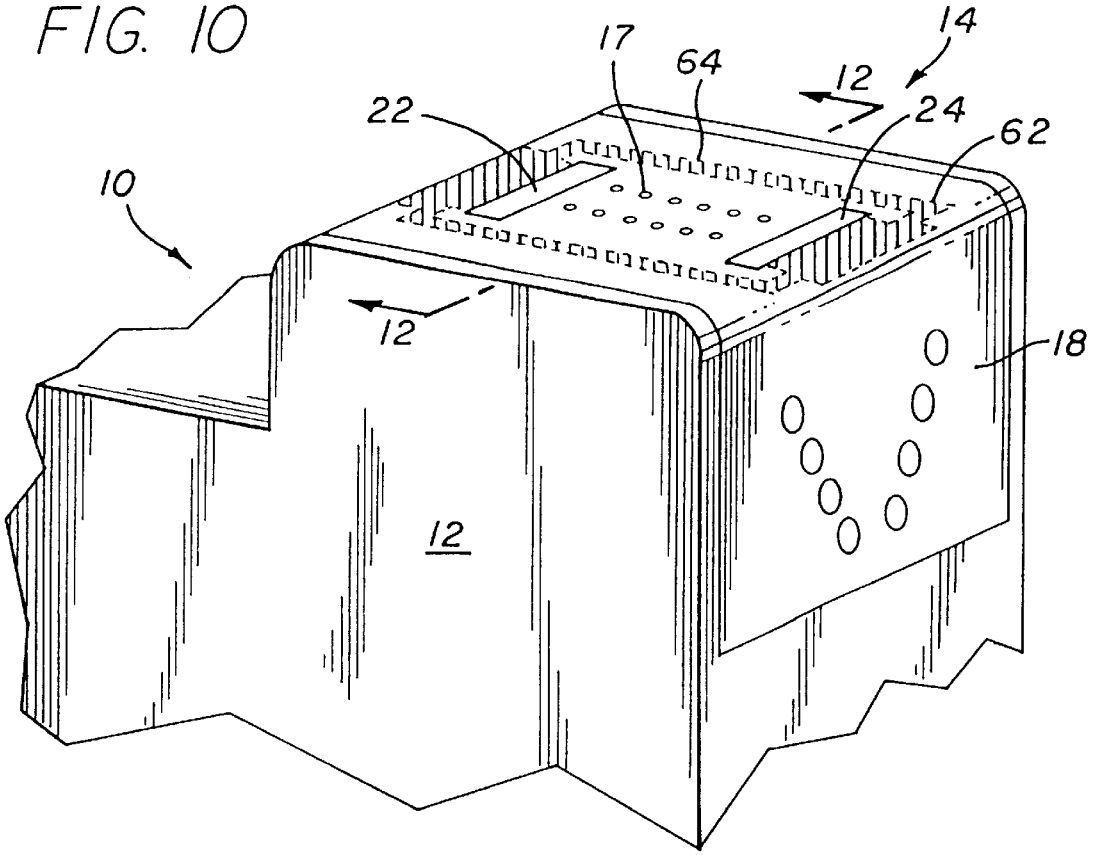

FIG. 11
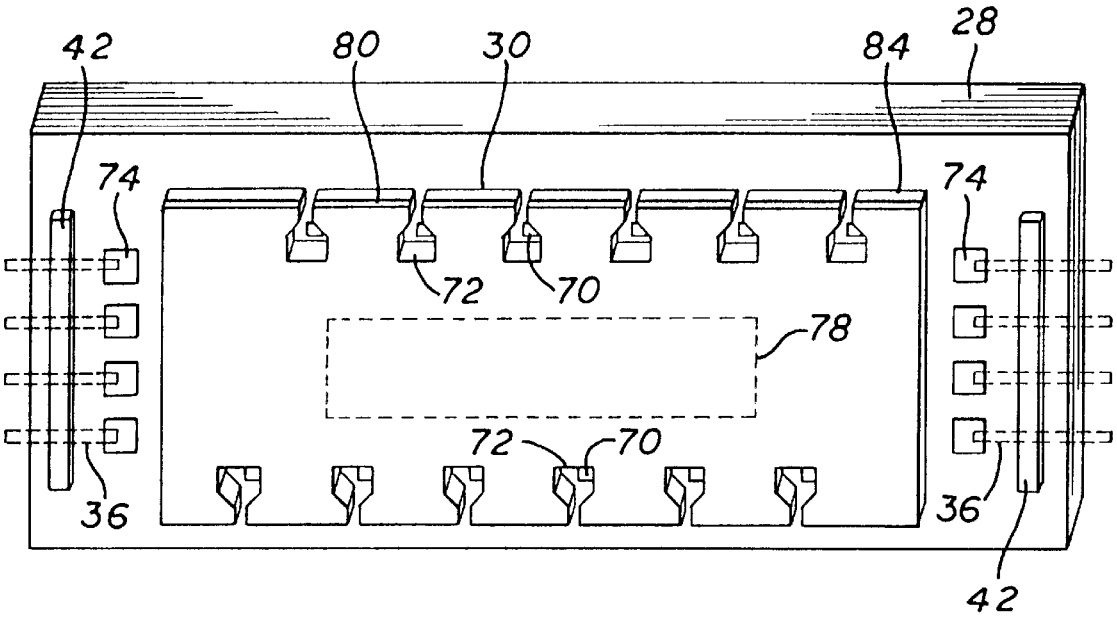
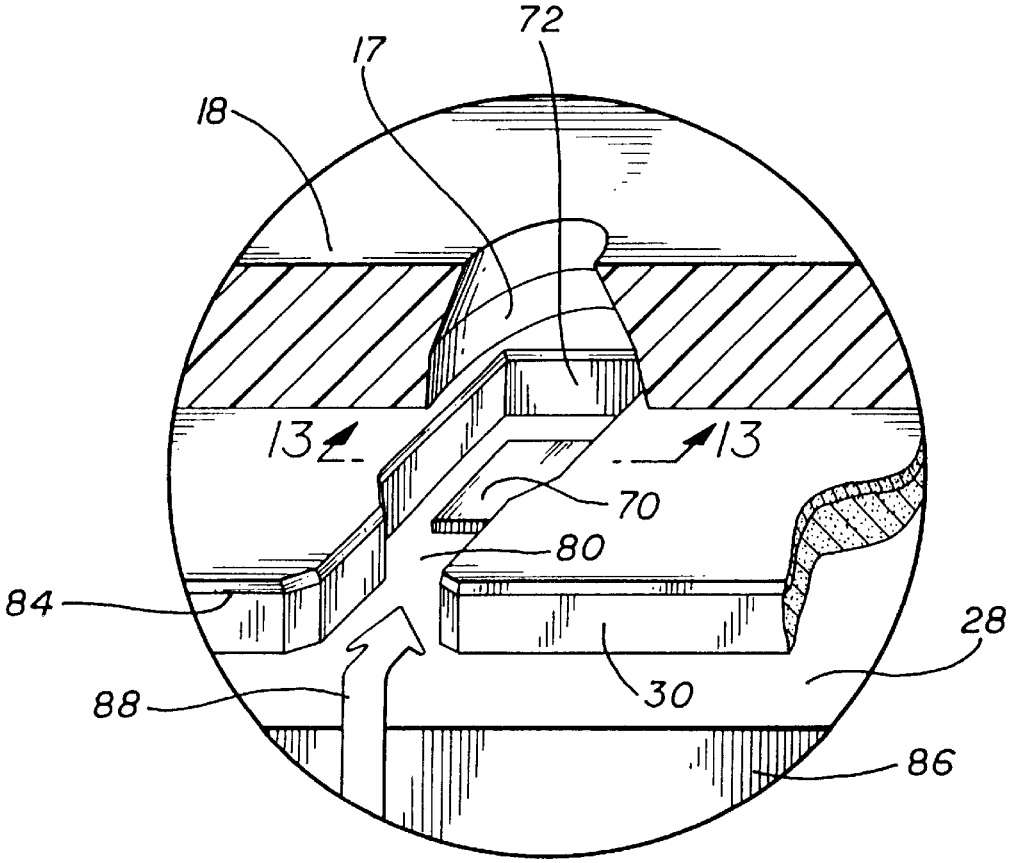
FIG. 12

FIG. 22
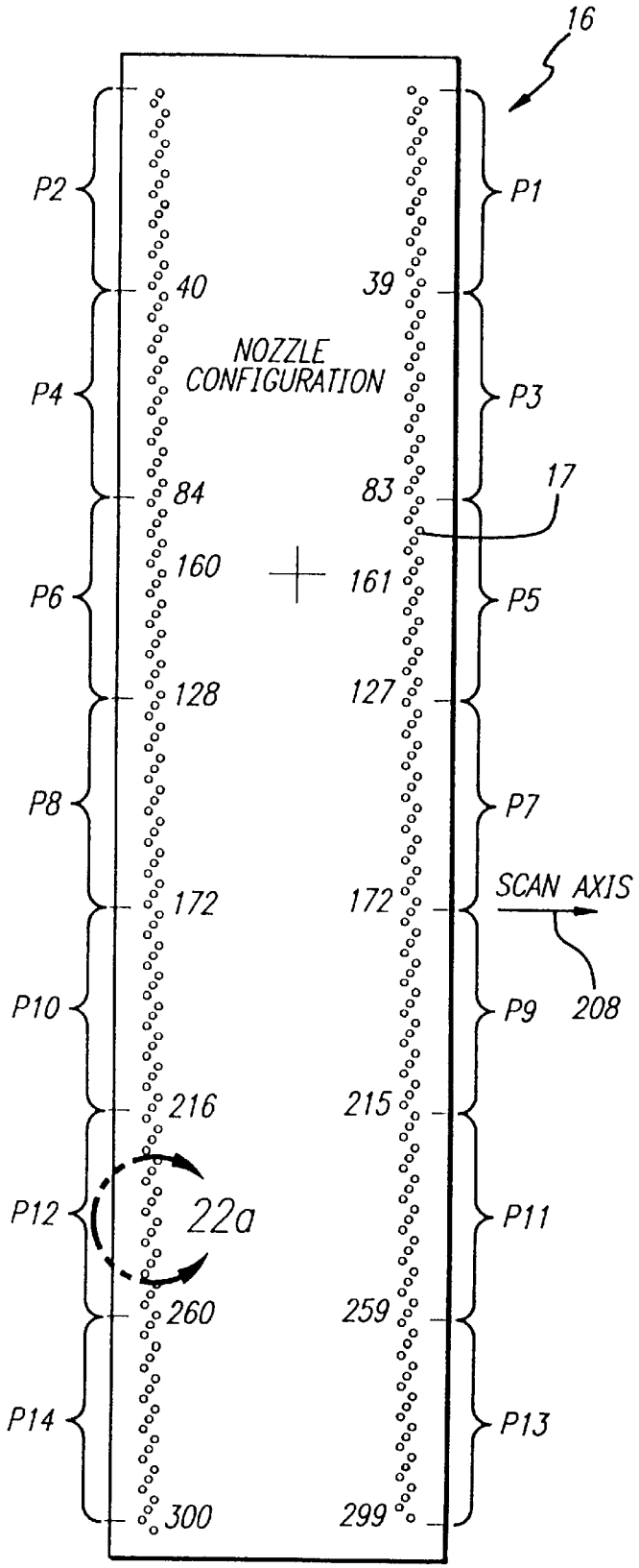
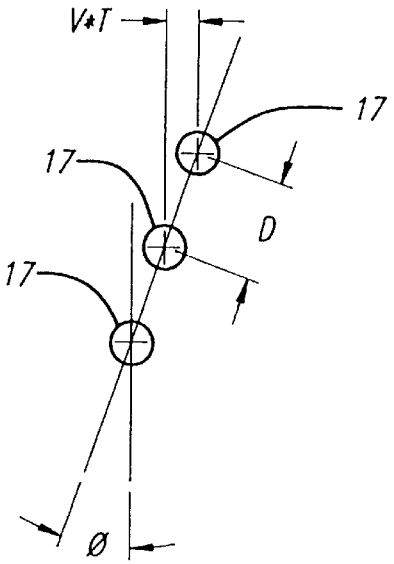
FIG. 22a

FIG. 24-1

| NOZZLE | X | Y | NOZZLE | X | Y | NOZZLE | X | Y |
|---|---|---|---|---|---|---|---|---|
| 1 | 2035.00 | 6329.00 | 51 | 2036.50 | 4212.50 | 101 | 2038.50 | 2095.50 |
| 2 | -2057.00 | 6285.50 | 52 | -2055.50 | 4170.00 | 102 | -2054.00 | 2053.25 |
| 3 | 2061.00 | 6244.25 | 53 | 2062.75 | 4127.50 | 103 | 2064.50 | 2010.75 |
| 4 | -2069.50 | 6202.00 | 54 | -2068.00 | 4085.25 | 104 | -2066.25 | 1968.60 |
| 5 | 2048.75 | 6159.50 | 55 | 2050.50 | 4042.75 | 105 | 2052.25 | 1926.00 |
| 6 | -2043.75 | 6117.25 | 56 | -2042.00 | 4000.50 | 106 | -2040.25 | 1883.75 |
| 7 | 2036.75 | 6075.00 | 57 | 2038.50 | 3958.25 | 107 | 2040.25 | 1841.50 |
| 8 | -2055.75 | 6032.75 | 58 | -2054.00 | 3916.00 | 108 | -2052.25 | 1799.25 |
| 9 | 2062.75 | 5990.25 | 59 | 2064.50 | 3873.50 | 109 | 2066.25 | 1756.75 |
| 10 | -2068.00 | 5948.00 | 60 | -2066.25 | 3831.25 | 110 | -2064.50 | 1714.50 |
| 11 | 2050.50 | 5905.50 | 61 | 2052.25 | 3788.75 | 111 | 2054.00 | 1672.00 |
| 12 | -2042.00 | 5863.25 | 62 | -2040.25 | 3746.50 | 112 | -2038.50 | 1629.75 |
| 13 | 2038.50 | 5821.00 | 63 | 2040.25 | 3704.25 | 113 | 2042.00 | 1587.50 |
| 14 | -2054.00 | 5778.75 | 64 | -2052.25 | 3662.00 | 114 | -2050.50 | 1545.25 |
| 15 | 2064.50 | 5736.25 | 65 | 2066.25 | 3619.50 | 115 | 2068.00 | 1502.75 |
| 16 | -2066.25 | 5694.00 | 66 | -2064.50 | 3577.25 | 116 | -2062.75 | 1460.50 |
| 17 | 2052.25 | 5651.50 | 67 | 2054.00 | 3534.75 | 117 | 2055.75 | 1418.00 |
| 18 | -2040.25 | 5609.25 | 68 | -2038.50 | 3492.50 | 118 | -2036.75 | 1375.75 |
| 19 | 2040.50 | 5567.00 | 69 | 2042.00 | 3450.25 | 119 | 2043.75 | 1333.50 |
| 20 | -2052.25 | 5524.75 | 70 | -2050.50 | 3408.00 | 120 | -2048.75 | 1291.25 |
| 21 | 2066.25 | 5482.25 | 71 | 2068.00 | 3365.50 | 121 | 2069.50 | 1248.75 |
| 22 | -2064.50 | 5440.00 | 72 | -2062.75 | 3323.25 | 122 | -2061.00 | 1206.50 |
| 23 | 2054.00 | 5397.50 | 73 | 2055.75 | 3280.75 | 123 | 2057.50 | 1164.00 |
| 24 | -2038.50 | 5355.25 | 74 | -2036.75 | 3238.50 | 124 | -2035.00 | 1121.75 |
| 25 | 2042.00 | 5313.00 | 75 | 2043.75 | 3196.25 | 125 | 2045.25 | 1079.50 |

FIG. 24-2

| NOZZLE | X | Y | NOZZLE | X | Y | NOZZLE | X | Y |
|---|---|---|---|---|---|---|---|---|
| 151 | 2040.25 | -21.00 | 201 | 2042.00 | -2137.75 | 251 | 2043.75 | -4254.50 |
| 152 | -2052.25 | -63.25 | 202 | -2050.50 | -2180.00 | 252 | -2048.75 | -4296.75 |
| 153 | 2066.25 | -105.75 | 203 | 2068.00 | -2222.50 | 253 | 2069.50 | 4339.25 |
| 154 | -2064.50 | -148.00 | 204 | -2062.75 | -2264.75 | 254 | 2061.00 | -4381.50 |
| 155 | 2054.00 | -190.50 | 205 | 2055.75 | -2307.25 | 255 | 2057.00 | -4424.00 |
| 156 | -2038.50 | -232.75 | 206 | -2036.75 | -2349.50 | 256 | 2035.00 | -4466.25 |
| 157 | 2042.00 | -275.00 | 207 | 2043.75 | -2391.75 | 257 | 2045.25 | 4508.50 |
| 158 | -2050.50 | -317.25 | 208 | -2048.75 | -2434.00 | 258 | -2047.00 | -4550.75 |
| 159 | 2068.00 | -359.75 | 209 | 2069.50 | -2476.50 | 259 | 2071.25 | -4593.25 |
| 160 | -2062.75 | -402.00 | 210 | -2061.00 | -2518.75 | 260 | -2059.25 | -4635.50 |
| 161 | 2055.75 | -444.50 | 211 | 2057.50 | -2561.25 | 261 | 2059.25 | -4677.75 |
| 162 | -2036.75 | -486.75 | 212 | -2035.00 | -2603.50 | 262 | 2071.25 | 4720.00 |
| 163 | 2043.75 | -529.00 | 213 | 2045.25 | 2645.75 | 263 | 2047.00 | 4762.50 |
| 164 | -2048.75 | -571.25 | 214 | -2047.00 | -2688.00 | 264 | -2045.25 | 4804.75 |
| 165 | 2069.50 | -613.75 | 215 | 2071.25 | -2730.50 | 265 | 2035.00 | -4847.00 |
| 166 | -2061.00 | -656.00 | 216 | -2059.25 | -2772.75 | 266 | 2057.50 | -4889.25 |
| 167 | 2057.50 | -698.50 | 217 | 2059.25 | -2815.25 | 267 | 2061.00 | -4931.75 |
| 168 | -2035.00 | -740.75 | 218 | -2071.25 | -2857.50 | 268 | 2069.50 | -4974.00 |
| 169 | 2045.25 | -783.00 | 219 | 2047.00 | -2900.00 | 269 | 2048.75 | -5016.50 |
| 170 | 2047.00 | -825.25 | 220 | -2045.25 | -2942.25 | 270 | -2043.75 | -5058.75 |
| 171 | 2071.25 | -867.75 | 221 | 2035.00 | 2984.50 | 271 | 2036.75 | -5101.00 |
| 172 | 2059.25 | -910.00 | 222 | -2057.50 | -3026.75 | 272 | -2055.75 | -5143.25 |
| 173 | 2059.25 | -952.50 | 223 | 2061.00 | -3069.25 | 273 | 2062.75 | -5185.75 |
| 174 | 2071.25 | -994.75 | 224 | -2069.50 | -3111.50 | 274 | -2068.00 | -5228.00 |
| 175 | 2047.00 | -1037.25 | 225 | 2048.75 | -3154.00 | 275 | 2050.50 | -5270.50 |

FIG. 24-3

| | | | | | | | | |
|---|---|---|---|---|---|---|---|---|
| 26 | -2050.50 | 5270.75 | 76 | -2048.75 | 3154.00 | 126 | -2047.00 | 1037.25 |
| 27 | 2068.00 | 5228.25 | 77 | 2069.50 | 3111.50 | 127 | 2071.25 | 994.75 |
| 28 | -2062.75 | 5186.00 | 78 | -2061.00 | 3069.25 | 128 | -2059.25 | 952.50 |
| 29 | 2055.75 | 5143.50 | 79 | 2057.50 | 3026.75 | 129 | 2059.25 | 910.25 |
| 30 | -2036.75 | 5101.25 | 80 | -2035.00 | 2984.50 | 130 | -2071.25 | 868.00 |
| 31 | 2043.75 | 5059.00 | 81 | 2045.25 | 2942.25 | 131 | 2047.00 | 825.50 |
| 32 | -2048.75 | 5016.75 | 82 | -2047.00 | 2900.00 | 132 | -2045.25 | 783.25 |
| 33 | 2069.50 | 4974.25 | 83 | 2071.25 | 2875.50 | 133 | 2035.00 | 741.00 |
| 34 | -2061.00 | 4932.00 | 84 | -2059.25 | 2815.25 | 134 | -2057.50 | 698.75 |
| 35 | 2057.50 | 4889.50 | 85 | 2059.25 | 2772.75 | 135 | 2061.00 | 656.25 |
| 36 | -2035.00 | 4847.25 | 86 | -2071.25 | 2730.50 | 136 | -2069.50 | 614.00 |
| 37 | 2045.25 | 4805.00 | 87 | 2047.00 | 2688.00 | 137 | 2048.75 | 571.50 |
| 38 | -2047.00 | 4762.75 | 88 | -2045.25 | 2645.75 | 138 | -2043.75 | 529.25 |
| 39 | 2071.25 | 4720.25 | 89 | 2035.00 | 2603.50 | 139 | 2036.75 | 487.00 |
| 40 | -2059.25 | 4678.00 | 90 | -2057.50 | 2561.25 | 140 | -2055.75 | 444.75 |
| 41 | 2059.25 | 4635.50 | 91 | 2061.00 | 2518.75 | 141 | 2062.75 | 402.25 |
| 42 | -2071.25 | 4593.25 | 92 | -2069.50 | 2476.50 | 142 | -2068.00 | 360.00 |
| 43 | 2047.00 | 4550.75 | 93 | 2048.75 | 2434.00 | 143 | 2050.50 | 317.50 |
| 44 | -2045.25 | 4508.50 | 94 | -2043.75 | 2391.75 | 144 | -2042.00 | 275.25 |
| 45 | 2035.00 | 4466.25 | 95 | 2036.50 | 2349.50 | 145 | 2038.50 | 233.00 |
| 46 | -2057.50 | 4424.00 | 96 | -2055.75 | 2307.25 | 146 | -2054.00 | 190.75 |
| 47 | 2061.00 | 4381.50 | 97 | 2062.75 | 2264.75 | 147 | 2064.50 | 148.25 |
| 48 | -2069.50 | 4339.25 | 98 | -2068.00 | 2222.50 | 148 | -2066.25 | 106.00 |
| 49 | 2048.75 | 4296.75 | 99 | 2050.50 | 2180.00 | 149 | 2052.25 | 63.50 |
| 50 | -2043.75 | 4254.50 | 100 | -2042.00 | 2137.75 | 150 | -2040.25 | 21.25 |

FIG. 24-4

| | | | | | | | | |
|---|---|---|---|---|---|---|---|---|
| 176 | -2045.25 | -1079.50 | 226 | -2043.75 | -3196.25 | 276 | -2042.00 | -5312.75 |
| 177 | 2035.00 | -1121.75 | 227 | 2036.75 | -3238.50 | 277 | 2038.50 | -5355.00 |
| 178 | -2057.50 | -1164.00 | 228 | -2055.75 | -3280.75 | 278 | -2054.00 | -5397.25 |
| 179 | 2061.00 | -1206.50 | 229 | 2062.75 | -3323.25 | 279 | 2064.50 | -5439.75 |
| 180 | -2069.50 | -1248.75 | 230 | -2068.00 | -3365.50 | 280 | -2066.25 | -5482.00 |
| 181 | 2048.75 | -1291.25 | 231 | 2050.50 | -3408.00 | 281 | 2052.25 | -5524.50 |
| 182 | -2043.75 | -1333.50 | 232 | -2042.00 | -3450.25 | 282 | -2040.25 | -5566.75 |
| 183 | 2036.75 | -1375.75 | 233 | 2038.50 | -3492.50 | 283 | 2040.25 | -5609.00 |
| 184 | -2055.75 | -1418.00 | 234 | -2054.00 | -3534.75 | 284 | -2052.25 | -5651.25 |
| 185 | 2062.75 | -1460.50 | 235 | 2064.50 | -3577.25 | 285 | 2066.25 | -5693.75 |
| 186 | -2068.00 | -1502.75 | 236 | -2066.25 | -3619.50 | 286 | -2064.50 | -5736.00 |
| 187 | 2050.50 | -1545.25 | 237 | 2052.25 | -3662.00 | 287 | 2054.00 | -5778.50 |
| 188 | -2042.00 | -1587.50 | 238 | -2040.25 | -3704.25 | 288 | -2038.50 | -5820.75 |
| 189 | 2038.50 | -1629.75 | 239 | 2040.25 | -3746.50 | 289 | 2042.00 | -5863.00 |
| 190 | -2054.00 | -1672.00 | 240 | -2052.25 | -3788.75 | 290 | -2050.50 | -5905.25 |
| 191 | 2064.50 | -1714.50 | 241 | 2066.25 | -3831.25 | 291 | 2068.00 | -5947.75 |
| 192 | 2066.25 | -1756.75 | 242 | -2064.50 | -3873.50 | 292 | -2062.75 | -5990.00 |
| 193 | 2052.25 | -1799.25 | 243 | 2054.00 | -3916.00 | 293 | 2055.75 | -6032.50 |
| 194 | -2040.25 | -1841.50 | 244 | -2038.50 | -3958.25 | 294 | -2036.75 | -6074.75 |
| 195 | 2040.25 | -1883.75 | 245 | 2042.00 | -4000.50 | 295 | 2043.75 | -6117.00 |
| 196 | -2052.25 | -1926.00 | 246 | -2050.50 | -4042.75 | 296 | -2048.75 | -6159.25 |
| 197 | 2066.25 | -1968.50 | 247 | 2068.00 | -4085.25 | 297 | 2069.50 | -6201.75 |
| 198 | -2064.50 | -2010.75 | 248 | -2062.75 | -4127.50 | 298 | -2061.00 | -6244.00 |
| 199 | 2054.00 | -2053.25 | 249 | 2055.75 | -4170.00 | 299 | 2057.50 | -6286.50 |
| 200 | -2038.50 | -2095.50 | 250 | -2036.75 | -4212.25 | 300 | -2035.00 | -6328.75 |

FIG. 28-1

| NOZZLE | PRIM # | ADDR # | NOZZLE | PRIM # | ADDR # | NOZZLE | PRIM # | ADDR # |
|---|---|---|---|---|---|---|---|---|
| 1 | 1 | 1 | 51 | 3 | 2 | 101 | 5 | 3 |
| 2 | 2 | 9 | 52 | 4 | 10 | 102 | 6 | 11 |
| 3 | 1 | 16 | 53 | 3 | 17 | 103 | 5 | 18 |
| 4 | 2 | 2 | 54 | 4 | 3 | 104 | 6 | 4 |
| 5 | 1 | 9 | 55 | 3 | 10 | 105 | 5 | 11 |
| 6 | 2 | 17 | 56 | 4 | 18 | 106 | 6 | 19 |
| 7 | 1 | 2 | 57 | 3 | 3 | 107 | 5 | 4 |
| 8 | 2 | 10 | 58 | 4 | 11 | 108 | 6 | 12 |
| 9 | 1 | 17 | 59 | 3 | 18 | 109 | 5 | 19 |
| 10 | 2 | 3 | 60 | 4 | 4 | 110 | 6 | 5 |
| 11 | 1 | 10 | 61 | 3 | 11 | 111 | 5 | 12 |
| 12 | 2 | 18 | 62 | 4 | 19 | 112 | 6 | 20 |
| 13 | 1 | 3 | 63 | 3 | 4 | 113 | 5 | 5 |
| 14 | 2 | 11 | 64 | 4 | 12 | 114 | 6 | 13 |
| 15 | 1 | 18 | 65 | 3 | 19 | 115 | 5 | 20 |
| 16 | 2 | 4 | 66 | 4 | 5 | 116 | 6 | 6 |
| 17 | 1 | 11 | 67 | 3 | 12 | 117 | 5 | 13 |
| 18 | 2 | 19 | 68 | 4 | 20 | 118 | 6 | 21 |
| 19 | 1 | 4 | 69 | 3 | 5 | 119 | 5 | 6 |
| 20 | 2 | 12 | 70 | 4 | 13 | 120 | 6 | 14 |
| 21 | 1 | 19 | 71 | 3 | 20 | 121 | 5 | 21 |
| 22 | 2 | 5 | 72 | 4 | 6 | 122 | 6 | 7 |
| 23 | 1 | 12 | 73 | 3 | 13 | 123 | 5 | 14 |
| 24 | 2 | 20 | 74 | 4 | 21 | 124 | 6 | 22 |
| 25 | 1 | 5 | 75 | 3 | 6 | 125 | 5 | 7 |

FIG. 28-2

| NOZZLE | PRIM # | ADDR # | NOZZLE | PRIM # | ADDR # | NOZZLE | PRIM # | ADDR # |
|---|---|---|---|---|---|---|---|---|
| 151 | 7 | 4 | 201 | 9 | 5 | 251 | 11 | 6 |
| 152 | 8 | 12 | 202 | 10 | 13 | 252 | 12 | 14 |
| 153 | 7 | 19 | 203 | 9 | 20 | 253 | 11 | 21 |
| 154 | 8 | 5 | 204 | 10 | 6 | 254 | 12 | 7 |
| 155 | 7 | 12 | 205 | 9 | 13 | 255 | 11 | 14 |
| 156 | 8 | 20 | 206 | 10 | 21 | 256 | 12 | 22 |
| 157 | 7 | 5 | 207 | 9 | 6 | 257 | 11 | 7 |
| 158 | 8 | 13 | 208 | 10 | 14 | 258 | 12 | 15 |
| 159 | 7 | 20 | 209 | 9 | 21 | 259 | 11 | 22 |
| 160 | 8 | 6 | 210 | 10 | 7 | 260 | 12 | 8 |
| 161 | 7 | 13 | 211 | 9 | 14 | 261 | 13 | 15 |
| 162 | 8 | 21 | 212 | 10 | 22 | 262 | 14 | 1 |
| 163 | 7 | 6 | 213 | 9 | 7 | 263 | 13 | 8 |
| 164 | 8 | 14 | 214 | 10 | 15 | 264 | 14 | 16 |
| 165 | 7 | 21 | 215 | 9 | 22 | 265 | 13 | 1 |
| 166 | 8 | 7 | 216 | 10 | 8 | 266 | 14 | 9 |
| 167 | 7 | 14 | 217 | 11 | 15 | 267 | 13 | 16 |
| 168 | 8 | 22 | 218 | 12 | 1 | 268 | 14 | 2 |
| 169 | 7 | 7 | 219 | 11 | 8 | 269 | 13 | 9 |
| 170 | 8 | 15 | 220 | 12 | 16 | 270 | 14 | 17 |
| 171 | 7 | 1 | 221 | 11 | 1 | 271 | 13 | 2 |
| 172 | 8 | 8 | 222 | 12 | 9 | 272 | 14 | 10 |
| 173 | 9 | 16 | 223 | 11 | 16 | 273 | 13 | 17 |
| 174 | 10 | 1 | 224 | 12 | 2 | 274 | 14 | 3 |
| 175 | 9 | 8 | 225 | 11 | 9 | 275 | 13 | 10 |

FIG. 28-3

| | | | | | | | | |
|---|---|---|---|---|---|---|---|---|
| 26 | 2 | 13 | 76 | 4 | 14 | 126 | 6 | 15 |
| 27 | 1 | 20 | 77 | 3 | 21 | 127 | 5 | 22 |
| 28 | 2 | 6 | 78 | 4 | 7 | 128 | 6 | 8 |
| 29 | 1 | 13 | 79 | 3 | 14 | 129 | 7 | 15 |
| 30 | 2 | 21 | 80 | 4 | 22 | 130 | 8 | 1 |
| 31 | 1 | 6 | 81 | 3 | 7 | 131 | 7 | 8 |
| 32 | 2 | 14 | 82 | 4 | 15 | 132 | 8 | 16 |
| 33 | 1 | 21 | 83 | 3 | 22 | 133 | 7 | 1 |
| 34 | 2 | 7 | 84 | 4 | 8 | 134 | 8 | 9 |
| 35 | 1 | 14 | 85 | 5 | 15 | 135 | 7 | 16 |
| 36 | 2 | 22 | 86 | 6 | 1 | 136 | 8 | 2 |
| 37 | 1 | 7 | 87 | 5 | 8 | 137 | 7 | 9 |
| 38 | 2 | 15 | 88 | 6 | 16 | 138 | 8 | 17 |
| 39 | 1 | 22 | 89 | 5 | 1 | 139 | 7 | 2 |
| 40 | 2 | 8 | 90 | 6 | 9 | 140 | 8 | 10 |
| 41 | 3 | 15 | 91 | 5 | 16 | 141 | 7 | 17 |
| 42 | 4 | 1 | 92 | 6 | 2 | 142 | 8 | 3 |
| 43 | 3 | 8 | 93 | 5 | 9 | 143 | 7 | 10 |
| 44 | 4 | 16 | 94 | 6 | 17 | 144 | 8 | 18 |
| 45 | 3 | 1 | 95 | 5 | 2 | 145 | 7 | 3 |
| 46 | 4 | 9 | 96 | 6 | 10 | 146 | 8 | 11 |
| 47 | 3 | 16 | 97 | 5 | 17 | 147 | 7 | 18 |
| 48 | 4 | 2 | 98 | 6 | 3 | 148 | 8 | 4 |
| 49 | 3 | 9 | 99 | 5 | 10 | 149 | 7 | 11 |
| 50 | 4 | 17 | 100 | 6 | 18 | 150 | 8 | 19 |

FIG. 28-4

| | | | | | | | | |
|---|---|---|---|---|---|---|---|---|
| 176 | 10 | 16 | 226 | 12 | 17 | 276 | 14 | 18 |
| 177 | 9 | 1 | 227 | 11 | 2 | 277 | 13 | 3 |
| 178 | 10 | 9 | 228 | 12 | 10 | 278 | 14 | 11 |
| 179 | 9 | 16 | 229 | 11 | 17 | 279 | 13 | 18 |
| 180 | 10 | 2 | 230 | 12 | 3 | 280 | 14 | 4 |
| 181 | 9 | 9 | 231 | 11 | 10 | 281 | 13 | 11 |
| 182 | 10 | 17 | 232 | 12 | 18 | 282 | 14 | 19 |
| 183 | 9 | 2 | 233 | 11 | 3 | 283 | 13 | 4 |
| 184 | 10 | 10 | 234 | 12 | 11 | 284 | 14 | 12 |
| 185 | 9 | 17 | 235 | 11 | 18 | 285 | 13 | 19 |
| 186 | 10 | 3 | 236 | 12 | 4 | 286 | 14 | 5 |
| 187 | 9 | 10 | 237 | 11 | 11 | 287 | 13 | 12 |
| 188 | 10 | 18 | 238 | 12 | 19 | 288 | 14 | 20 |
| 189 | 9 | 3 | 239 | 11 | 4 | 289 | 13 | 5 |
| 190 | 10 | 11 | 240 | 12 | 12 | 290 | 14 | 13 |
| 191 | 9 | 18 | 241 | 11 | 19 | 291 | 13 | 20 |
| 192 | 10 | 4 | 242 | 12 | 5 | 292 | 14 | 6 |
| 193 | 9 | 11 | 243 | 11 | 12 | 293 | 13 | 13 |
| 194 | 10 | 19 | 244 | 12 | 20 | 294 | 14 | 21 |
| 195 | 9 | 4 | 245 | 11 | 5 | 295 | 13 | 6 |
| 196 | 10 | 12 | 246 | 12 | 13 | 296 | 14 | 14 |
| 197 | 9 | 19 | 247 | 11 | 20 | 297 | 13 | 21 |
| 198 | 10 | 5 | 248 | 12 | 6 | 298 | 14 | 7 |
| 199 | 9 | 12 | 249 | 11 | 13 | 299 | 13 | 14 |
| 200 | 10 | 20 | 250 | 12 | 21 | 300 | 14 | 22 |

RELIABLE HIGH PERFORMANCE DROP GENERATOR FOR AN INKJET PRINTHEAD

CROSS-REFERENCE TO RELATED APPLICATIONS

This application is a continuation application of application Ser. No. 08/608,376, filed on Feb. 28, 1996, which in turn is a continuation-in-part application of application Ser. No. 08/319,896, filed Oct. 6, 1994, entitled "Inkjet Printhead Architecture for High Speed and High Resolution Printing", by Brian J. Keefe, et al, now U.S. Pat. No. 5,648,805, which in turn is a continuation-in-part application of application Ser. No. 08/179,866, filed Jan. 11, 1994 entitled "Improved Ink Delivery System for an Inkjet Printhead," by Brian J. Keefe, et al., now U.S. Pat. No. 5,625,396, which is a continuation application of application Ser. No. 08/862,086, filed Apr. 2, 1992, now U.S. Pat. No. 5,278,584, to Keefe, et al., entitled "Ink Delivery System for an Inkjet Printhead."

This application also relates to the subject matter disclosed in the following U.S. patents and co-pending applications:

U.S. Pat. No. 4,926,197 to Childers, entitled "Plastic Substrate for Thermal Ink Jet Printer";

Application Ser. No. 07/568,000, filed Aug. 16, 1990 now abandoned, entitled "Photo-Ablated Components for Inkjet Printheads";

Application Ser. No. 07/862,668, filed Apr.2, 1992 now abandoned, entitled "Integrated Nozzle Member and TAB Circuit for Inkjet Printhead";

Application Ser. No. 07/862,669, filed Apr. 2, 1992 now U.S. Pat. No. 5,291,226, entitled "Nozzle Member Including Ink Flow Channels";

Application Ser. No. 07/864,889, filed Apr.2, 1992 now U.S. Pat. No. 5,300,959, entitled "Laser Ablated Nozzle Member for Inkjet Printhead";

Application Ser. No. 07/864,822, filed Apr. 2, 1992 now U.S. Pat. No. 5,420,627, entitled "Improved Inkjet Printhead";

Application Ser. No. 07/864,930, filed Apr. 2, 1992 now U.S. Pat. No. 5,297,331, entitled "Structure and Method for Aligning a Substrate With Respect to Orifices in an Inkjet Printhead";

Application Ser. No. 07/864,896, filed Apr. 2, 1992 now U.S. Pat. No. 5,450,113, entitled "Adhesive Seal for an Inkjet Printhead";

Application Ser. No. 07/862,667, filed Apr. 2, 1992 now U.S. Pat. No. 5,309,959, entitled "Efficient Conductor Routing for an Inkjet Printhead";

Application Ser. No. 07/864,890, filed Apr. 2, 1992 now U.S. Pat. No. 5,469,199, entitled "Wide Inkjet Printhead";

Application Ser. No. 08/009,151, filed Jan. 25, 1993 now U.S. Pat. No. 5,387,314, entitled "Fabrication of Ink Fill Slots in Thermal Inkjet Printheads Utilizing Chemical Micromachining";

Application Ser. No. 08/236,915, filed Apr. 29, 1994 now U.S. Pat. No. 5,635,963, entitled "Thermal Inkjet Printer Printhead";

Application Ser. No. 08/235,610, filed Apr. 29, 1994 now U.S. Pat. No. 5,635,966, entitled "Edge Feed Ink Delivery Thermal Inkjet Printhead Structure and Method of Fabrication";

U.S. Pat. No. 4,719,477 to Hess, entitled "Integrated Thermal Ink Jet Printhead and Method of Manufacture";

U.S. Pat. No. 5,122,812 to Hess, et al., entitled "Thermal Inkjet Printhead Having Driver Circuitry Thereon and Method for Making the Same";

U.S. Pat. No. 5,159,353 to Fasen, et al., entitled "Thermal Inkjet Printhead Structure and Method for Making the Same";

Application Ser. No. 08/319,404, filed Oct. 6, 1994 now U.S. Pat. No. 5,604,519, entitled "Inkjet Printhead Architecture for High Frequency Operation";

Application Ser. No. 08/319,892, filed Oct. 6, 1994 now U.S. Pat. No. 5,638,101, entitled "High Density Nozzle Array for Inkjet Printhead";

Application Ser. No. 08/320,084, filed Oct. 6, 1994 now U.S. Pat. No. 5,563,642, entitled "Inkjet Printhead Architecture for High Speed Ink Firing Chamber Refill";

Application Ser. No. 08/319,893, filed Oct. 6, 1994 now U.S. Pat. No. 5,594,481, entitled "Barrier Architecture for Inkjet Printhead";

Application Ser. No. 08/319,895, filed Oct. 6, 1994 now U.S. Pat. No. 5,568,171, entitled "Compact Inkjet Substrate with a Minimal Number of Circuit Interconnects Located at the End Thereof"; and Application Ser. No. 08/319,405, filed Oct. 6, 1994, entitled "Compact Inkjet Substrate with Centrally Located Circuitry and Edge Feed Ink Channels".

The above patents and co-pending applications are assigned to the present assignee and are incorporated herein by reference.

FIELD OF THE INVENTION

The present invention generally relates to inkjet and other types of printers and, more particularly, to an inkjet drop generator, which comprises the printhead portion of an inkjet printer and the ink contained therein.

BACKGROUND OF THE INVENTION

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and affordable.

An inkjet printhead generally includes: (1) ink channels to supply ink from an ink reservoir to each vaporization chamber proximate to an orifice; (2) a metal orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated orifice onto the paper.

In an inkjet printhead, described in U.S. Pat. No. 4,683,481 to Johnson, entitled "Thermal Ink Jet Common-Slotted Ink Feed Printhead," ink is fed from an ink reservoir to the various vaporization chambers through an elongated hole formed in the substrate. The ink then flows to a manifold area, formed in a barrier layer between the substrate and a nozzle member, then into a plurality of ink channels, and finally into the various vaporization chambers. This design may be classified as a "center" feed design, whereby ink is fed to the vaporization chambers from a central location then distributed outward into the vaporization chambers. Some disadvantages of this type of ink feed design are that manufacturing time is required to make the hole in the substrate, and the required substrate area is increased by at least the area of the hole. Also, once the hole is formed, the substrate is relatively fragile, making handling more difficult. Further, the manifold inherently provides some restriction of ink flow to the vaporization chambers such that the energization of heater elements within a vaporization chamber may affect the flow of ink into a nearby vaporization chamber, thus producing crosstalk which affects the amount of ink emitted by an orifice upon energization of a nearby heater element. More importantly, prior printhead design limited the ability of printheads to have the high nozzle densities and the high operating frequencies and firing rates required for increased resolution and throughput. Print resolution depends on the density of ink-ejecting orifices and heating resistors formed on the cartridge printhead substrate. Modem circuit fabrication techniques allow the placement of substantial numbers of resistors on a single printhead substrate. However, the number of resistors applied to the substrate is limited by the conductive components used to electrically connect the cartridge to external driver circuitry in the printer unit. Specifically, an increasingly large number of resistors requires a correspondingly large number of interconnection pads, leads, and the like. This increase in components and interconnects causes greater manufacturing/production costs, and increases the probability that defects will occur during the manufacturing process. In order to solve this problem, thermal inkjet printheads have been developed which incorporate pulse driver circuitry directly on the printhead substrate with the resistors. The incorporation of driver circuitry on the printhead substrate in this manner reduces the number of interconnect components needed to electrically connect the cartridge to the printer unit. This results in an improved degree of production and operating efficiency. This development is described in U.S. Pat. Nos. 4,719,477 and 5,122,812 which are herein incorporated by reference.

To produce high-efficiency, integrated printing systems as described above, significant research has been conducted in order to develop improved transistor structures and methods for integrating the same into thermal inkjet printing units. The integration of driver components and printing resistors onto a common substrate results in a need for specialized, multi-layer connective circuitry so that the driver transistors can communicate with the resistors and other portions of the printing system. Typically, this connective circuitry involves a plurality of separate conductive layers, each being formed using conventional circuit fabrication techniques.

To create the resistors, an electrically conducting layer is positioned on selected portions of the layer of resistive material in order to form covered sections of the resistive materials and uncovered sections thereof. The uncovered sections ultimately function as heating resistors in the printhead. The covered sections are used to form continuous conductive links between the electrical contact regions of the transistors and other components in the printing system. Thus, the layer of resistive material performs dual functions: (1) as heating resistors in the system, and (2) as direct conductive pathways to the drive transistors. This substantially eliminates the need to use multiple layers for carrying out these functions alone.

A selected portion of protective material is then applied to the covered and uncovered sections of resistive material. Thereafter, an orifice plate having a plurality of openings through the plate was positioned on the protective material. Beneath the openings, a section of the protective material which was removed forms ink firing cavities or vaporization chambers. Positioned at the bottom surface of each chamber is one of the heater resistors. The electrical activation of each resistor causes the resistor to rapidly heat and vaporize a portion of the ink in the cavity. The rapidly formed (nucleated) ink bubble ejects a droplet of ink from the orifice associated with the activated resistor and ink firing vaporization chamber.

To increase resolution and print quality, the printhead nozzles must be placed closer together. This requires that both heater resistors and the associated orifices be placed closer together. To increase printer throughput, the width of the printing swath must be increased by placing more nozzles on the print head. However, adding resistors and nozzles requires adding associated power and control interconnections. These interconnections are conventionally flexible wires or equivalent conductors that electrically connect the transistor drivers on the printhead to printhead interface circuitry in the printer. They may be contained in a ribbon cable that connects on one end to control circuitry within the printer and on the other end to driver circuitry on the printhead. An increased number of heater resistors spaced closer together also creates a greater likelihood of crosstalk and increased difficulty in supplying ink to each vaporization chamber quickly.

Interconnections are a major source of cost in printer design, and adding them in increase the number of heater resistors increases the cost and reduces the reliability of the printer. Thus, as the number of drivers on a printhead has increased over the years, there have been attempts to reduce the number of interconnections per driver. A matrix approach offers an improvement over the direct drive approach, yet as previously realized a matrix approach has its drawbacks. The number of interconnections with a simple matrix is still large and still results in an undesirable increase in the number of interconnections.

Another concern with inkjet printing is the sufficiency of ink flow to the paper or other print media. Print quality is also a function of ink flow through the printhead. Too little ink on the paper or other media to be printed upon produces faded and hard-to-read printed documents. Ink flow from its storage space to the ink firing chamber has suffered, in previous printhead designs, from an inability to be rapidly supplied to the firing chambers. The manifold from the ink source inherently provides some restriction on ink flow to the firing chambers thereby reducing the speed of printhead operation as well as resulting in crosstalk.

As indicated above, most print cartridges have been based on a "center feed" design; this design commonly uses dye-based ink. This design, however, was not totally adequate for a number of reasons: (1) the dye-based inks tend to fade over time; (2) most inkjet inks run when water is poured over them; (3) optical densities of dye-based inks are limited; (4) center feed architectures tend to have limited firing frequencies; and (5) previous ink compositions tend to dry slowly, so even if the firing frequency is improved, the time between printing pages has to be controlled, which can limit the advantages of faster firing frequencies.

A more recent design has helped to alleviate some of the foregoing drawbacks by use of pigment-based ink. This solves the permanence issue, an improvement upon water-fastness. However, this design, available commercially from Hewlett-Packard Company under the product number 51645A and used with the DeskJet® 855C and DeskJet® 1600C printers, also employs a center feed pen.

To resolve these needs of increased printing speed, resolution and quality, increased throughput, reduced number of interconnections, and improved ink flow control for higher frequency firing rates, a drop generator for inkjet printing for forming dot matrix images on paper, comprising a combination of an inkjet printer printhead and ink compatible therewith, preferably with the architecture of the printhead and the ink mutually tuned, is desirable.

SUMMARY OF THE INVENTION

In accordance with the present invention, an inkjet drop ejection system is provided comprising:

(a) a substantially rectangular substrate having a top surface and an opposing bottom surface, and having a first outer edge along a periphery of the substrate and a second outer edge along the opposite periphery of the substrate;

(b) a nozzle member having a plurality of ink orifices formed therein, the nozzle member being positioned to overlie the top surface of the substrate;

(c) first and second pluralities of ink ejection elements formed on the top surface of the substrate, each of the ink ejection elements comprising an firing element in a vaporization chamber and being located approximate to an associated one of the orifices for causing a portion of ink to be expelled from the associated orifice, the first plurality of ink ejection elements arranged in a first array along the first outer edge and the second plurality of ink ejection elements arranged in a second array along the second outer edge;

(d) an ink reservoir for holding a quantity of ink;

(e) a fluid channel, communicating with the reservoir, leading to each of the orifices and the ink ejection elements, the fluid channel allowing ink to flow from the ink reservoir, around the first outer edge of the substrate and to the top edge of the substrate so as to be proximate to the orifices and the ink ejection elements;

(f) a separate inlet passage defined by a barrier layer for each vaporization chamber connecting the secondary channel with the vaporization chamber for allowing high frequency refill of the vaporization chamber;

(g) the separate inlet passage for each vaporization chamber having pinch points formed in the barrier layer to prevent cross-talk and overshoot during high frequency operation;

(h) circuit means for transmitting firing signals to the ink firing elements at a maximum frequency greater than 9 KHz; and (i) the inkjet drop ejection system forming a part of a color set of comprising at least one ink, the ink comprising at least one colorant in an aqueous vehicle.

The rectangular substrate may be formed with the firing elements arranged in a staggered configuration along the substrate such that adjacent firing elements are located at different shelf lengths (staggered) along the edge thereof. Alternatively, the rectangular substrate may be formed with the firing elements arranged along the substrate at substantially identical shelf lengths (non-staggered) along the edge thereof. This latter configuration is obtained by changing the orientation of the printhead relative to the direction of scan axis, and provides the same printing result as staggering the firing elements.

The colorant comprises either a pigment, black or colored (cyan, yellow, or magenta) or a water-miscible dye, black or colored (cyan, yellow, or magenta). If a pigment is used, then a pigment dispersant is employed in combination with the pigment to disperse the pigment in the aqueous-based vehicle.

In the staggered configuration, peninsulas are formed between firing elements to reduce cross-talk, and the shelf length distance from edge of manifold to the firing elements varies from 90 to 130 microns, depending on the stagger. In the non-staggered configuration, the shelf length is about 55 microns; due to the short shelf length, there are no peninsulas. The former embodiment can operate at maximum frequencies of about 12 KHz, while the latter embodiment can operate at maximum frequencies up to 20 KHz.

The combination of the pen architecture (the elements of the printhead) and the ink composition comprises the ink drop generator, and in the preferred case are tuned for maximum performance. Tuning of the pen architecture is achieved by optimizing distances such as shelf length and configuring the shape of the vaporization chambers (square versus round), and the like. Tuning of the ink composition is achieved by optimizing physical and chemical parameters, such as pH, viscosity, and surface tension.

One embodiment of this invention provides an improved ink flow path between an ink reservoir and ink ejection chambers in an inkjet printhead as well as provides an improved architecture of a barrier layer and nozzle member for the printhead. In the preferred embodiment, a barrier layer containing ink channels and vaporization chambers is located between a rectangular substrate and a nozzle member containing an array of orifices. The substrate contains two linear arrays of heater elements, and each orifice in the nozzle member is associated with a vaporization chamber and heater element. The ink channels in the barrier layer have ink entrances generally running along two opposite edges of the substrate so that ink flowing around the edges of the substrate gain access to the ink channels and to the vaporization chambers. Piezoelectric elements can be used instead of heater elements.

Using the above-described ink flow path (i.e., edge feed), there is no need for a hole or slot in the substrate to supply ink to a centrally located ink manifold in the barrier layer. Hence, the manufacturing time to form the substrate is reduced. Further, the substrate area can be made smaller for a given number of heater elements. The substrate is also less fragile than a similar substrate with a slot, thus simplifying the handling of the substrate. Further, in this edge-feed design, the entire back surface of the silicon substrate can be cooled by the ink flow across it. Thus, steady state power dissipation is improved.

Other advantages will become apparent after reading the disclosure.

BRIEF DESCRIPTION OF THE DRAWINGS

The present invention can be further understood by reference to the following description and attached drawings which illustrate the preferred embodiment.

Other features and advantages will be apparent from the following detailed description of the preferred embodiment, taken in conjunction with the accompanying drawings, which illustrate, by way of example, the principles of the invention.

FIG. 8 is a perspective view of the headland area of the inkjet print cartridge of FIG. 7.

FIG. 10 is a perspective view of a portion of the inkjet print cartridge of FIG. 3 illustrating the configuration of a seal which is formed between the ink cartridge body and the TAB head assembly.

FIG. 11 is a top perspective view of a substrate structure containing heater resistors, ink channels, and vaporization chambers, which is mounted on the back of the TAB head assembly of FIG. 4.

FIG. 12 is a top perspective view, partially cut away, of a portion of the TAB head assembly showing the relationship of an orifice with respect to a vaporization chamber, a heater resistor, and an edge of the substrate.

FIG. 22 is a view of one arrangement of orifices and the associated heater resistors on a printhead.

FIG. 22 is an enlargement of a portion of FIG. 22.

FIG. 24 is a table showing the spatial location of the 300 orifice nozzles of one embodiment of the present invention.

FIG. 28 is a table showing the primitive select line and address select line for each of the 300 heater orifice/resistors of one embodiment of the present invention.

DETAILED DESCRIPTION OF THE PREFERRED EMBODIMENTS

A. Printhead Architecture

Figure 1:
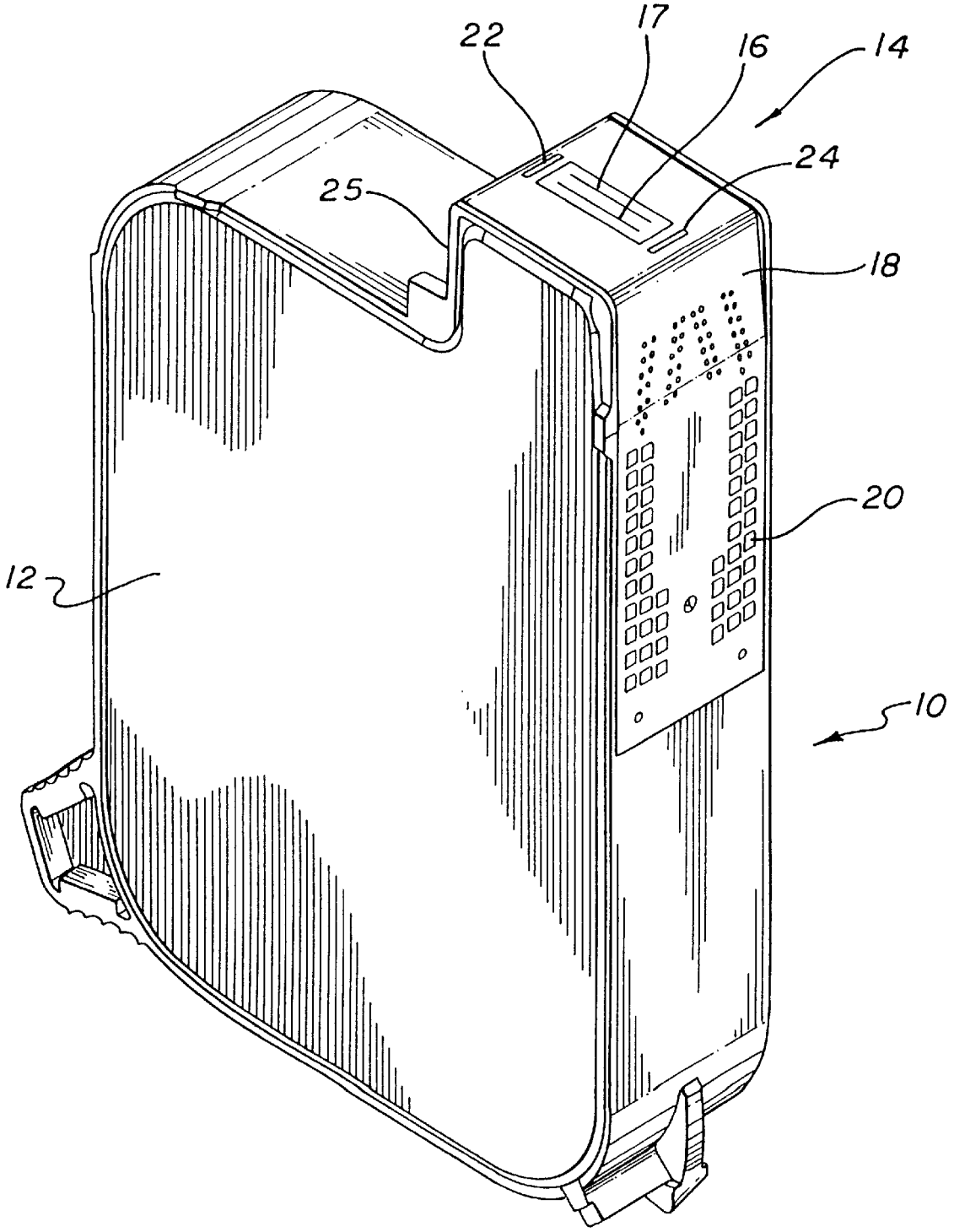
FIG. 1 is a perspective view of an inkjet print cartridge according to one embodiment of the present invention.

Referring to FIG. 1, reference numeral 10 generally indicates an inkjet print cartridge incorporating a printhead according to one embodiment of the present invention simplified for illustrative purposes. The inkjet print cartridge 10 includes an ink reservoir 12 and a printhead 14, where the printhead 14 is formed using Tape Automated Bonding (TAB). The printhead 14 (hereinafter "TAB head assembly 14") includes a nozzle member 16 comprising two parallel columns of offset holes or orifices 17 formed in a flexible polymer flexible circuit 18 by, for example, laser ablation.

A back surface of the flexible circuit 18 includes conductive traces 36 formed thereon using a conventional photolithographic etching and/or plating process. These conductive traces 36 are terminated by large contact pads 20 designed to interconnect with a printer. The print cartridge 10 is designed to be installed in a printer so that the contact pads 20, on the front surface of the flexible circuit 18, contact printer electrodes providing externally generated energization signals to the printhead.

Windows 22 and 24 extend through the flexible circuit 18 and are used to facilitate bonding of the other ends of the conductive traces 36 to electrodes on a silicon substrate containing heater resistors. The windows 22 and 24 are filled with an encapsulant to protect any underlying portion of the traces and substrate.

In the print cartridge 10 of FIG. 1, the flexible circuit 18 is bent over the back edge of the print cartridge "snout" and extends approximately one half the length of the back wall 25 of the snout. This flap portion of the flexible circuit 18 is needed for the routing of conductive traces 36 which are connected to the substrate electrodes through the far end window 22. The contact pads 20 are located on the flexible circuit 18 which is secured to this wall and the conductive traces 36 are routed over the bend and are connected to the substrate electrodes through the windows 22, 24 in the flexible circuit 18.

Figure 2:
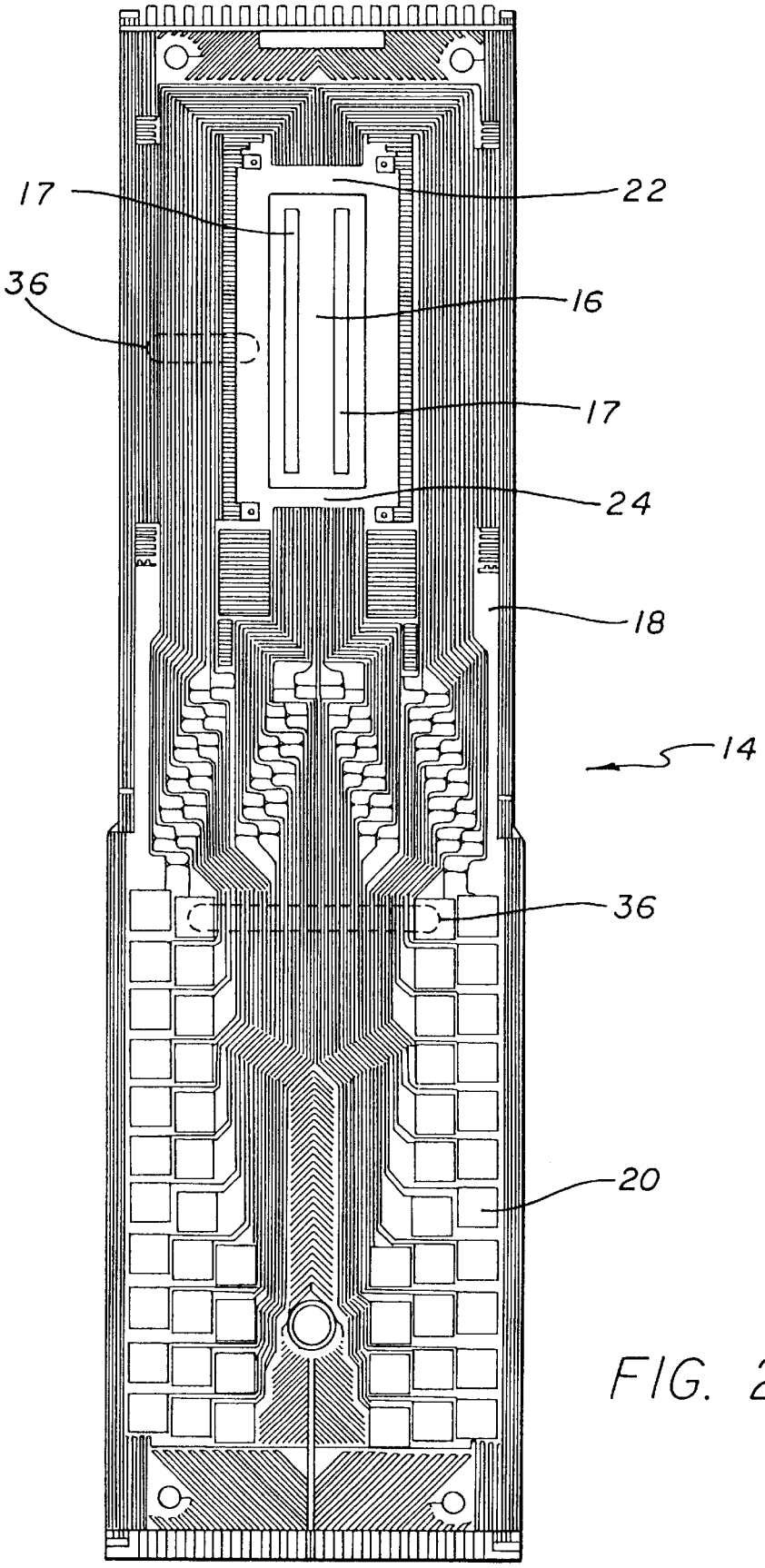
FIG. 2 is a perspective view of the front surface of the Tape Automated Bonding (TAB) printhead assembly (hereinafter "TAB head assembly") removed from the print cartridge of FIG. 1.

FIG. 2 shows a front view of the TAB head assembly 14 of FIG. 1 removed from the print cartridge 10 and prior to windows 22 and 24 in the TAB head assembly 14 being filled with an encapsulant. TAB head assembly 14 has affixed to the back of the flexible circuit 18 a silicon substrate 28 (not shown) containing a plurality of individually energizable thin film resistors. Each resistor is located generally behind a single orifice 17 and acts as an ohmic heater when selectively energized by one or more pulses applied sequentially or simultaneously to one or more of the contact pads 20.

The orifices 17 and conductive traces 36 may be of any size, number, and pattern, and the various figures are designed to simply and clearly show the features of the invention. The relative dimensions of the various features have been greatly adjusted for the sake of clarity.

Figure 14:
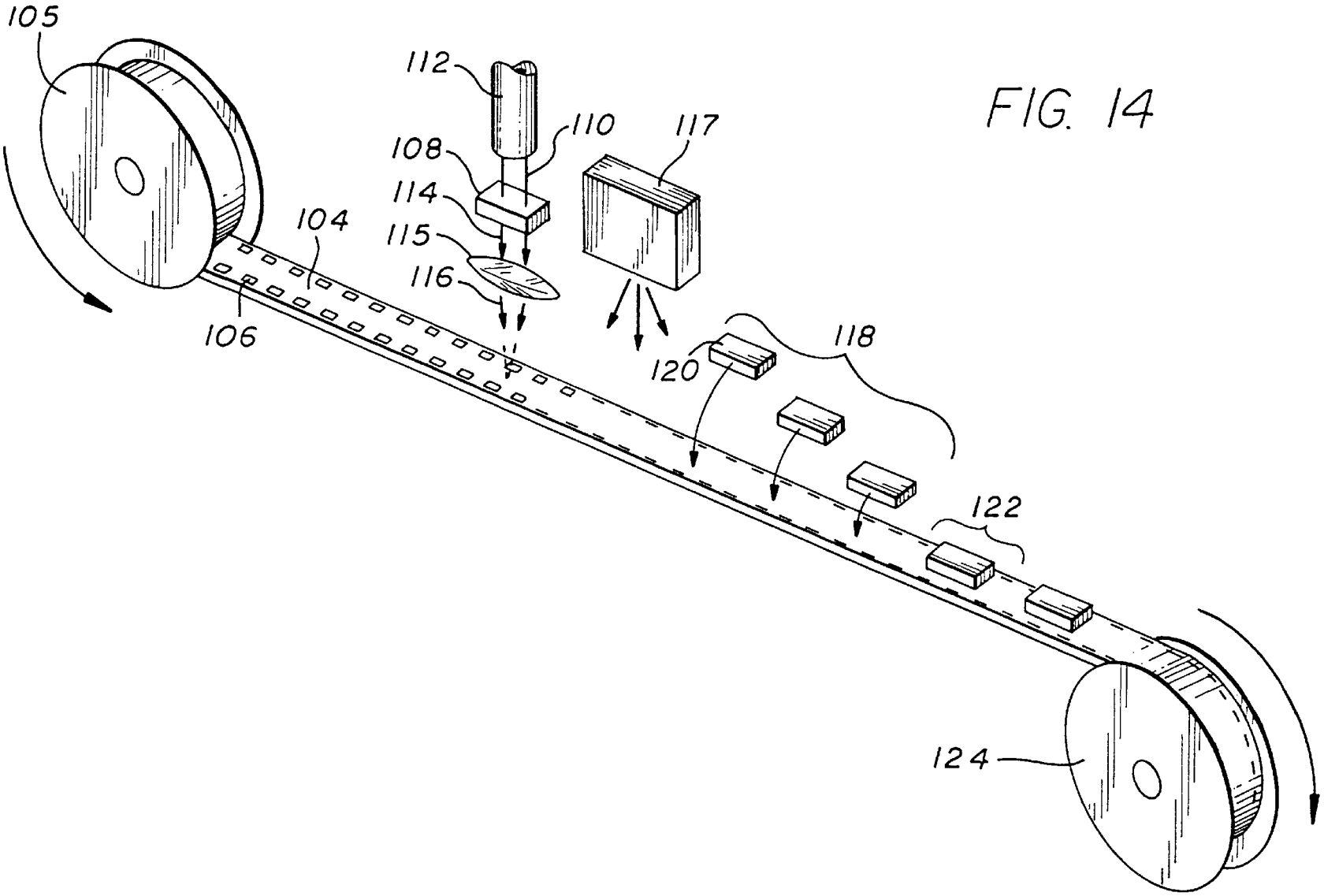
FIG. 14 illustrates one process which may be used to form the preferred TAB head assembly.

The orifice 17 pattern on the flexible circuit 18 shown in FIG. 2 may be formed by a masking process in combination with a laser or other etching means in a step-and-repeat process, which would be readily understood by one of ordinary skilled in the art after reading this disclosure. FIG. 14, to be described in detail later, provides additional details of this process. Further details regarding TAB head assembly 14 and flexible circuit 18 are provided below.

Figure 3:
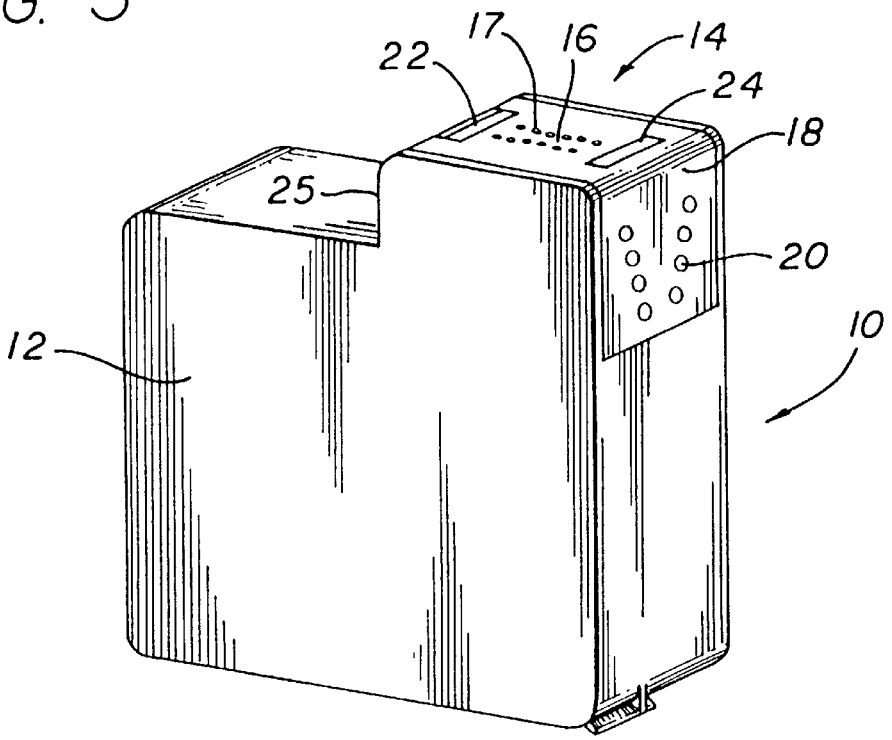
FIG. 3 is a perspective view of an simplified schematic of the inkjet print cartridge of FIG. 1 for illustrative purposes.
Figure 4:
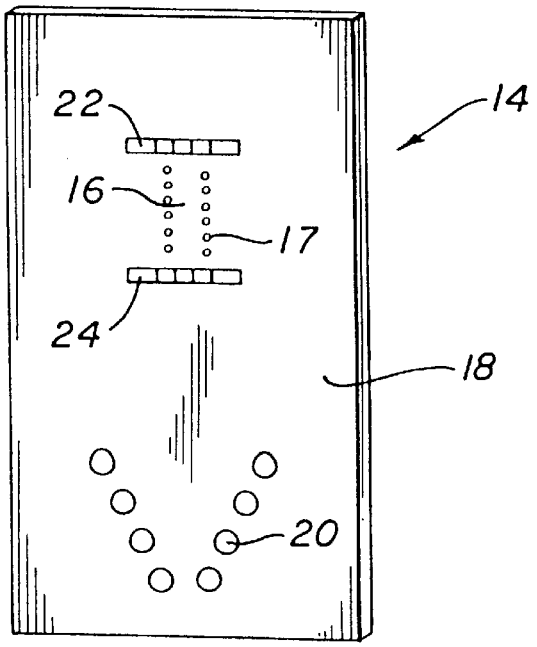
FIG. 4 is a perspective view of the front surface of the Tape Automated Bonding (TAB) printhead assembly (hereinafter "TAB head assembly") removed from the print cartridge of FIG. 3.

FIG. 3 is a perspective view of a simplified schematic of the inkjet print cartridge of FIG. 1 for illustrative purposes. FIG. 4 is a perspective view of the front surface of the Tape Automated Bonding (TAB) printhead assembly (hereinafter "TAB head assembly") removed from the simplified schematic print cartridge of FIG. 3.

Figure 5:
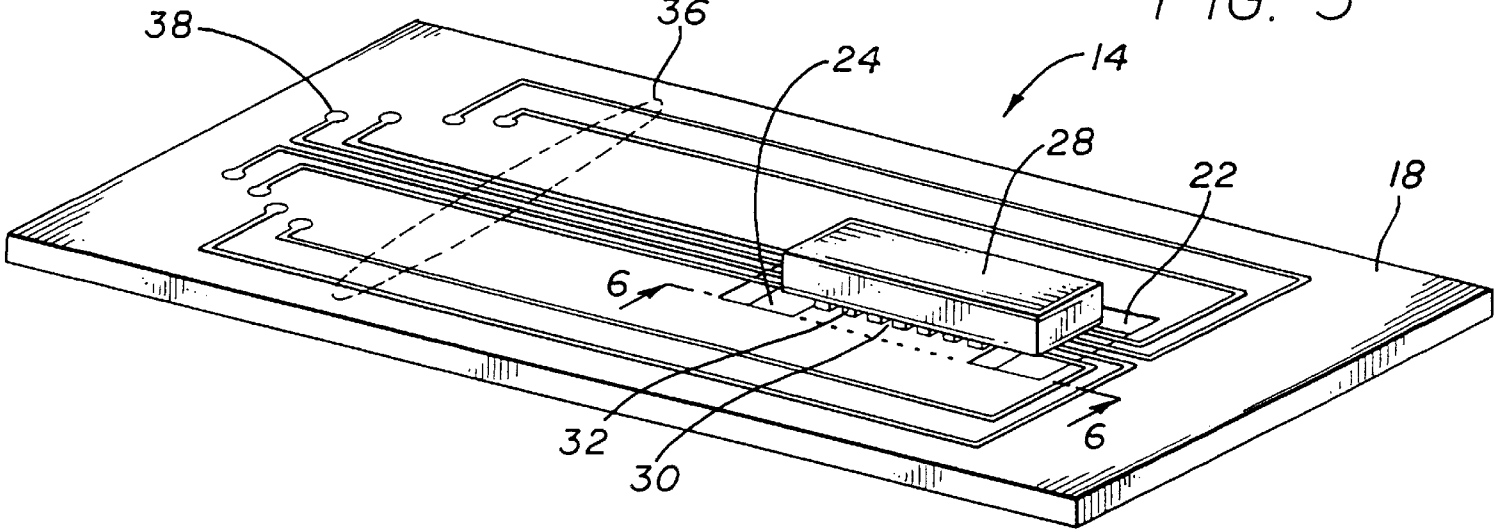
FIG. 5 is a perspective view of the back surface of the TAB head assembly of FIG. 4 with a silicon substrate mounted thereon and the conductive leads attached to the substrate.

FIG. 5 shows the back surface of the TAB head assembly 14 of FIG. 4 showing the silicon die or substrate 28 mounted to the back of the flexible circuit 18 and also showing one edge of the barrier layer 30 formed on the substrate 28 containing ink channels and vaporization chambers. FIG. 7 shows greater detail of this barrier layer 30 and will be discussed later. Shown along the edge of the barrier layer 30 are the entrances to the ink channels 32 which receive ink from the ink reservoir 12. The conductive traces 36 formed on the back of the flexible circuit 18 terminate in contact pads 20 ( shown in FIG. 4) on the opposite side of the flexible circuit 18. The windows 22 and 24 allow access to the ends of the conductive traces 36 and the substrate electrodes 40 (shown in FIG. 6) from the other side of the flexible circuit 18 to facilitate bonding.

Figure 6:
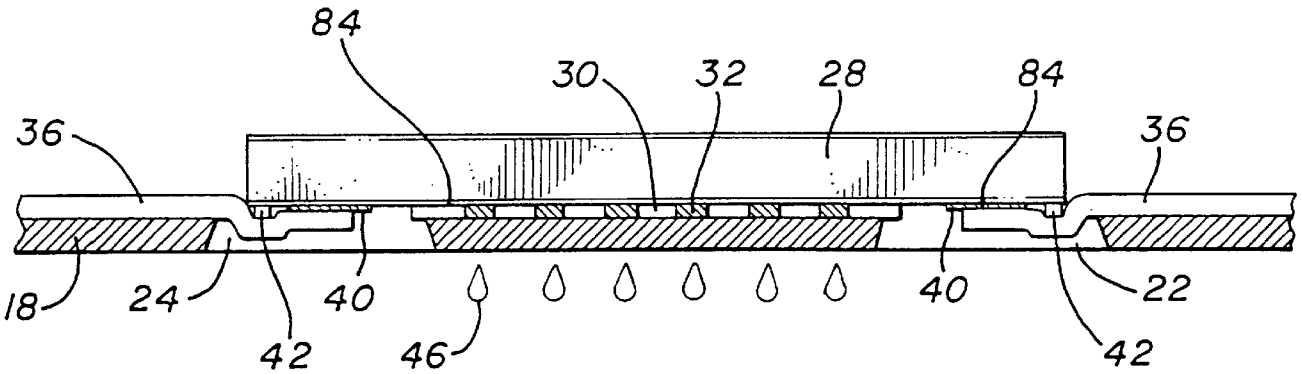
FIG. 6 is a side elevational view in cross-section taken along line 6—6 in FIG. 5 illustrating the attachment of conductive leads to electrodes on the silicon substrate.
Figure 7:
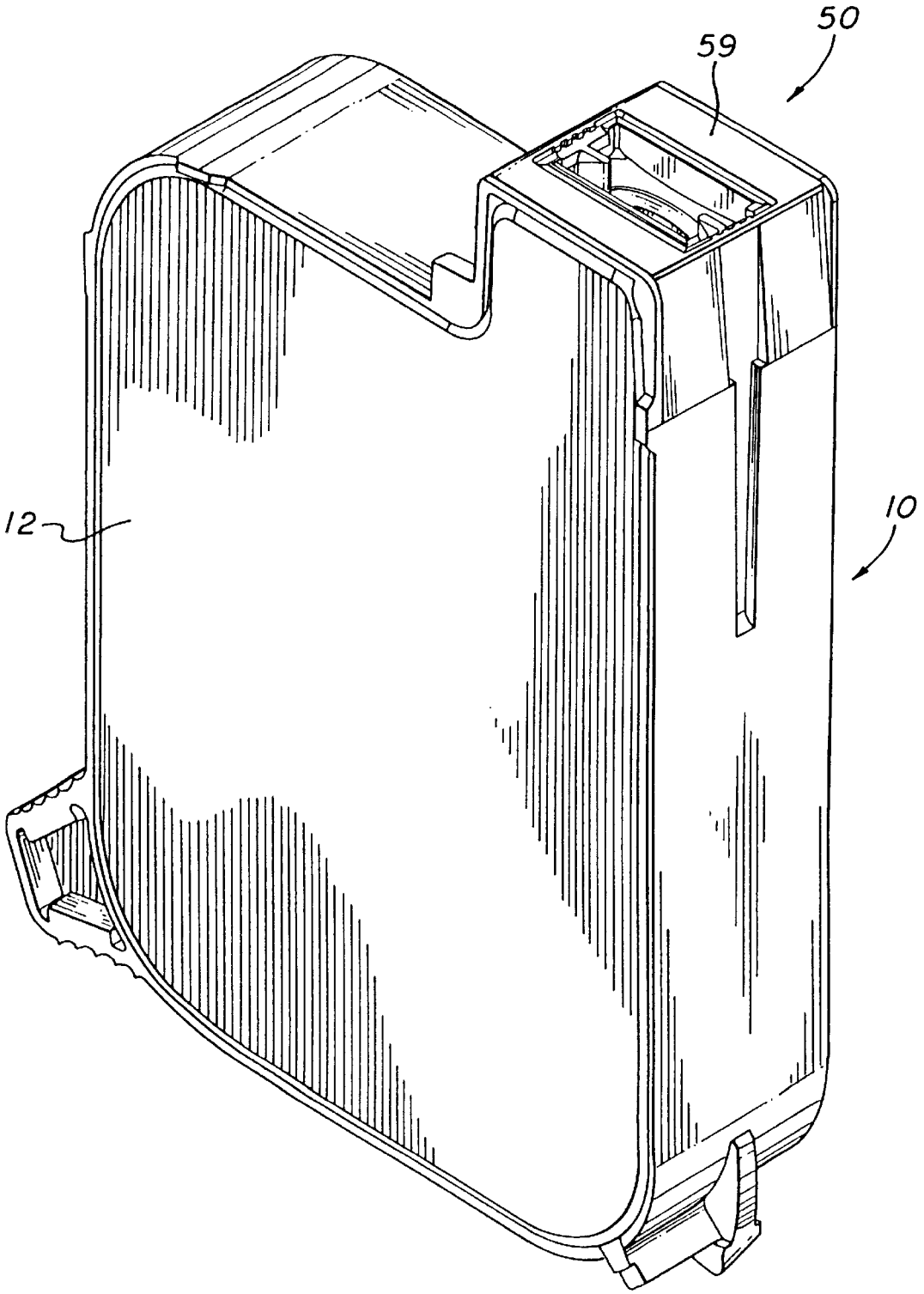
FIG. 7 is a perspective view of the inkjet print cartridge of FIG. 1 with the TAB head assembly removed.

FIG. 6 shows a side view cross-section taken along line A—A in FIG. 5 illustrating the connection of the ends of the conductive traces 36 to the electrodes 40 formed on the substrate 28. As seen in FIG. 6, a portion 42 of the barrier layer 30 is used to insulate the ends of the conductive traces 36 from the substrate 28. Also shown in FIG. 6 is a side view of the flexible circuit 18, the barrier layer 30, the windows 22 and 24, and the entrances of the various ink channels 32. Droplets of ink 46 are shown being ejected from orifice holes associated with each of the ink channels 32.

Figure 9:
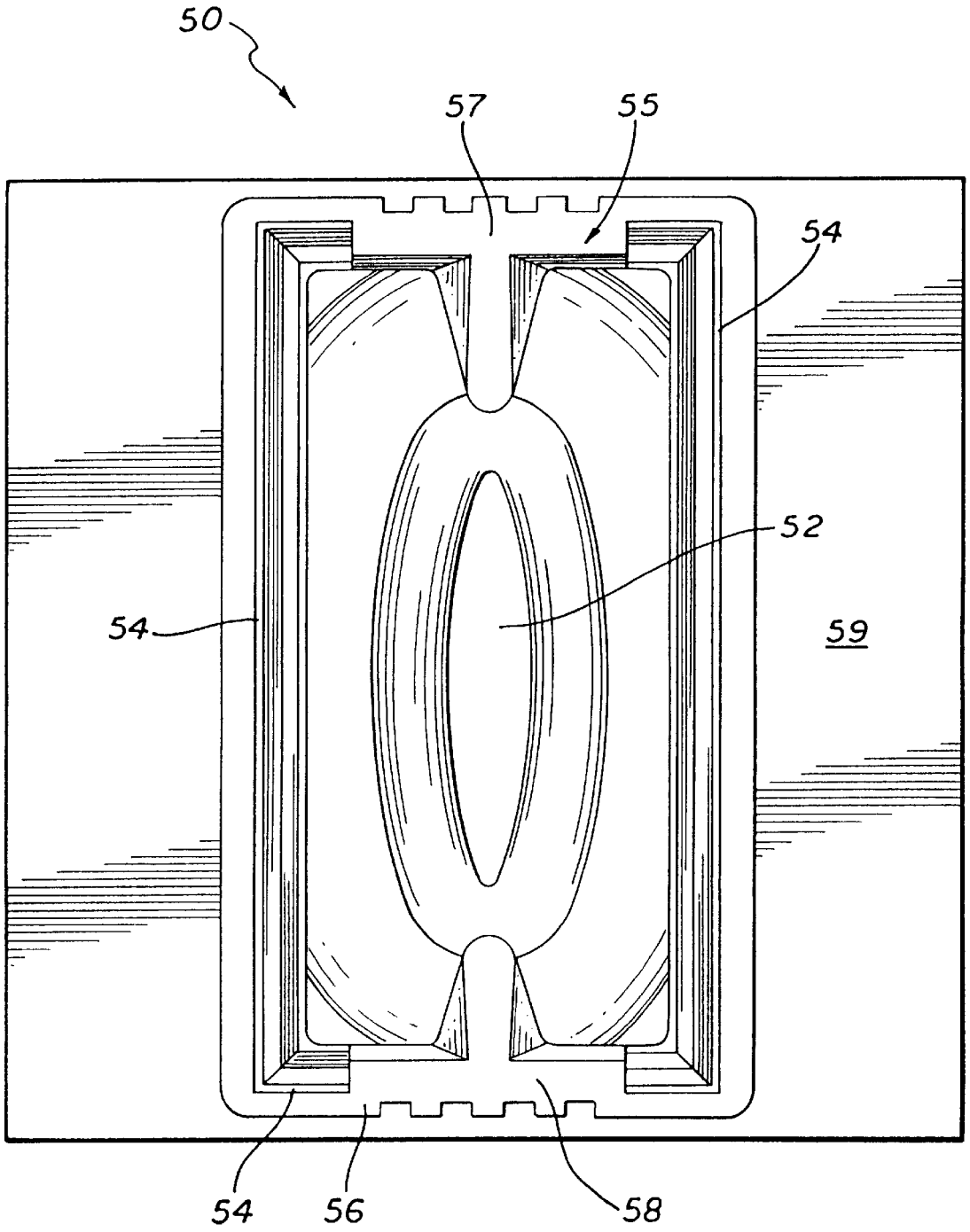
FIG. 9 is a top plan view of the headland area of the inkjet print cartridge of FIG. 7.

FIG. 7 shows the print cartridge 10 of FIG. 1 with the TAB head assembly 14 removed to reveal the headland pattern 50 used in providing a seal between the TAB head assembly 14 and the printhead body. FIG. 8 shows the headland area in enlarged perspective view. FIG. 9 shows the headland area in an enlarged top plan view. The headland characteristics are exaggerated for clarity. Shown in FIGS. 8 and 9 is a central slot 52 in the print cartridge 10 for allowing ink from the ink reservoir 12 to flow to the back surface of the TAB head assembly 14.

The headland pattern 50 formed on the print cartridge 10 is configured so that a bead of epoxy adhesive (not shown) dispensed on the inner raised walls 54 and across the wall openings 55 and 56 (so as to circumscribe the substrate when the TAB head assembly 14 is in place) will form an ink seal between the body of the print cartridge 10 and the back of the TAB head assembly 14 when the TAB head assembly 14 is pressed into place against the headland pattern 50. Other adhesives which may be used include hot-melt, silicone, UV curable adhesive, and mixtures thereof. Further, a patterned adhesive film may be positioned on the headland, as opposed to dispensing a bead of adhesive.

Figure 13:
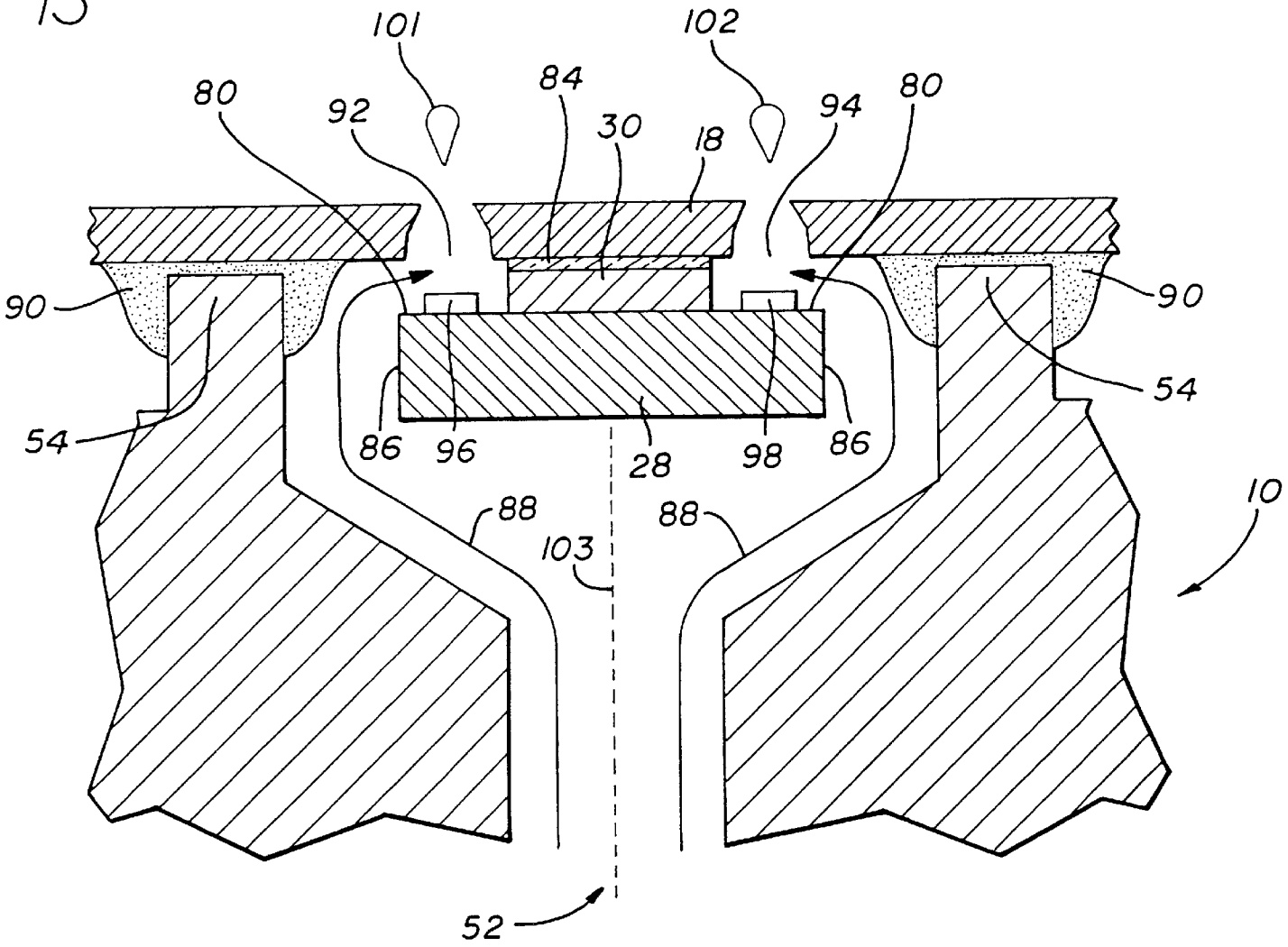
FIG. 13 is a schematic cross-sectional view taken along line B—B of FIG. 10 showing the adhesive seal between the TAB head assembly and the print cartridge as well as the ink flow path around the edges of the substrate.

When the TAB head assembly 14 of FIG. 5 is properly positioned and pressed down on the headland pattern 50 in FIG. 8 after the adhesive (not shown) is dispensed, the two short ends of the substrate 28 will be supported by the surface portions 57 and 58 within the wall openings 55 and 56. Additional details regarding adhesive 90 are shown in FIG. 13. The configuration of the headland pattern 50 is such that, when the substrate 28 is supported by the surface portions 57 and 58, the back surface of the flexible circuit 18 will be slightly above the top of the raised walls 54 and approximately flush with the flat top surface 59 of the print cartridge 10. As the TAB head assembly 14 is pressed down onto the headland 50, the adhesive is squished down. From the top of the inner raised walls 54, the adhesive overspills into the gutter between the inner raised walls 54 and the outer raised wall 60 and overspills somewhat toward the slot 52. From the wall openings 55 and 56, the adhesive squishes inwardly in the direction of slot 52 and squishes outwardly toward the outer raised wall 60, which blocks further outward displacement of the adhesive. The outward displacement of the adhesive not only serves as an ink seal, but encapsulates the conductive traces in the vicinity of the headland 50 from underneath to protect the traces from ink.

FIG. 10 shows a portion of the completed print cartridge 10 of FIG. 3 illustrating, by cross-hatching, the location of the underlying adhesive 90 (not shown) which forms the seal between the TAB head assembly 14 and the body of the print cartridge 10. In FIG. 10 the adhesive is located generally between the dashed lines surrounding the array of orifices 17, where the outer dashed line 62 is slightly within the boundaries of the outer raised wall 60 in FIG. 7, and the inner dashed line 64 is slightly within the boundaries of the inner raised walls 54 in FIG. 7. The adhesive is also shown being squished through the wall openings 55 and 56 (FIG. 7) to encapsulate the traces leading to electrodes on the substrate. A cross-section of this seal taken along line B—B in FIG. 10 is also shown in FIG. 13, to be discussed later.

This seal formed by the adhesive 90 circumscribing the substrate 28 allows ink to flow from slot 52 and around the sides of the substrate to the vaporization chambers formed in the barrier layer 30, but will prevent ink from seeping out from under the TAB head assembly 14. Thus, this adhesive seal 90 provides a strong mechanical coupling of the TAB head assembly 14 to the print cartridge 10, provides a fluidic seal, and provides trace encapsulation. The adhesive seal is also easier to cure than prior art seals, and it is much easier to detect leaks between the print cartridge body and the printhead, since the sealant line is readily observable. Further details on adhesive seal 90 are shown in FIG. 13.

FIG. 11 is a front perspective view of the silicon substrate 28 which is affixed to the back of the flexible circuit 18 in FIG. 5 to form the TAB head assembly 14. Silicon substrate 28 has formed on it, using conventional photolithographic techniques, two rows or columns of thin film resistors 70, shown in FIG. 11 exposed through the vaporization chambers 72 formed in the barrier layer 30.

In one embodiment, the substrate 28 is approximately one-half inch long and contains 300 heater resistors 70, thus enabling a resolution of 600 dots per inch. Heater resistors 70 may instead be any other type of ink ejection element, such as a piezoelectric pump-type element or any other conventional element. Thus, element 70 in all the various figures may be considered to be piezoelectric elements in an alternative embodiment without affecting the operation of the printhead. Also formed on the substrate 28 are electrodes 74 for connection to the conductive traces 36 (shown by dashed lines) formed on the back of the flexible circuit 18.

A demultiplexer 78, shown by a dashed outline in FIG. 11, is also formed on the substrate 28 for demultiplexing the incoming multiplexed signals applied to the electrodes 74 and distributing the signals to the various thin film resistors 70. The demultiplexer 78 enables the use of much fewer electrodes 74 than thin film resistors 70. Having fewer electrodes allows all connections to the substrate to be made from the short end portions of the substrate, as shown in FIG. 4, so that these connections will not interfere with the ink flow around the long sides of the substrate. The demultiplexer 78 may be any decoder for decoding encoded signals applied to the electrodes 74. The demultiplexer has input leads (not shown for simplicity) connected to the electrodes 74 and has output leads (not shown) connected to the various resistors 70. The demultiplexer 78 circuitry is discussed in further detail below.

Also formed on the surface of the substrate 28 using conventional photolithographic techniques is the barrier layer 30, which may be a layer of photoresist or some other polymer, in which is formed the vaporization chambers 72 and ink channels 80. A portion 42 of the barrier layer 30 insulates the conductive traces 36 from the underlying substrate 28, as previously discussed with respect to FIG. 4.

In order to adhesively affix the top surface of the barrier layer 30 to the back surface of the flexible circuit 18 shown in FIG. 5, a thin adhesive layer 84 (not shown), such as an uncured layer of poly-isoprene photoresist, is applied to the top surface of the barrier layer 30. A separate adhesive layer may not be necessary if the top of the barrier layer 30 can be otherwise made adhesive. The resulting substrate structure is then positioned with respect to the back surface of the flexible circuit 18 so as to align the resistors 70 with the orifices formed in the flexible circuit 18. This alignment step also inherently aligns the electrodes 74 with the ends of the conductive traces 36. The traces 36 are then bonded to the electrodes 74. This alignment and bonding process is described in more detail later with respect to FIG. 14. The aligned and bonded substrate/flexible circuit structure is then heated while applying pressure to cure the adhesive layer 84 and firmly affix the substrate structure to the back surface of the flexible circuit 18.

FIG. 12 is an enlarged view of a single vaporization chamber 72, thin film resistor 70, and frustum shaped orifice 17 after the substrate structure of FIG. 11 is secured to the back of the flexible circuit 18 via the thin adhesive layer 84. A side edge of the substrate 28 is shown as edge 86. In operation, ink flows from the ink reservoir 12 around the side edge 86 of the substrate 28, and into the ink channel 80 and associated vaporization chamber 72, as shown by the arrow 88. Upon energization of the thin film resistor 70, a thin layer of the adjacent ink is superheated, causing explosive vaporization and, consequently, causing a droplet of ink to be ejected through the orifice 17. The vaporization chamber 72 is then refilled by capillary action.

In a preferred embodiment, the barrier layer 30 is approximately 1 mils thick, the substrate 28 is approximately 20 mils thick, and the flexible circuit 18 is approximately 2 mils thick.

Shown in FIG. 13 is a side elevational view cross-section taken along line B—B in FIG. 10 showing a portion of the adhesive seal 90, applied to the inner raised wall 54 and wall openings 55, 56, surrounding the substrate 28 and showing the substrate 28 being adhesively secured to a central portion of the flexible circuit 18 by the thin adhesive layer 84 on the top surface of the barrier layer 30 containing the ink channels and vaporization chambers 92 and 94. A portion of the plastic body of the printhead cartridge 10, including raised walls 54 shown in FIGS. 7 and 8, is also shown.

FIG. 13 also illustrates how ink 88 from the ink reservoir 12 flows through the central slot 52 formed in the print cartridge 10 and flows around the edges 86 of the substrate 28 through ink channels 80 into the vaporization chambers 92 and 94. Thin film resistors 96 and 98 are shown within the vaporization chambers 92 and 94, respectively. When the resistors 96 and 98 are energized, the ink within the vaporization chambers 92 and 94 are ejected, as illustrated by the emitted drops of ink 101 and 102.

The edge feed feature, where ink flows around the edges 86 of the substrate 28 and directly into ink channels 80, has a number of advantages over previous center feed printhead designs which form an elongated central hole or slot running lengthwise in the substrate to allow ink to flow into a central manifold and ultimately to the entrances of ink channels. One advantage is that the substrate or die 28 width can be made narrower, due to the absence of the elongated central hole or slot in the substrate. Not only can the substrate be made narrower, but the length of the edge feed substrate can be shorter, for the same number of nozzles, than the center feed substrate due to the substrate structure now being less prone to cracking or breaking without the central ink feed hole. This shortening of the substrate 28 enables a shorter headland 50 in FIG. 8 and, hence, a shorter print cartridge snout. This is important when the print cartridge 10 is installed in a printer which uses one or more pinch rollers below the snout's transport path across the paper to press the paper against the rotatable platen and which also uses one or more rollers (also called star wheels) above the transport path to maintain the paper contact around the platen. With a shorter print cartridge snout, the star wheels can be located closer to the pinch rollers to ensure better paper/roller contact along the transport path of the print cartridge snout. Additionally, by making the substrate smaller, more substrates can be formed per wafer, thus lowering the material cost per substrate.

Other advantages of the edge feed feature are that manufacturing time is saved by not having to etch a slot in the substrate, and the substrate is less prone to breakage during handling. Further, the substrate is able to dissipate more heat, since the ink flowing across the back of the substrate and around the edges of the substrate acts to draw heat away from the back of the substrate.

There are also a number of performance advantages to the edge feed design. Be eliminating the manifold as well as the slot in the substrate, the ink is able to flow more rapidly into the vaporization chambers, since there is less restriction on the ink flow. This more rapid ink flow improves the frequency response of the printhead, allowing higher printing rates from a given number of orifices. Further, the more rapid ink flow reduces crosstalk between nearby vaporization chambers caused by variations in ink flow as the heater elements in the vaporization chambers are fired.

In another embodiment, the ink reservoir contains two separate ink sources, each containing a different color of ink. In this alternative embodiment, the central slot 52 in FIG. 13 is bisected, as shown by the dashed line 103, so that each side of the central slot 52 communicates with a separate ink source. Therefore, the left linear array of vaporization chambers can be made to eject one color of ink, while the right linear array of vaporization chambers can be made to eject a different color of ink. This concept can even be used to create a four color printhead, where a different ink reservoir feeds ink to ink channels along each of the four sides of the substrate. Thus, instead of the two-edge feed design discussed above, a four-edge design would be used, preferably using a square substrate for symmetry.

FIG. 14 illustrates one method for forming the preferred embodiment of the TAB head assembly 14. The starting material is a Kapton™ or Upilex™ type polymer tape 104, although the tape 104 can be any suitable polymer film which is acceptable for use in the below-described procedure. Some such films may comprise Teflon, polyamide, polymethylmethacrylate, polycarbonate, polyester, polyamide polyethyleneterephthalate or mixtures thereof.

The tape 104 is typically provided in long strips on a reel 105. Sprocket holes 106 along the sides of the tape 104 are used to accurately and securely transport the tape 104. Alternately, the sprocket holes 106 may be omitted and the tape may be transported with other types of fixtures.

In the preferred embodiment, the tape 104 is already provided with conductive copper traces 36, such as shown in FIGS. 2, 4 and 5, formed thereon using conventional metal deposition and photolithographic processes. The particular pattern of conductive traces depends on the manner in which it is desired to distribute electrical signals to the electrodes formed on silicon dies, which are subsequently mounted on the tape 104.

In the preferred process, the tape 104 is transported to a laser processing chamber and laser-ablated in a pattern defined by one or more masks 108 using laser radiation 110, such as that generated by an Excimer laser 112 of the $F_2$, ArF, KrCl, KrF, or XeCl type. The masked laser radiation is designated by arrows 114.

In a preferred embodiment, such masks 108 define all of the ablated features for an extended area of the tape 104, for example encompassing multiple orifices in the case of an orifice pattern mask 108, and multiple vaporization chambers in the case of a vaporization chamber pattern mask 108. Alternatively, patterns such as the orifice pattern, the vaporization chamber pattern, or other patterns may be placed side by side on a common mask substrate which is substantially larger than the laser beam. Then such patterns may be moved sequentially into the beam. The masking material used in such masks will preferably be highly reflecting at the laser wavelength, consisting of, for example, a multilayer dielectric or a metal such as aluminum.

Figure 21:
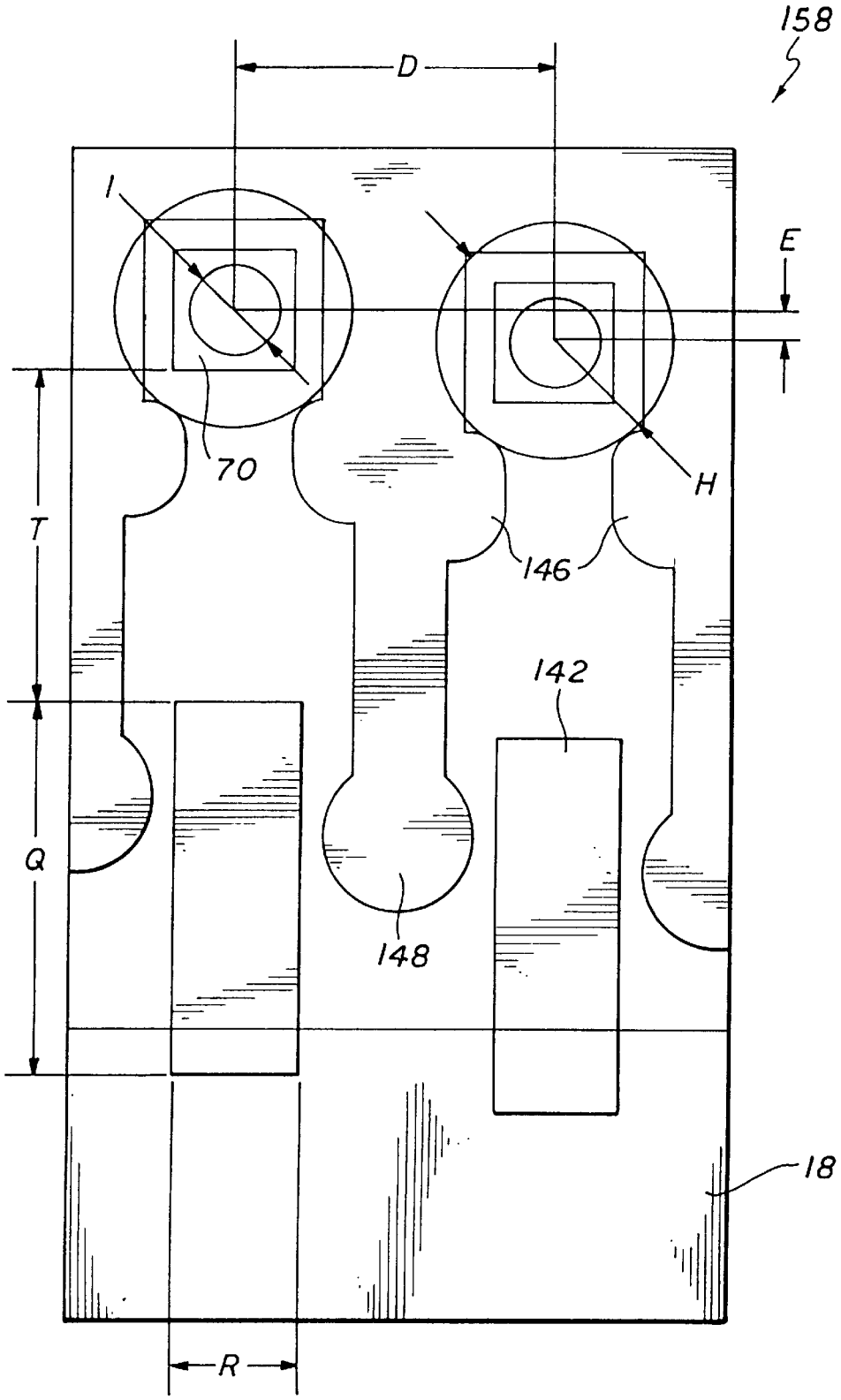
FIG. 21 is a top plan view of the TAB head assembly portion shown in FIG. 19.

The orifice pattern defined by the one or more masks 108 may be that generally shown in FIG. 21. Multiple masks 108 may be used to form a stepped orifice taper as shown in FIG. 12.

In one embodiment, a separate mask 108 defines the pattern of windows 22 and 24 shown in FIGS. 1 and 2; however, in the preferred embodiment, the windows 22 and 24 are formed using conventional photolithographic methods prior to the tape 104 being subjected to the processes shown in FIG. 14.

In an alternative embodiment of a nozzle member, where the nozzle member also includes vaporization chambers, one or more masks 108 would be used to form the orifices and another mask 108 and laser energy level (and/or number of laser shots) would be used to define the vaporization chambers, ink channels, and manifolds which are formed through a portion of the thickness of the tape 104.

The laser system for this process generally includes beam delivery optics, alignment optics, a high precision and high speed mask shuttle system, and a processing chamber including a mechanism for handling and positioning the tape 104. In the preferred embodiment, the laser system uses a projection mask configuration wherein a precision lens 115 interposed between the mask 108 and the tape 104 projects the Excimer laser light onto the tape 104 in the image of the pattern defined on the mask 108.

The masked laser radiation exiting from lens 115 is represented by arrows 116. Such a projection mask configuration is advantageous for high precision orifice dimensions, because the mask is physically remote from the nozzle member. Soot is naturally formed and ejected in the ablation process, traveling distances of about one centimeter from the nozzle member being ablated. If the mask were in contact with the nozzle member, or in proximity to it, soot buildup on the mask would tend to distort ablated features and reduce their dimensional accuracy. In the preferred embodiment, the projection lens is more than two centimeters from the nozzle member being ablated, thereby avoiding the buildup of any soot on it or on the mask.

Ablation is well known to produce features with tapered walls, tapered so that the diameter of an orifice is larger at the surface onto which the laser is incident, and smaller at the exit surface. The taper angle varies significantly with variations in the optical energy density incident on the nozzle member for energy densities less than about two joules per square centimeter. If the energy density were uncontrolled, the orifices produced would vary significantly in taper angle, resulting in substantial variations in exit orifice diameter. Such variations would produce deleterious variations in ejected ink drop volume and velocity, reducing print quality. In the preferred embodiment, the optical energy of the ablating laser beam is precisely monitored and controlled to achieve a consistent taper angle, and thereby a reproducible exit diameter. In addition to the print quality benefits resulting from the constant orifice exit diameter, a taper is beneficial to the operation of the orifices, since the taper acts to increase the discharge speed and provide a more focused ejection of ink, as well as provide other advantages. The taper may be in the range of 5 to 15 degrees relative to the axis of the orifice. The preferred embodiment process described herein allows rapid and precise fabrication without a need to rock the laser beam relative to the nozzle member. It produces accurate exit diameters even though the laser beam is incident on the entrance surface rather than the exit surface of the nozzle member.

After the step of laser-ablation, the polymer tape 104 is stepped, and the process is repeated. This is referred to as a step-and-repeat process. The total processing time required for forming a single pattern on the tape 104 may be on the order of a few seconds. As mentioned above, a single mask pattern may encompass an extended group of ablated features to reduce the processing time per nozzle member.

Laser ablation processes have distinct advantages over other forms of laser drilling for the formation of precision orifices, vaporization chambers, and ink channels. In laser ablation, short pulses of intense ultraviolet light are absorbed in a thin surface layer of material within about 1 micrometer or less of the surface. Preferred pulse energies are greater than about 100 millijoules per square centimeter and pulse durations are shorter than about 1 microsecond. Under these conditions, the intense ultraviolet light photodissociates the chemical bonds in the material. Furthermore, the absorbed ultraviolet energy is concentrated in such a small volume of material that it rapidly heats the dissociated fragments and ejects them away from the surface of the material. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micrometer. In addition, laser ablation can also form chambers with substantially flat bottom surfaces which form a plane recessed into the layer, provided the optical energy density is constant across the region being ablated. The depth of such chambers is determined by the number of laser shots, and the power density of each.

Laser-ablation processes also have numerous advantages as compared to conventional lithographic electroforming processes for forming nozzle members for inkjet printheads. For example, laser-ablation processes generally are less expensive and simpler than conventional lithographic electroforming processes. In addition, by using laser-ablations processes, polymer nozzle members can be fabricated in substantially larger sizes (i.e., having greater surface areas) and with nozzle geometries that are not practical with conventional electroforming processes. In particular, unique nozzle shapes can be produced by controlling exposure intensity or making multiple exposures with a laser beam being reoriented between each exposure. Examples of a variety of nozzle shapes are described in copending application Ser. No. 07/658,726, entitled "A Process of Photo-Ablating at Least One Stepped Opening Extending Through a Polymer Material, and a Nozzle Plate Having Stepped Openings," assigned to the present assignee and incorporated herein by reference. Also, precise nozzle geometries can be formed without process controls as strict as those required for electroforming processes.

Another advantage of forming nozzle members by laser-ablating a polymer material is that the orifices or nozzles can be easily fabricated with various ratios of nozzle length (L) to nozzle diameter (D). In the preferred embodiment, the L/D ratio exceeds unity. One advantage of extending a nozzle's length relative to its diameter is that orifice-resistor positioning in a vaporization chamber becomes less critical.

In use, laser-ablated polymer nozzle members for inkjet printers have characteristics that are superior to conventional electroformed orifice plates. For example, laser-ablated polymer nozzle members are highly resistant to corrosion by water-based printing inks and are generally hydrophobic. Further, laser-ablated polymer nozzle members have a relatively low elastic modulus, so built-in stress between the nozzle member and an underlying substrate or barrier layer has less of a tendency to cause nozzle member-to-barrier layer delamination. Still further, laser-ablated polymer nozzle members can be readily fixed to, or formed with, a polymer substrate.

Although an Excimer laser is used in the preferred embodiments, other ultraviolet light sources with substantially the same optical wavelength and energy density may be used to accomplish the ablation process. Preferably, the wavelength of such an ultraviolet light source will lie in the 150 nm to 400 nm range to allow high absorption in the tape to be ablated. Furthermore, the energy density should be greater than about 100 millijoules per square centimeter with a pulse length shorter than about 1 microsecond to achieve rapid ejection of ablated material with essentially no heating of the surrounding remaining material.

As will be understood by those of ordinary skill in the art, numerous other processes for forming a pattern on the tape 104 may also be used. Other such processes include chemical etching, stamping, reactive ion etching, ion beam milling, and molding or casting on a photodefined pattern.

A next step in the process is a cleaning step wherein the laser ablated portion of the tape 104 is positioned under a cleaning station 117. At the cleaning station 117, debris from the laser ablation is removed according to standard industry practice.

The tape 104 is then stepped to the next station, which is an optical alignment station 118 incorporated in a conventional automatic TAB bonder, such as an inner lead bonder commercially available from Shinkawa Corporation, model number IL-20. The bonder is preprogrammed with an alignment (target) pattern on the nozzle member, created in the same manner and/or step as used to created the orifices, and a target pattern on the substrate, created in the same manner and/or step used to create the resistors. In the preferred embodiment, the nozzle member material is semi-transparent so that the target pattern on the substrate may be viewed through the nozzle member. The bonder then automatically positions the silicon dies 120 with respect to the nozzle members so as to align the two target patterns. Such an alignment feature exists in the Shinkawa TAB bonder. This automatic alignment of the nozzle member target pattern with the substrate target pattern not only precisely aligns the orifices with the resistors but also inherently aligns the electrodes on the dies 120 with the ends of the conductive traces formed in the tape 104, since the traces and the orifices are aligned in the tape 104, and the substrate electrodes and the heating resistors are aligned on the substrate. Therefore, all patterns on the tape 104 and on the silicon dies 120 will be aligned with respect to one another once the two target patterns are aligned.

Thus, the alignment of the silicon dies 120 with respect to the tape 104 is performed automatically using only commercially available equipment. By integrating the conductive traces with the nozzle member, such an alignment feature is possible. Such integration not only reduces the assembly cost of the printhead but reduces the printhead material cost as well.

The automatic TAB bonder then uses a gang bonding method to press the ends of the conductive traces down onto the associated substrate electrodes through the windows formed in the tape 104. The bonder then applies heat, such as by using thermocompression bonding, to weld the ends of the traces to the associated electrodes. A schematic side view of one embodiment of the resulting structure is shown in FIG. 6. Other types of bonding can also be used, such as ultrasonic bonding, conductive epoxy, solder paste, or other well-known means.

The tape 104 is then stepped to a heat and pressure station 122. As previously discussed with respect to FIGS. 9 and 10, an adhesive layer 84 exists on the top surface of the barrier layer 30 formed on the silicon substrate. After the above-described bonding step, the silicon dies 120 are then pressed down against the tape 104, and heat is applied to cure the adhesive layer 84 and physically bond the dies 120 to the tape 104.

Thereafter the tape 104 steps and is optionally taken up on the take-up reel 124. The tape 104 may then later be cut to separate the individual TAB head assemblies from one another.

The resulting TAB head assembly is then positioned on the print cartridge 10, and the previously described adhesive seal 90 is formed to firmly secure the nozzle member to the print cartridge, provide an ink-proof seal around the substrate between the nozzle member and the ink reservoir, and encapsulate the traces in the vicinity of the headland so as to isolate the traces from the ink.

Peripheral points on the flexible TAB head assembly are then secured to the plastic print cartridge 10 by a conventional melt-through type bonding process to cause the polymer flexible circuit 18 to remain relatively flush with the surface of the print cartridge 10, as shown in FIG. 1.

To increase resolution and print quality, the printhead nozzles must be placed closer together. This requires that both heater resistors and the associated orifices be placed closer together. To increase printer throughput, the firing frequency of the resistors must be increased. When firing the resistors at high frequencies, i.e., greater than 8 KHz, conventional ink channel barrier designs either do not allow the vaporization chambers to adequately refill or allow extreme blowback or catastrophic overshoot and puddling on the exterior of the nozzle member. Also, the closer spacing of the resistors created space problems and restricted possible barrier solutions due to manufacturing concerns.

Figure 15:
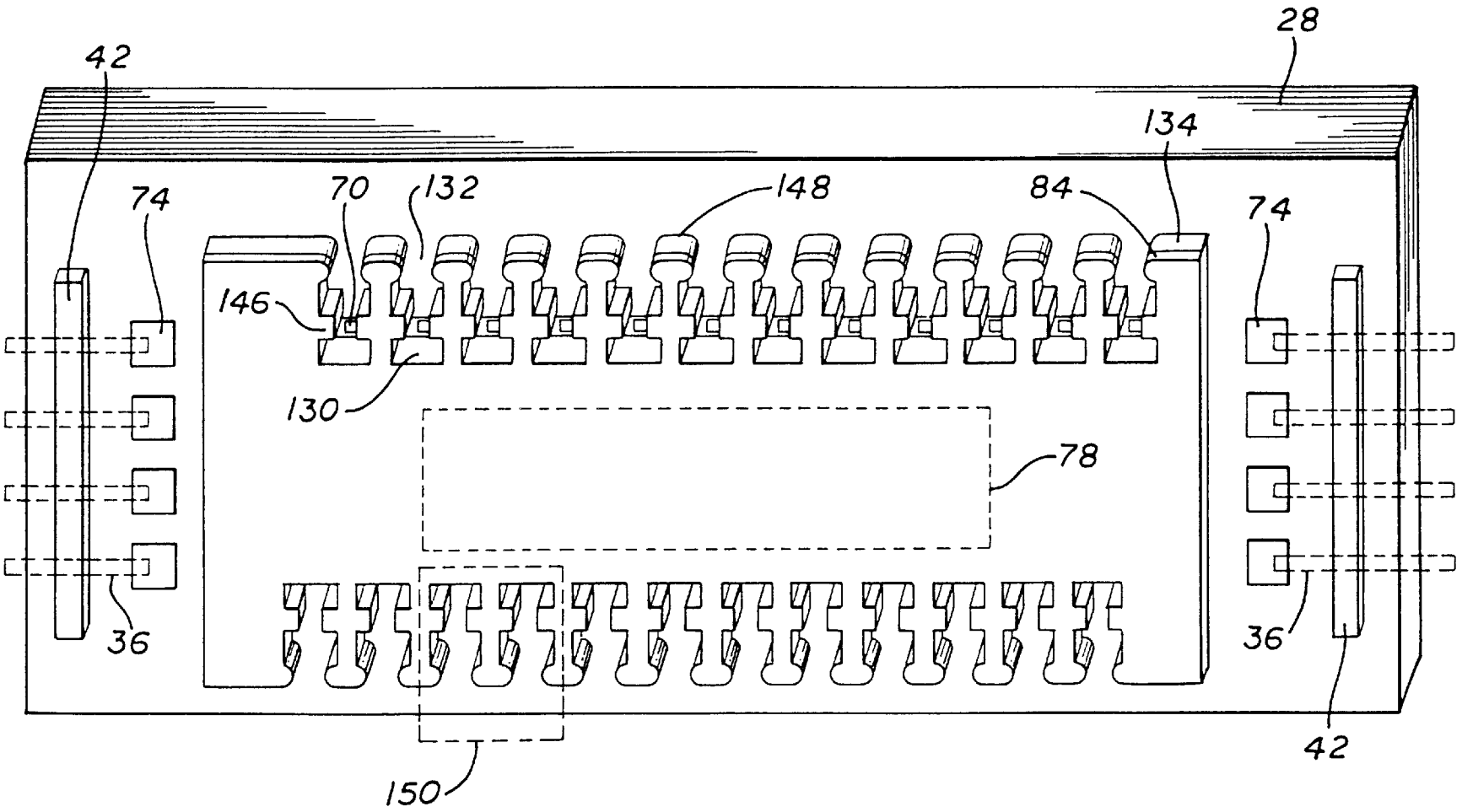
FIG. 15 shows the same substrate structure as that shown in FIG. 11 but having a different barrier layer pattern for improved printing performance.

The TAB head assembly architecture shown schematically in FIG. 15 is advantageous when a very high density of dots is required to be printed (e.g., 600 dpi). However, at such high dot densities and at high firing rates (e.g., 12 KHz) cross-talk between neighboring vaporization chambers becomes a serious problem. During the firing of a single nozzle, bubble growth initiated by a resistor displaces ink outward in the form of a drop. At the same time, ink is also displaced back into the ink channel. The quantity of ink so displaced is often described as "blowback volume." The ratio of ejected volume to blowback volume is an indication of ejection efficiency, which may be on the order of about 1:1 for the TAB head assembly 14 of FIG. 11. In addition to representing an inertial impediment to refill, blowback volume causes displacements in: the menisci of neighboring nozzles. When these neighboring nozzles are fired, such displacements of their menisci cause deviations in drop volume from the nominally equilibrated situation resulting in nonuniform dots being printed.

A second embodiment of the present invention shown in the TAB head assembly architecture of FIG. 15 is designed to minimize such cross-talk effects. Elements in FIGS. 9 and 13 which are labeled with the same numbers are similar in structure and operation. The significant differences between the structures of FIGS. 9 and 13 include the barrier layer pattern and the increased density of the vaporization chambers.

In FIG. 15, vaporization chambers 130 and ink channels 132 are shown formed in barrier layer 134. Ink channels 132 provide an ink path between the source of ink and the vaporization chambers 130. The flow of ink into the ink channels 132 and into the vaporization chambers 130 is generally similar to that described with respect to FIGS. 10 and 11, whereby ink flows around the long side edges 86 of the substrate 28 and into the ink channels 132.

The vaporization chambers 130 and ink channels 132 may be formed in the barrier layer 134 using conventional photolithographic techniques. The barrier layer 134 may be similar to the barrier layer 30 in FIGS. 5 and 10 and may comprise any high quality photoresist, such as Vacrel™ or Parad™.

Thin film resistors 70 in FIG. 15 are similar to those described with respect to FIG. 11 and are formed on the surface of the silicon substrate 28. As previously mentioned with respect to FIG. 11, resistors 70 may instead be well known piezoelectric pump-type ink ejection elements or any other conventional ink ejection elements where vaporization of ink is not necessarily occurring in chambers 130. If a piezoelectric ink ejection element is used, such chambers 130 may be broadly referred to as ink ejection chambers.

Figure 17:
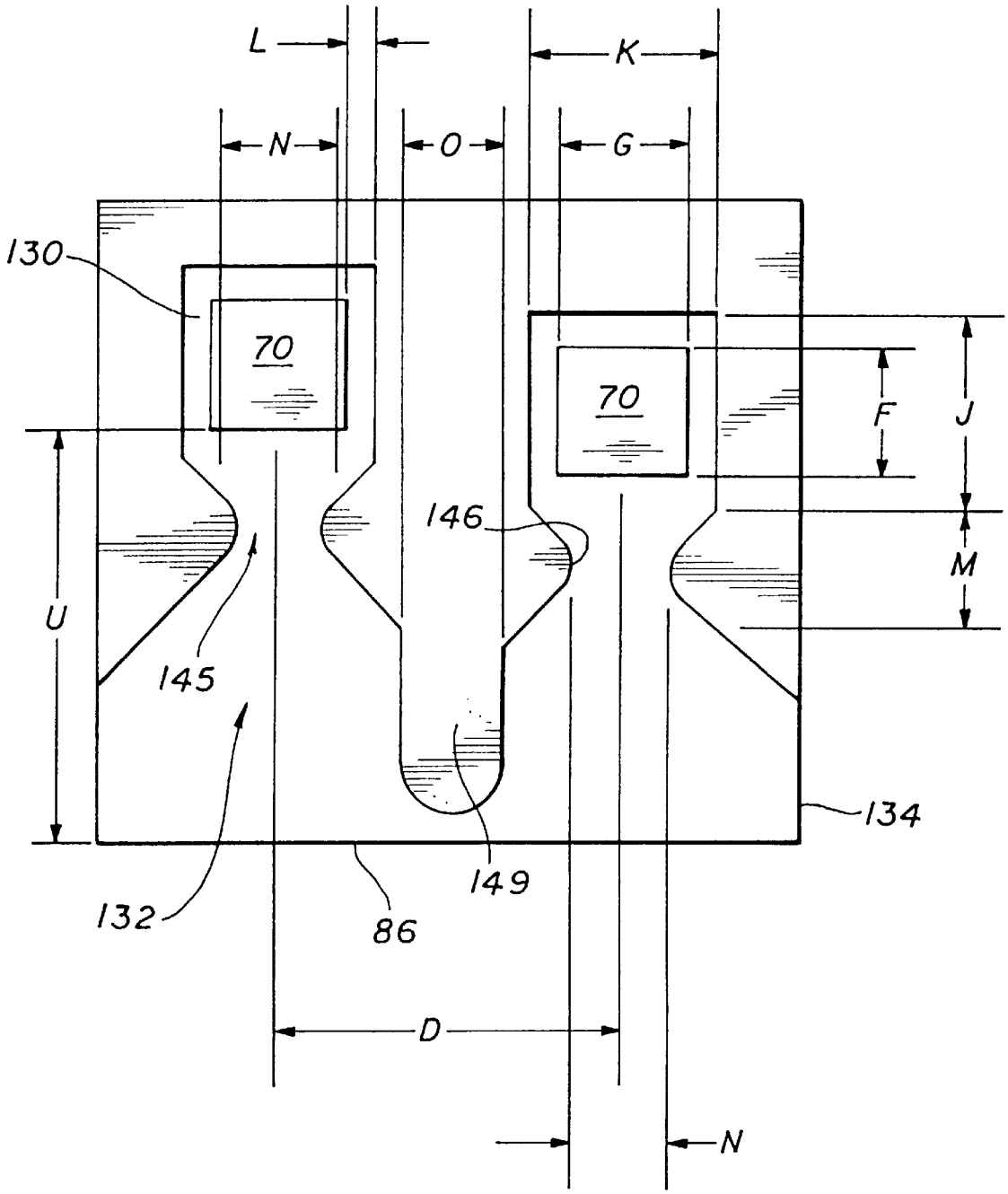
FIG. 17 is a top plan view of a magnified portion of an alternative structure to the structure of FIG. 16.

To form a completed TAB head assembly, the substrate structure of FIG. 15 is affixed to the nozzle structure of FIG. 17 in the manner shown in FIG. 19 which is described in greater detail later. The resulting TAB head assembly is very similar to the TAB head assembly 14 in FIGS. 2, 4, 5, and 6.

Generally, the particular architecture of the ink channels 132 in FIG. 15 provides advantages over the architecture shown in FIG. 11. Further details and other advantages of the TAB head assembly architecture will be described with respect to FIG. 16, which is a magnified top plan view of the portion of FIG. 15 shown within dashed outline 150. The architecture of the ink channels 132 in FIG. 16 has the following differences from the architecture shown in FIG. 11. The relatively narrow constriction points or pinch point gaps 145 created by the pinch points 146 in the ink channels 132 provide viscous damping during refill of the vaporization chambers 130 after firing. This viscous damping helps minimize cross-talk between neighboring vaporization chambers 130. The pinch points 146 also help control ink blow-back and bubble collapse after firing to improve the uniformity of ink drop ejection. The addition of "peninsulas" 149 extending from the barrier body out to the edge of the substrate provided fluidic isolation of the vaporization chambers 130 from each other to prevent cross-talk and allowed support of the nozzle member 136 at the edge of the substrate. The enlarged areas or reefs 148 formed on the ends of the peninsulas 149 near the entrance to each ink channel 132 increase the nozzle member 136 support area at the edges of the barrier layer 134 so that the nozzle member 136 lies relatively flat on barrier layer 134 when affixed to barrier layer 134. Adjacent reefs 148 also act to constrict the entrance of the ink channels 132 so as to help filter large foreign particles.

Figure 16:
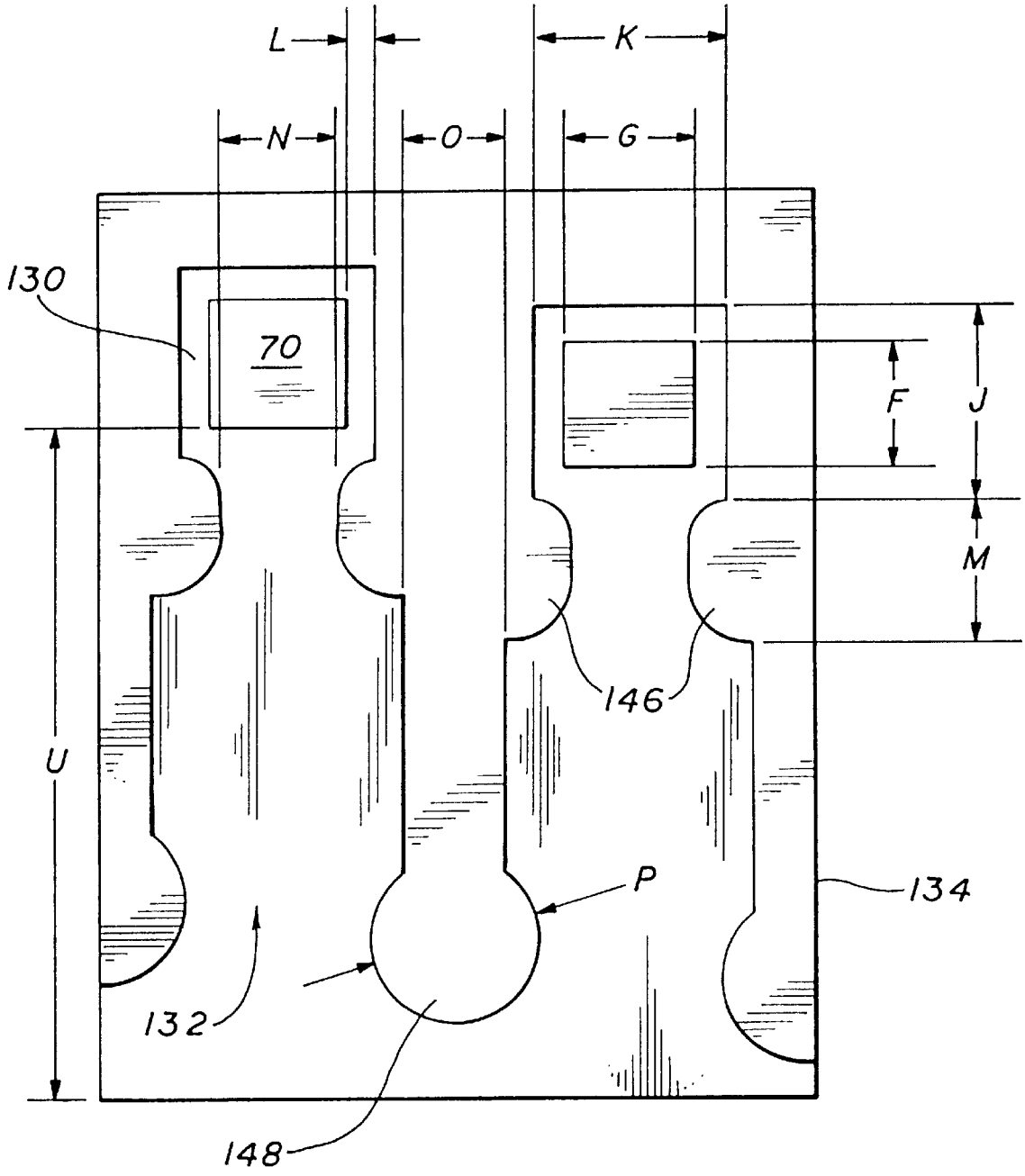
FIG. 16 is a top plan view of a magnified portion of the structure of FIG. 15.

The pitch D of the vaporization chambers 130 shown in FIG. 16 provides for 600 dots per inch (dpi) printing using two rows of vaporization chambers 130 as shown in FIG. 22 and to be described below. Within a single row or column of vaporization chambers 130, a small offset E (shown in FIG. 21) is provided between vaporization chambers 130. This small offset E allows adjacent resistors 70 to be fired at slightly different times when the TAB head assembly is scanning across the recording medium to further minimize cross-talk effects between adjacent vaporization chambers 130. There are twenty two different offset locations, one for each address line. Further details are provided below with respect to FIGS. 22–24. The definition of the dimensions of the various elements shown in FIGS. 16, 17, 20 and 21 are provided in Table I.

TABLE I

DEFINITION OF INK CHAMBER DEFINITIONS

| Dimension | Definition |
|---|---|
| A | Substrate Thickness |
| B | Barrier Thickness |
| C | Nozzle Member Thickness |
| D | Orifice/Resistor Pitch |
| E | Resistor/Orifice Offset |
| F | Resistor Length |
| G | Resistor Width |
| H | Nozzle Entrance Diameter |
| I | Nozzle Exit Diameter |
| J | Chamber Length |
| K | Chamber Width |
| L | Chamber Gap |
| M | Channel Length |
| N | Channel Width |
| O | Barrier Width |
| P | Reef Diameter |
| Q | Cavity Length |
| R | Cavity Width |
| S | Cavity Depth |
| T | Cavity Location |
| U | Shelf Length |

The dimensions of the various elements formed in the barrier layer 134 shown in FIG. 16 are given in Table II below. Also shown in Table II is the orifice diameter I shown in FIG. 21.

TABLE II

INK CHAMBER DIMENSIONS IN MICRONS

| Dimension | Minimum | Nominal | Maximum |
|---|---|---|---|
| E | 1 | 173 | 2 |
| F | 30 | 35 | 40 |
| G | 30 | 35 | 40 |
| I | 23 | 26 | 34 |
| J | 45 | 50 | 55 |
| K | 45 | 50 | 55 |
| L | 0 | 8 | 10 |
| M | 20 | 35 | 50 |
| N | 15 | 30 | 55 |
| O | 10 | 25 | 40 |
| P | 30 | 40 | 50 |
| U | 75 | 155–190 | 270 |

An alternative embodiment of the TAB head assembly architecture will be described with respect to FIG. 17, which is a modified top plan view of the portion of the ink channels 132 shown in FIG. 16. The architecture of the ink channels 132 in FIG. 17 has the following differences from the architecture shown in FIG. 16. As the shelf length U decreases in length, the nozzle frequency increases. In the embodiment shown in FIG. 17 the shelf length is reduced. As a consequence, the fluid impedance is reduced, resulting in a more uniform frequency response for all nozzles. Edge feed permits use of a second saw cut partially through the wafer to allowing a shorter shelf length, U, to be formed. Alternatively, precise etching may be used. This shelf length is shorter than that of other commercially available printer cartridges and permits firing at much higher frequencies.

Figure 20:
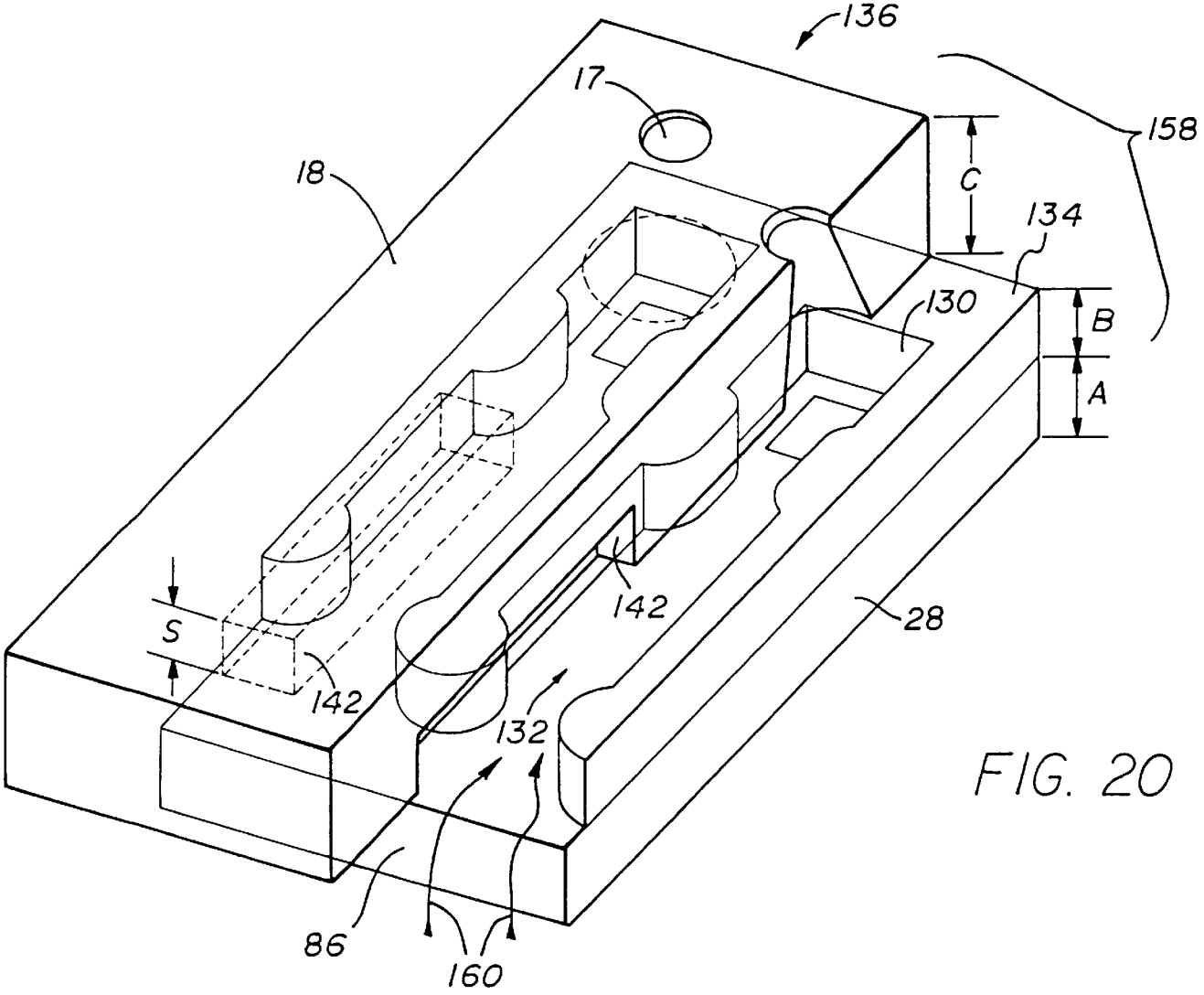
FIG. 20 is a magnified perspective view, partially cut away, of a portion of the resulting TAB head assembly when the back surface of the flexible circuit in FIG. 19 is properly affixed to the barrier layer of the substrate structure shown in FIG. 15.

The frequency limit of a thermal inkjet pen is limited by resistance in the flow of ink to the nozzle. However, some resistance in ink flow is necessary to damp meniscus oscillation, but too much resistance limits the upper frequency at which a print cartridge can operate. Ink flow resistance (impedance) is intentionally controlled by the pinch point gap 145 gap adjacent the resistor with a well-defined length and width. The distance of the resistor 70 from the substrate edge varies with the firing patterns of the TAB head assembly. An additional component to the fluid impedance is the entrance to the firing (vaporization) chamber. The entrance comprises a thin region between the nozzle member 136 and the substrate 28 and its height is essentially a function of the thickness of the barrier layer 134 (FIG. 20). This region has high fluid impedance, since its height is small.

Figure 18:
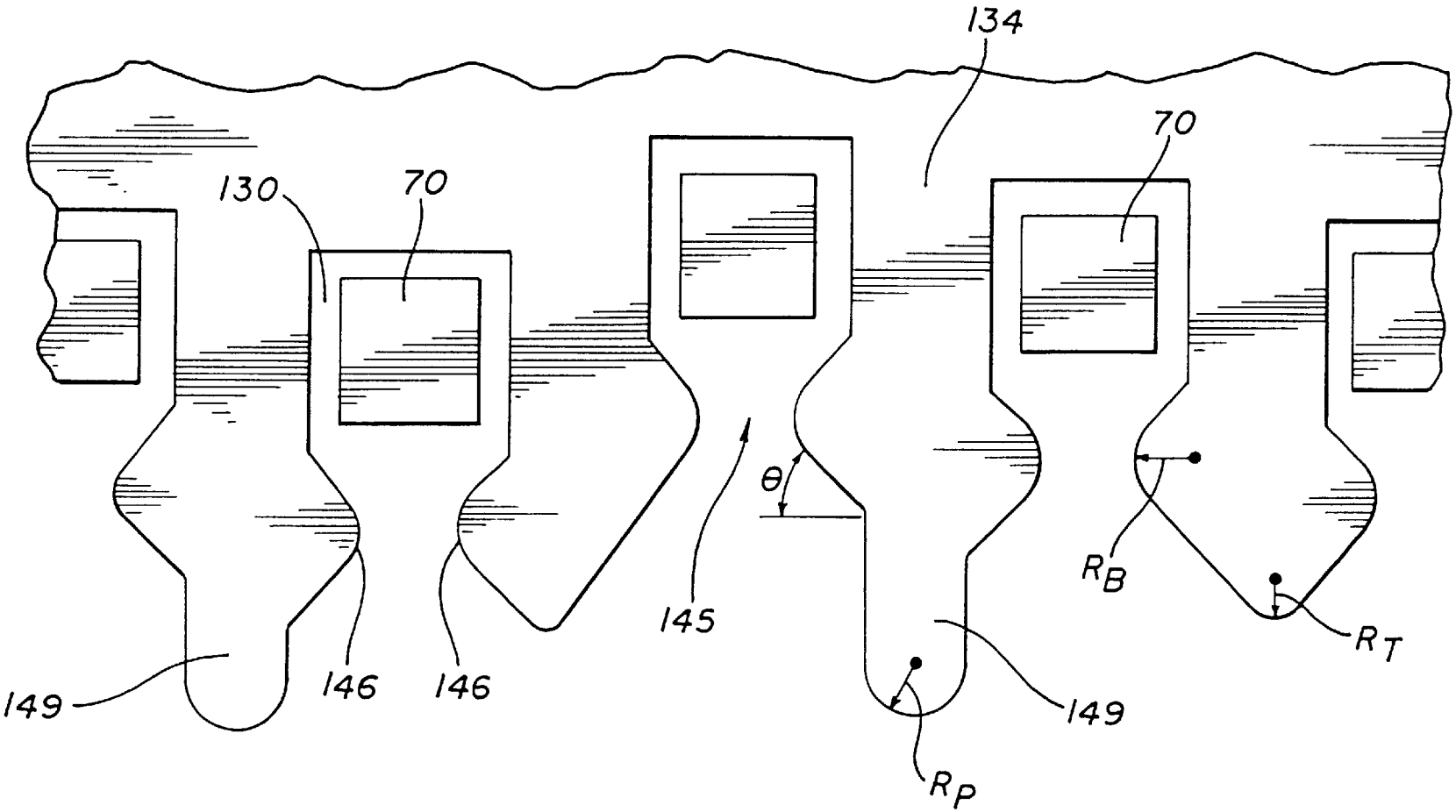
FIG. 18 is a top plan view of the structure of FIG. 15 expanded to show four resistors and the associated barrier structure.

The refill ink channel was reduced to a minimum shelf length, to allow the fastest possible refill, and "pinched" to the minimum width, to create the best damping. The short shelf length reduced the mass of the moving ink during ink chamber refill, thus reducing the sensitivity to damping features. This allowed wider processing tolerances while at the same time maintaining controlled damping. The principal difference is that the peninsulas 149 have been shortened and the reefs 148 have been removed. In addition, every other peninsula 149 has been shortened further to the pinch points 146. Also as shown in FIG. 17 the shape of the pinch points 146 have been modified. The pinch points 146 can be on one or both sides of the ink channel 130 with various tip configurations. This architecture allows greater than 8 KHz ink refill speed while providing sufficient overshoot damping. The shorter ink channel allows barrier processing of narrow ink channel widths that could not previously be accomplished. The dimensions of the various elements formed in the barrier layer 134 shown in FIG. 16 are identified in Table III below. FIG. 18 shows the effect of the offset from resistor to resistor on the shape long and shortened peninsulas due to the pinch points 146.

TABLE III

INK CHAMBER DIMENSIONS IN MICRONS

| Dimension | Minimum | Nominal | Maximum |
|---|---|---|---|
| E | 1 | 1.73 | 2 |
| F | 30 | 35 | 40 |
| G | 30 | 35 | 40 |
| I | 20 | 28 | 40 |
| J | 45 | 51 | 75 |
| K | 45 | 51 | 55 |
| L | 0 | 8 | 10 |
| M | 20 | 25 | 50 |
| N | 15 | 30 | 55 |
| O | 10 | 25 | 40 |
| $R_B$ | 5 | 15 | 25 |
| $R_P$ | 5 | 12.5 | 20 |
| $R_T$ | 0 | 5 | 20 |
| U | 0 | 90–130 | 270 |

Figure 19:
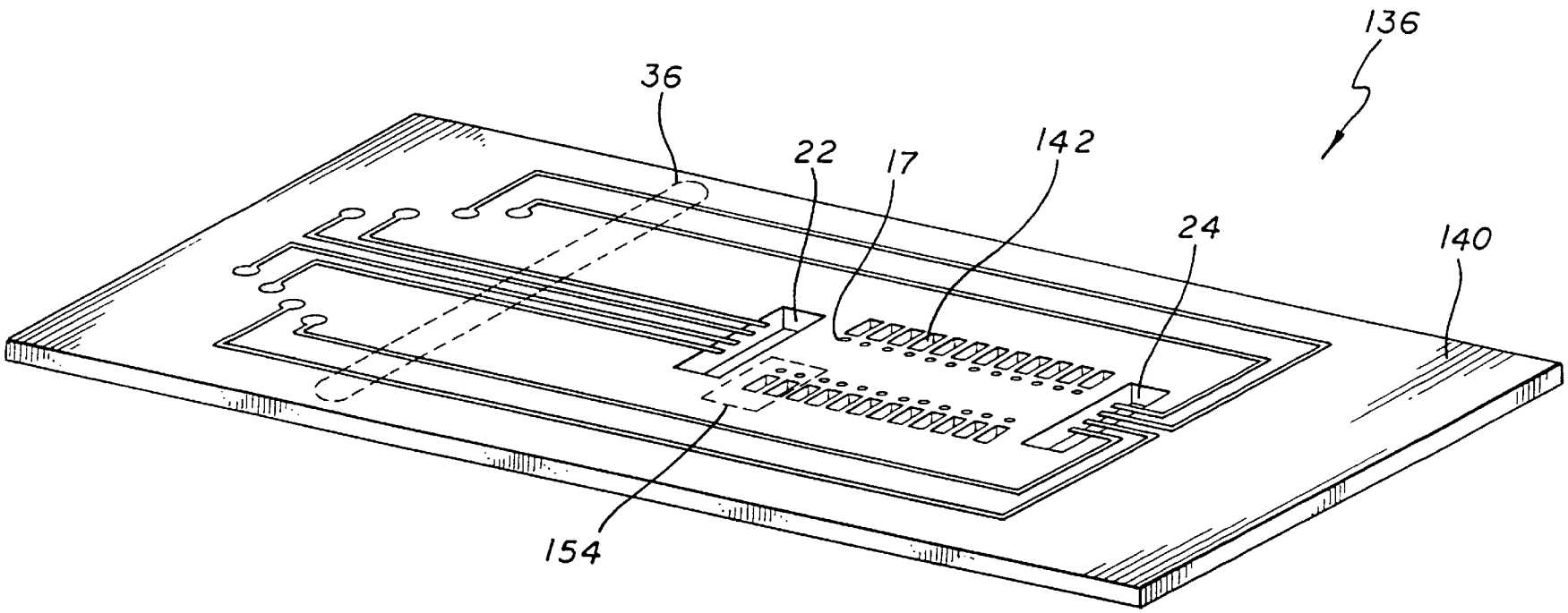
FIG. 19 is a perspective view of the back surface of a flexible polymer circuit having ink orifices and cavities formed in it.

FIG. 19 depicts a preferred nozzle member 136 in the form of a flexible polymer tape 140, which, when affixed to the substrate structure shown in FIG. 15, forms a TAB head assembly similar to that shown in FIGS. 4 and 5. Elements in FIGS. 5 and 15 which are labeled with the same numbers are similar in structure and operation. The flexible polymer nozzle member 136 in FIG. 19 primarily differs from the flexible circuit 18 in FIG. 5 by the increased density of laser-ablated nozzles 17 in the nozzle member 136 (to produce a higher printing resolution) and by the inclusion of cavities 142 which are laser-ablated through a partial thickness of the nozzle member 136. A separate mask 108 in the process shown in FIG. 14 may be used to define the pattern of cavities 142 in the nozzle member 136. A second laser source may be used to output the proper energy and pulse length to laser ablate cavities 142 through only a partial thickness of the nozzle member 136.

Conductors 36 on flexible circuit 140 provide an electrical path between the contact pads 20 (FIG. 4) and the electrodes 74 on the substrate 28 (FIG. 15). Conductors 36 are formed directly on flexible circuit 140 as previously described with respect to FIG. 5.

FIG. 20 is a magnified, partially cut away view in perspective of the portion of the nozzle member 136 shown in the dashed outline 154 of FIG. 19 after the nozzle member 136 has been properly positioned over the substrate structure of FIG. 20 to form a TAB head assembly 158 similar to the TAB head assembly 14 in FIG. 5. As shown in FIG. 20, the nozzles 17 are aligned over the vaporization chambers 130, and the cavities 142 are aligned over the ink channels 132. FIG. 20 also illustrates the ink flow 160 from an ink reservoir generally situated behind the substrate 28 as the ink flows over an edge 86 of the substrate 28 and enters cavities 142 and ink channels 132.

Preferred dimensions A, B, and C in FIG. 20 are provided in Table IV below, where dimension C is the thickness of the nozzle member 136, dimension B is the thickness of the barrier layer 134, and dimension A is the thickness of the substrate 28.

FIG. 21 is a top plan view of the portion of the TAB head assembly 158 shown in FIG. 20, where the vaporization chambers 130 and ink channels 132 can be seen through the nozzle member 136. The various dimensions of the cavities 142, the nozzles 17, and the separations between the various elements are identified in Table IV below. In FIG. 21, dimension H is the entrance diameter of the nozzles 17, while dimension I is the exit diameter of the nozzles 17. The other dimensions are self-explanatory.

The cavities 142 minimize the viscous damping of ink during refill as the ink flows into the ink channels 132. This helps compensate for the increased viscous damping provided by the pinch points 146, reefs 148, and increased length of the ink channels 132 along the substrate shelf. Minimizing viscous damping helps increase the maximum firing rate of the resistors 70, since ink can enter into the ink channels 132 more quickly after firing. Thus, the damping function is provided primarily by the pinch points rather than the viscous damping which is different individual vaporization chambers due to the different shelf lengths for individual vaporization chambers caused by the offsets, E, between the vaporization chambers.

TABLE IV

SUBSTRATE, INK CHANNEL AND NOZZLE MEMBER DIMENSIONS IN MICRONS

| Dimension | Minimum | Nominal | Maximum |
|---|---|---|---|
| A | 600 | 625 | 650 |
| B | 19 | 25 | 32 |

TABLE IV-continued

SUBSTRATE, INK CHANNEL AND NOZZLE MEMBER DIMENSIONS IN MICRONS

| Dimension | Minimum | Nominal | Maximum |
|---|---|---|---|
| C | 25 | 50 | 75 |
| D | | 84.7 | |
| H | 40 | 55 | 70 |
| Q | 80 | 120 | 200 |
| R | 20 | 35 | 50 |
| S | 0 | 25 | 50 |
| T | 50 | 100 | 150 |

Tables I, II and III above lists the nominal values of the various dimensions A–U of the TAB head assembly structure of FIGS. 13–18 as well as their preferred ranges. It should be understood that the preferred ranges and nominal values of an actual embodiment will depend upon the intended operating environment of the TAB head assembly, including the type of ink used, the operating temperature, the printing speed, and the dot density.

Referring to FIG. 22, as discussed above, the orifices 17 in the nozzle member 16 of the TAB head assembly are generally arranged in two major columns of orifices 17 as shown in FIG. 22. For clarity of understanding, the orifices 17 are conventionally assigned a number as shown, starting at the top right as the TAB head assembly as viewed from the external surface of the nozzle member 16 and ending in the lower left, thereby resulting in the odd numbers being arranged in one column and even numbers being arranged in the second column. Of course, other numbering conventions may be followed, but the description of the firing order of the orifices 17 associated with this numbering system has advantages. The orifices/resistors in each column are spaced 1/300 of an inch apart in the long direction of the nozzle member. The orifices and resistors in one column are offset from the orifice/resistors in the other column in the long direction of the nozzle member by 1/600 of an inch, thus, providing 600 dots per inch (dpi) printing.

Figure 23:
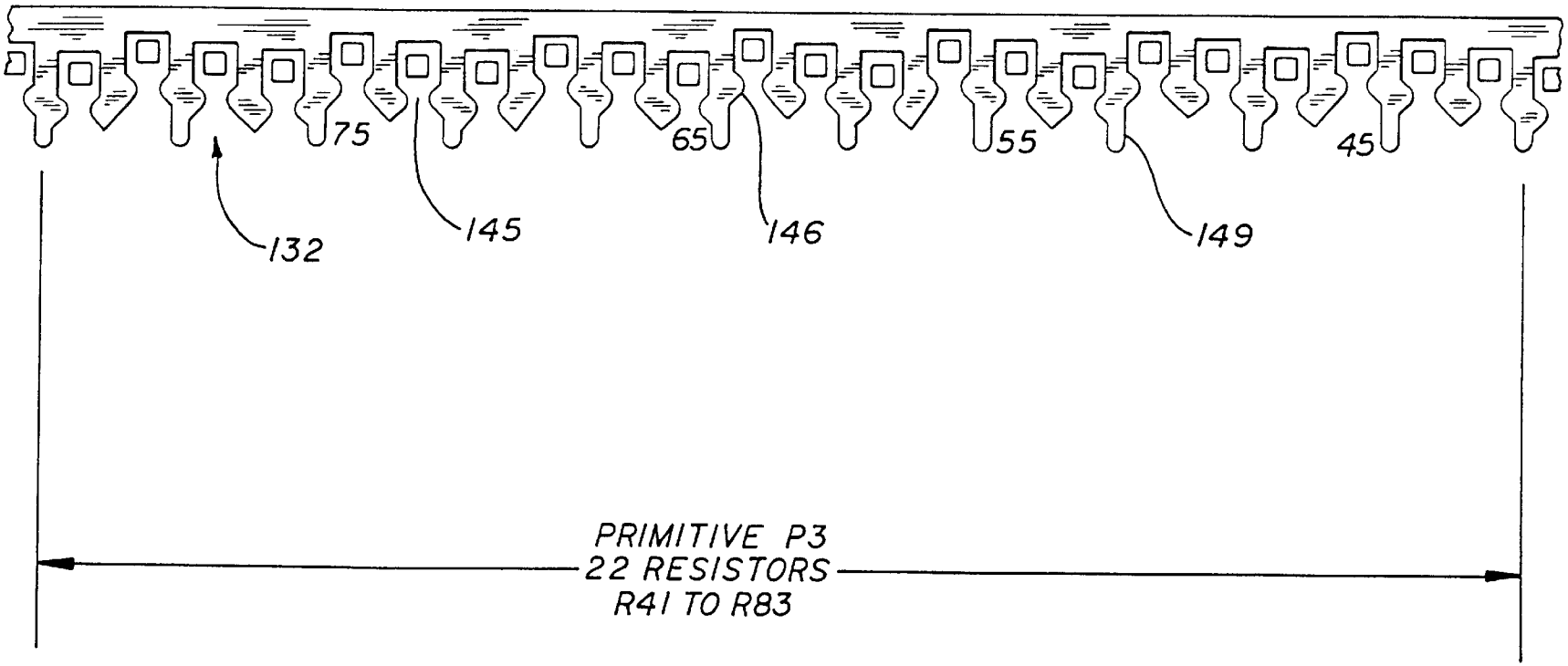
FIG. 23 is top plan view of one primitive of resistors and the associated ink vaporization chambers, ink channels and barrier architecture.

In one embodiment of the present invention the orifices 17, while aligned in two major columns as described, are further arranged in an offset pattern within each column to match the offset heater resistors 70 disposed in the substrate 28 as illustrated in FIGS. 22 and 23. Within a single row or column of resistors, a small offset E (shown in FIG. 21) is provided between resistors. This small offset E allows adjacent resistors 70 to be fired at slightly different times when the TAB head assembly is scanning across the recording medium to further minimize cross-talk effects between adjacent vaporization chambers 130. Thus, although the resistors are fired at twenty two different times, the offset allows the ejected ink drops from different nozzles to be placed in the same horizontal position on the print media. The resistors 70 are coupled to electrical drive circuitry (not shown in FIG. 22) and are organized in groups of fourteen primitives which consist of four primitives of twenty resistors (P1, P2, P13 and P14) and ten primitives of twenty two resistors for a total of 300 resistors. The fourteen resistor primitives (and associated orifices) are shown in FIG. 22. FIG. 23 shows the offset of the resistors and the ink channels 132, peninsulas 149, pinch point gaps 145 and pinch points 146 of primitive P5. The spatial location of the 300 resistor/orifices with respect to the centroid of the substrate is provided in FIG. 24. The TAB head assembly orifices 17 are positioned directly over the heater resistors 70 and are positioned relative to its most adjacent neighbor in accordance with FIG. 16. This placement and firing sequence provides a more uniform frequency response for all resistors 70 and reduces the crosstalk between adjacent vaporization chambers.

Figures 1, 25:
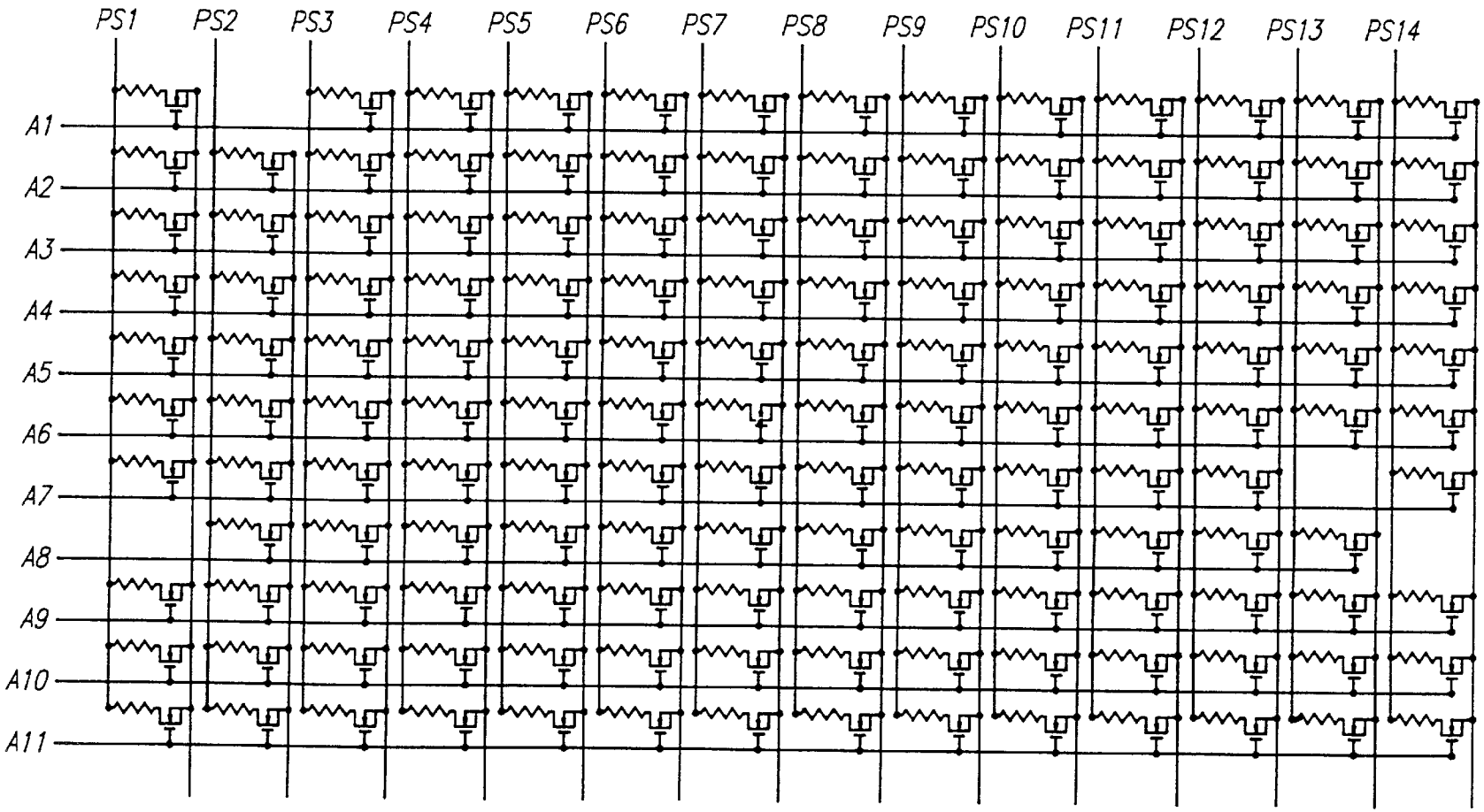
FIG. 25 is a schematic diagram of the heater resistors and the associated address lines, primitive select lines and ground lines which may be employed in the present invention.
Figures 2, 25:
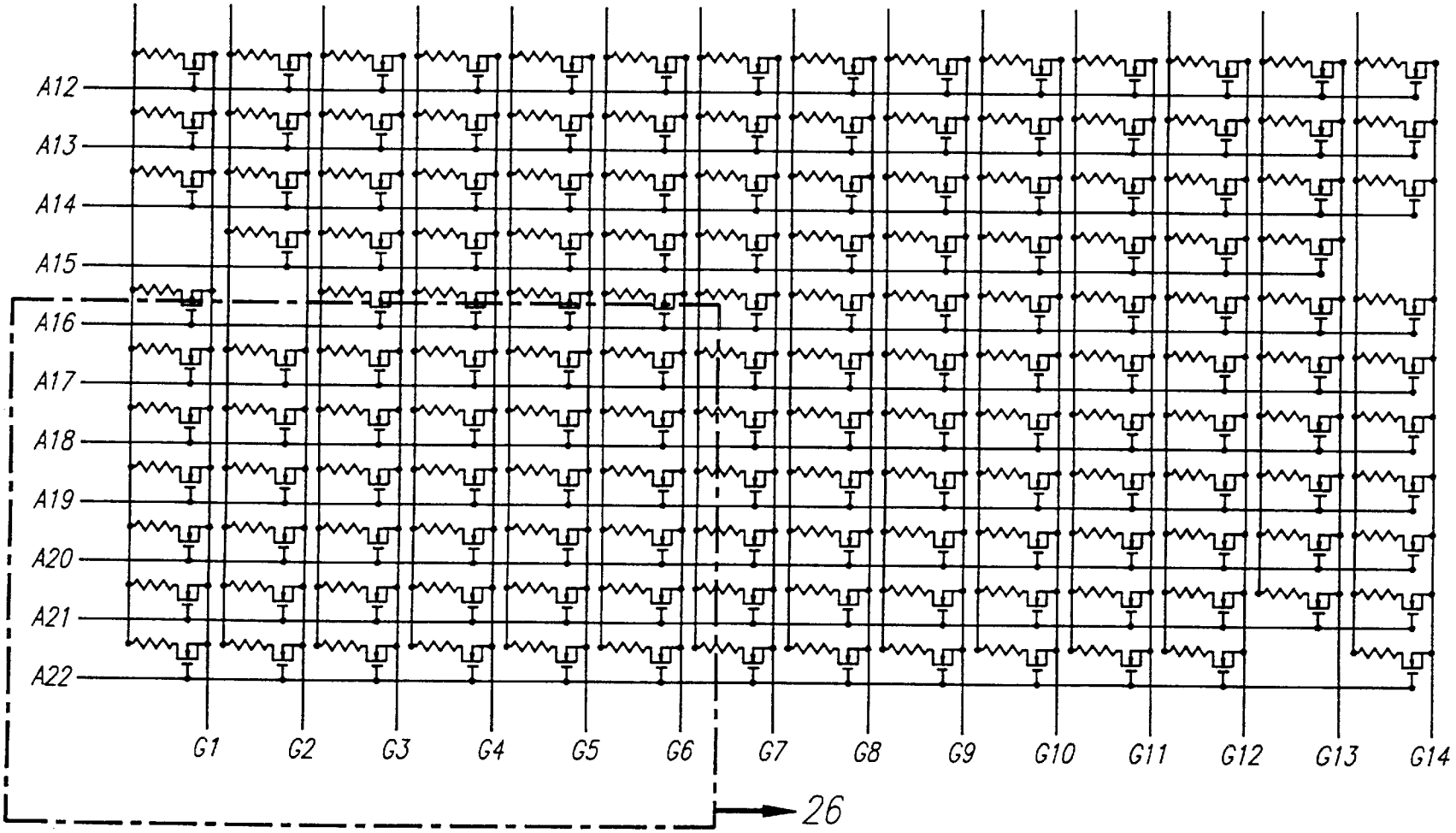
Figure 26:
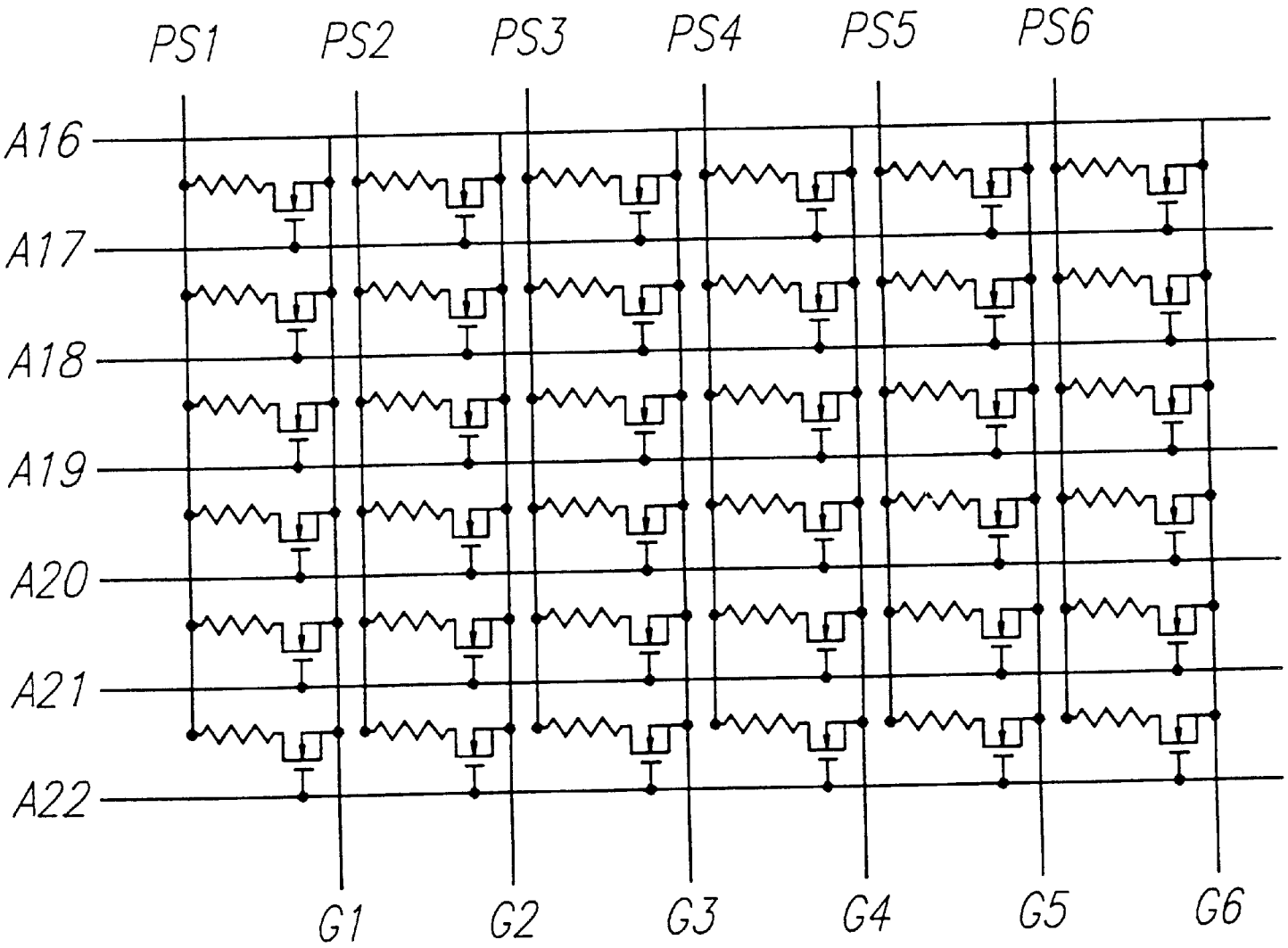
FIG. 26 is an enlarged schematic diagram of the heater resistors and the associated address lines, primitive select lines and ground lines of the outlined portion of FIG. 25.
Figure 27:
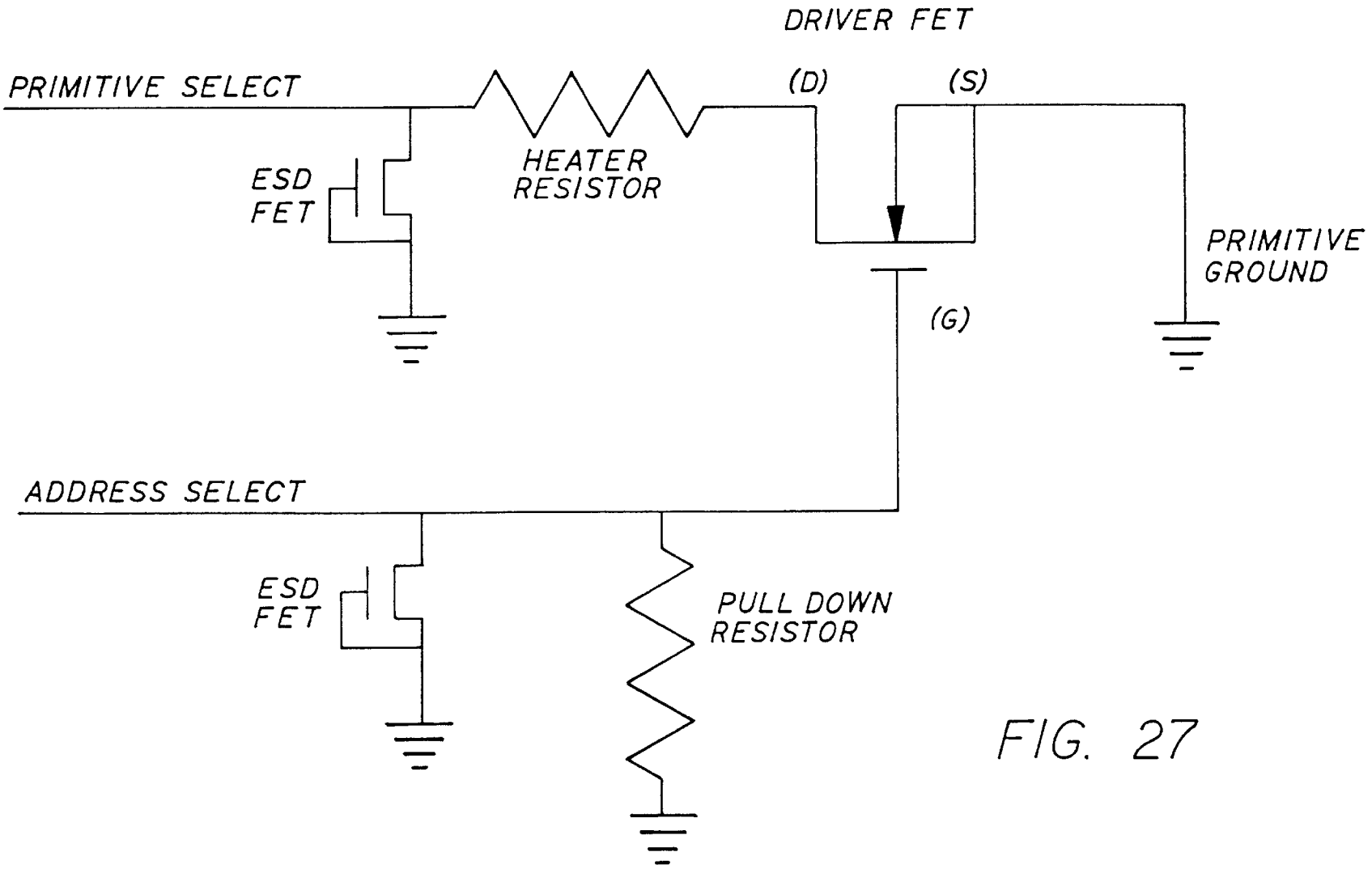
FIG. 27 is a schematic diagram of one heater resistor of FIGS. 25 and 26 and its associated address line, drive transistor, primitive select line and ground line.
Figure 29:
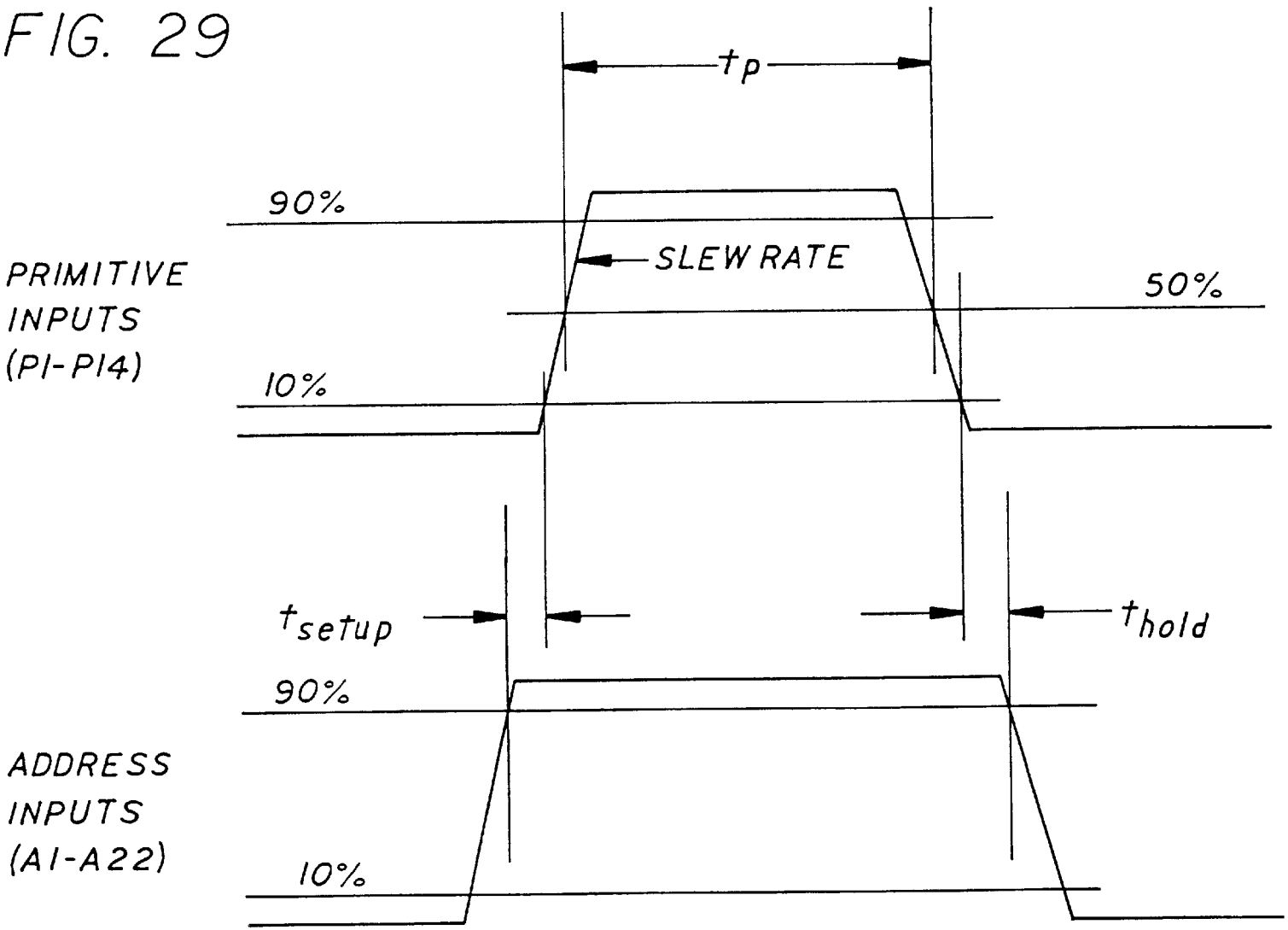
FIG. 29 is a schematic timing diagram for the setting of the address select and primitive select lines.

As described, the firing heater resistors 70 of the preferred embodiment are organized as fourteen primitive groups of twenty or twenty-two resistors. Referring now to the electrical schematic of FIG. 25 and the enlargement of a portion of FIG. 25 shown in FIG. 26, it can be seen that each resistor (numbered 1 through 300 and corresponding to the orifices 17 of FIG. 22) is controlled by its own FET drive transistor, which shares its control input Address Select (A1–A22) with thirteen other resistors. Each resistor is tied to nineteen or twenty-one other resistors by a common node Primitive Select (PS1–PS14). Consequently, firing a particular resistor requires applying a control voltage at its "Address Select" terminal and an electrical power source at its "Primitive Select" terminal. Only one Address Select line is enabled at one time. This ensures that the Primitive Select and Group Return lines supply current to at most one resistor at a time. Otherwise, the energy delivered to a heater resistor would be a function of the number of resistors 70 being fired at the same time. FIG. 27 is a schematic diagram of an individual heater resistor and its FET drive transistor. As shown in FIG. 27, Address Select and Primitive Select lines also contain transistors for draining unwanted electrostatic discharge and pull down resistors to place all unselected addresses in an off state. Table V and FIG. 28 show the correlation between the firing resistor/orifice and the Address Select and Primitive Select Lines.

ing high current can cause avalanche breakdown and consequent physical damage to MOS transistors. Accordingly, the Address Select lines are "set" before power is applied to the Primitive Select lines, and conversely, power is turned off before the Address Select lines are changed as shown in FIG. 29.

Figure 30:
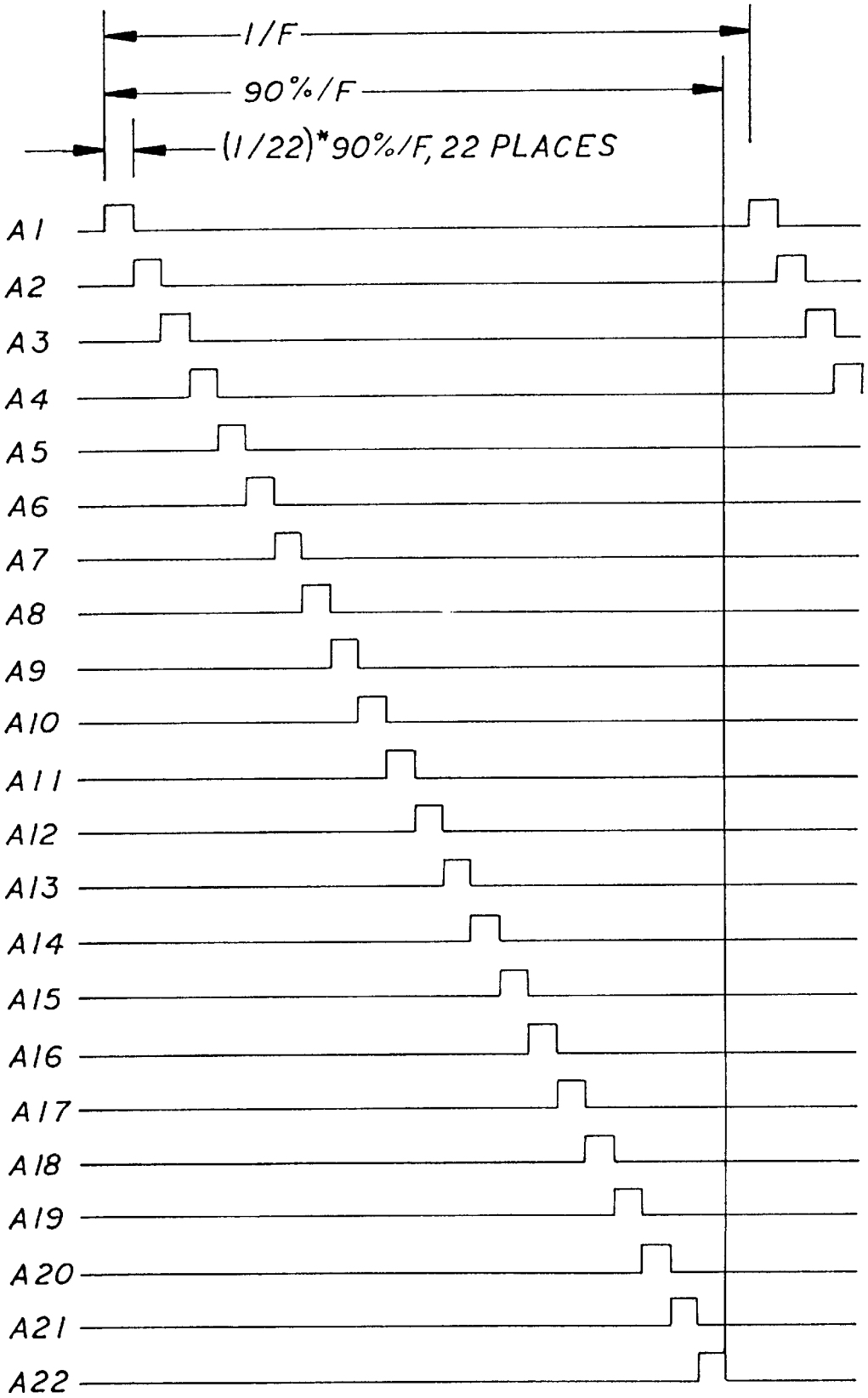
FIG. 30 is a schematic diagram of the firing sequence for the address select lines when the printer carriage is moving from left to right.

In response to print commands from the printer, each primitive is selectively fired by powering the associated primitive select interconnection. To provide uniform energy per heater resistor only one resistor is energized at a time per primitive. However, any number of the primitive selects may be enabled concurrently. Each enabled primitive select thus delivers both power and one of the enable signals to the driver transistor. The other enable signal is an address signal provided by each address select line only one of which is active at a time. Each address select line is tied to all of the switching transistors so that all such switching devices are conductive when the interconnection is enabled. Where a primitive select interconnection and an address select line for a heater resistor are both active simultaneously, that particular heater resistor is energized. Thus, firing a particular resistor requires applying a control voltage at its "Address Select" terminal and an electrical power source at its "Primitive Select" terminal. Only one Address Select line is enabled at one time. This ensures that the Primitive Select and Group Return lines supply current to at most one resistor at a time. Otherwise, the energy delivered to a heater resistor would be a function of the number of resistors 70 being fired at the same time. FIG. 30 shows the firing sequence when the print carriage is scanning from left to right. The firing

TABLE V

NOZZLE NUMBER BY ADDRESS SELECT AND PRIMITIVE SELECT LINES

| | P1 | P2 | P3 | P4 | P5 | P6 | P7 | P8 | P9 | P10 | P11 | P12 | P13 | P14 |
|---|---|---|---|---|---|---|---|---|---|---|---|---|---|---|
| A1 | 1 | | 45 | 42 | 89 | 86 | 133 | 130 | 177 | 174 | 221 | 218 | 265 | 262 |
| A2 | 7 | 4 | 51 | 48 | 95 | 92 | 139 | 136 | 183 | 180 | 227 | 224 | 271 | 268 |
| A3 | 13 | 10 | 57 | 54 | 101 | 98 | 145 | 142 | 189 | 186 | 233 | 230 | 277 | 274 |
| A4 | 19 | 16 | 63 | 60 | 107 | 104 | 151 | 148 | 195 | 192 | 239 | 236 | 283 | 280 |
| A5 | 25 | 22 | 69 | 66 | 113 | 110 | 157 | 154 | 201 | 198 | 245 | 242 | 289 | 286 |
| A6 | 31 | 28 | 75 | 72 | 119 | 116 | 163 | 160 | 207 | 204 | 251 | 248 | 295 | 292 |
| A7 | 37 | 34 | 81 | 78 | 125 | 122 | 169 | 166 | 213 | 210 | 257 | 254 | | 298 |
| A8 | | 40 | 43 | 84 | 87 | 128 | 131 | 172 | 175 | 216 | 219 | 260 | 263 | |
| A9 | 5 | 2 | 49 | 46 | 93 | 90 | 137 | 134 | 181 | 178 | 225 | 222 | 269 | 266 |
| A10 | 11 | 8 | 55 | 52 | 99 | 96 | 143 | 140 | 187 | 184 | 231 | 228 | 275 | 272 |
| A11 | 17 | 14 | 61 | 58 | 105 | 102 | 149 | 146 | 193 | 190 | 237 | 234 | 281 | 278 |
| A12 | 23 | 20 | 67 | 64 | 111 | 108 | 155 | 152 | 199 | 196 | 243 | 240 | 287 | 284 |
| A13 | 29 | 26 | 73 | 70 | 117 | 114 | 161 | 158 | 205 | 202 | 249 | 246 | 293 | 290 |
| A14 | 35 | 32 | 79 | 76 | 123 | 120 | 167 | 164 | 211 | 208 | 255 | 252 | 299 | 296 |
| A15 | | 38 | 41 | 82 | 85 | 126 | 129 | 170 | 173 | 214 | 217 | 258 | 261 | |
| A16 | 3 | | 47 | 44 | 91 | 88 | 135 | 132 | 179 | 176 | 223 | 220 | 267 | 264 |
| A17 | 9 | 6 | 53 | 50 | 97 | 94 | 141 | 138 | 185 | 182 | 229 | 226 | 273 | 270 |
| A18 | 15 | 12 | 59 | 56 | 103 | 100 | 147 | 144 | 191 | 188 | 235 | 232 | 279 | 276 |
| A19 | 21 | 18 | 65 | 62 | 109 | 106 | 153 | 150 | 197 | 194 | 241 | 238 | 285 | 282 |
| A20 | 27 | 24 | 71 | 68 | 115 | 112 | 159 | 156 | 203 | 200 | 247 | 244 | 291 | 288 |
| A21 | 33 | 30 | 77 | 74 | 121 | 118 | 165 | 162 | 209 | 206 | 253 | 250 | 297 | 294 |
| A22 | 39 | 36 | 83 | 80 | 127 | 124 | 171 | 168 | 215 | 212 | 259 | 256 | | 300 |

The Address Select lines are sequentially turned on via TAB head assembly interface circuitry according to a firing order counter located in the printer and sequenced (independently of the data directing which resistor is to be energized) from A1 to A22 when printing form left to right and from A22 to A1 when printing from right to left. The print data retrieved from the printer memory turns on any combination of the Primitive Select lines. Primitive Select lines (instead of Address Select lines) are used in the preferred embodiment to control the pulse width. Disabling Address Select lines while the drive transistors are conductsequence is reversed when scanning from right to left. A brief rest period of approximately ten percent of the period is allowed between cycles. This rest period prevents Address Select cycles from overlapping due to printer carriage velocity variations.

The interconnections for controlling the TAB head assembly driver circuitry include separate primitive select and primitive common interconnections. The driver circuitry of the preferred embodiment comprises an array of fourteen primitives, fourteen primitive commons, and twenty-two address select lines, thus requiring 50 interconnections to control 300 firing resistors. The integration of both heater resistors and FET driver transistors onto a common substrate creates the need for additional layers of conductive circuitry on the substrate so that the transistors could be electrically connected to the resistors and other components of the system. This creates a concentration of heat generation within the substrate.

Figure 31:
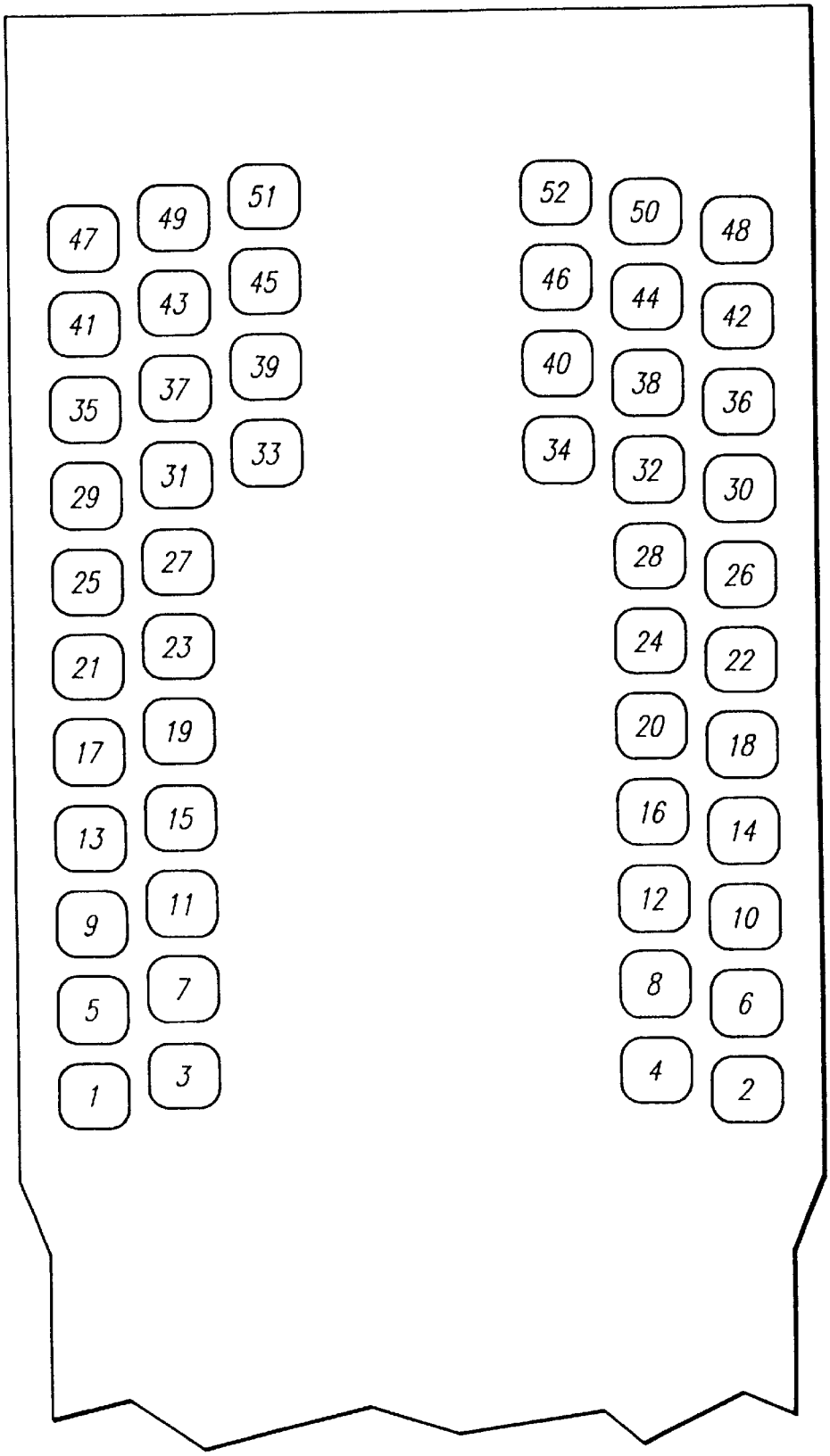
FIG. 31 is a diagram showing the layout of the contact pads on the TAB head assembly.

Referring to FIGS. 1 and 2, the print cartridge 10 is designed to be installed in a printer so that the contact pads 20, on the front surface of the flexible circuit 18, contact printer electrodes which couple externally generated energization signals to the TAB head assembly. To access the traces 36 on the back surface of the flexible circuit 18 from the front surface of the flexible circuit, holes (vias) are formed through the front surface of the flexible circuit to expose the ends of the traces. The exposed ends of the traces are then plated with, for example, gold to form the contact pads 20 shown on the front surface of the flexible circuit in FIG. 2. In the preferred embodiment, the contact or interface pads 20 are assigned the functions listed in Table VI. FIG. 31 shows the location of the interface pads 20 on the TAB head assembly of FIG. 2.

TABLE VI

ELECTRICAL PAD DEFINITION

| Pad # | Name | Function |
|---|---|---|
| | Odd Side of Head | |
| 1 | A9 | Address Select 9 |
| 3 | PS7 | Primitive Select 7 |
| 5 | G7 | Common 7 |
| 7 | PS5 | Primitive Select 5 |
| 9 | G5 | Common 5 |
| 11 | G3 | Common 3 |
| 13 | PS3 | Primitive Select 3 |
| 15 | A7 | Address Select 7 |
| 17 | A5 | Address Select 5 |
| 19 | G1 | Common 1 |
| 21 | PS1 | Primitive Select 1 |
| 23 | A3 | Address Select 3 |
| 25 | A1 | Address Select 1 |
| 27 | TSR | Thermal Sense |
| 29 | A2 | Address Select 2 |
| 31 | A4 | Address Select 4 |
| 33 | PS13 | Primitive Select 13 |
| 35 | G13 | Common 13 |
| 37 | A6 | Address Select 6 |
| 39 | A8 | Address Select 8 |
| 41 | PS11 | Primitive Select 11 |
| 43 | G11 | Common 11 |
| 45 | A10 | Address Select 10 |
| 47 | A12 | Address Select 12 |
| 49 | PS9 | Primitive Select 9 |
| 51 | G9 | Common 9 |
| | Even Side of Head | |
| 2 | G6 | Common 6 |
| 4 | PS6 | Primitive Select 6 |
| 6 | A11 | Address Select 11 |
| 8 | A13 | Address Select 13 |
| 10 | G4 | Common 4 |
| 12 | PS4 | Primitive Select 4 |
| 14 | A15 | Address Select 15 |
| 16 | A17 | Address Select 17 |
| 18 | G2 | Common 2 |
| 20 | PS2 | Primitive Select 2 |
| 22 | A19 | Address Select 19 |
| 24 | A21 | Address Select 21 |
| 26 | A22 | Address Select 22 |
| 28 | R10X | 10X Resistor |
| 30 | A20 | Address Select 20 |
| 32 | PS14 | Primitive Select 14 |
| 34 | G14 | Common 14 |

TABLE VI-continued

ELECTRICAL PAD DEFINITION

| Pad # | Name | Function |
|---|---|---|
| 36 | A18 | Address Select 18 |
| 38 | A16 | Address Select 16 |
| 40 | PS12 | Primitive Select 12 |
| 42 | G12 | Common 12 |
| 44 | G10 | Common 10 |
| 46 | PS10 | Primitive Select 12 |
| 48 | G8 | Common 8 |
| 50 | PS8 | Primitive Select 8 |
| 52 | A14 | Address Select 14 |

As disclosed above in Table III and the Figures associated therewith (FIGS. 17–23), the shelf length of that particular architecture is in the range of about 90 to 130 microns, with the variation due to nozzle stagger. As shown in, e.g., FIGS. 17 and 18, the firing (vaporization) chamber 130 is essentially square, more generally, rectangular. This configuration has a maximum operating frequency of about 12 Khz.

Figure 32:
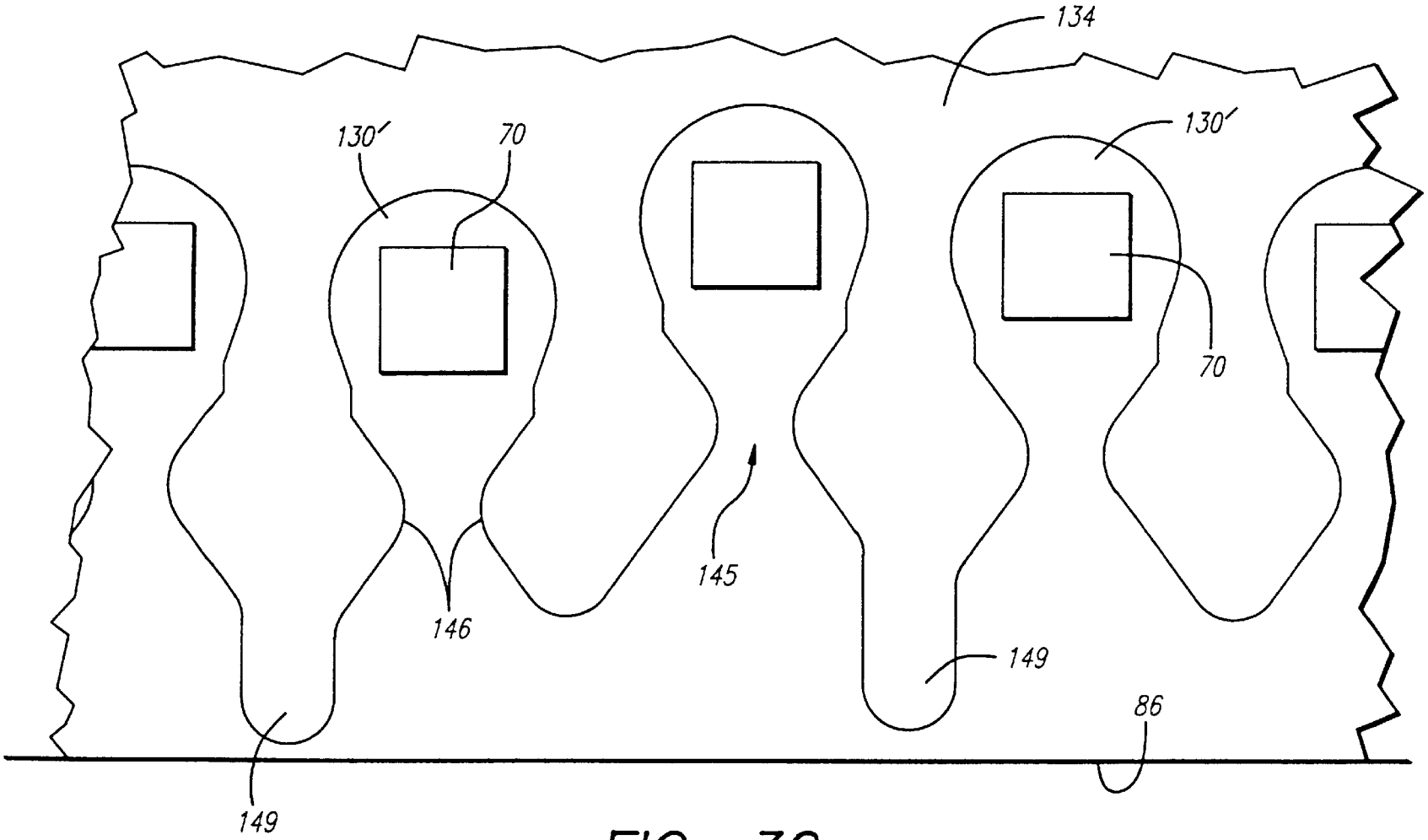
FIG. 32 is a top plan view, analogous to FIG. 18, depicting an alternative embodiment for an ink vaporization chamber.

In order to improve print quality for this particular architecture, a number of parameters may be modified. For example, the distance from the resistor 70 to the third (back) wall (opposite the ink channel) may be reduced from its present value of 8 microns to 4 microns. Secondly, a round, or ellipitical, vaporization chamber 130' may be used to eliminate "dead spots" in rectangular vaporization chambers 130, not matching the shape of the orifice 17. The "dead spots" result in an erratic nozzle trajectory and drop volume. Use of a round vaporization chamber 130' having substantially the same diameter (within manufacturing tolerances) as the orifice 17 appears to overcome this problem. This configuration is depicted in FIG. 32.

While peninsulas 149 are present to prevent cross-talk, preferably every other peninsula 149 is shortened to the pinch points 146, as described above with reference to FIGS. 17 and 18, to improve refill speed while preserving cross-talk reduction.

In yet another embodiment of the pen architecture, the shelf is shortened even further, to a width of about 55 microns. Because it is so short, there is no room for peninsulas 149. Further, the stagger of the resistors, depicted in FIGS. 17–23, is eliminated. Instead, the printhead is rotated slightly, as described more fully below, to account for the elimination of stagger in the resistors (so-called "slant" design). While a rectangular vaporization chamber 130 may be used, the round vaporization chamber 130' is preferably utilized in this embodiment. The pinch points 146 remain. This embodiment has a maximum operating frequency that approaches 20 Khz.

Figure 33:
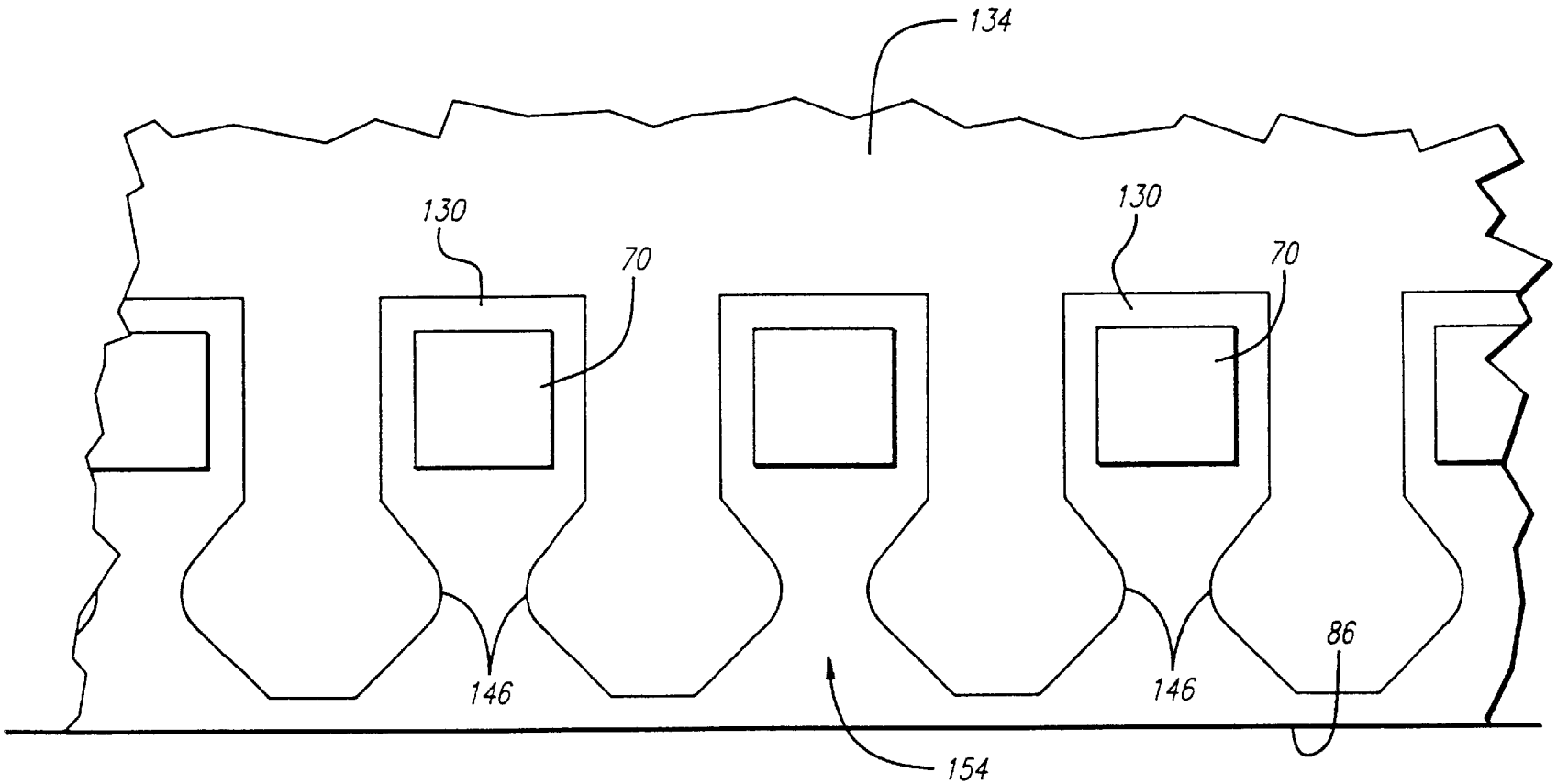
FIG. 33 is a top plan view, analogous to FIG. 18, depicting a plurality of firing resistors and associated vaporization chambers with stagger of the firing elements removed.

Specifically with regard to the elimination of stagger in the resistors, reference is now made to FIGS. 22, 22*a,* and 33–37. FIG. 33, which is analogous to FIG. 18, depicts a plurality of resistors 70 all placed at substantially the same distance from the edge 86; that is, the shelf length is not staggered. It is seen that the peninsulas 146, present in FIG. 18, are absent in FIG. 33.

Figure 34:
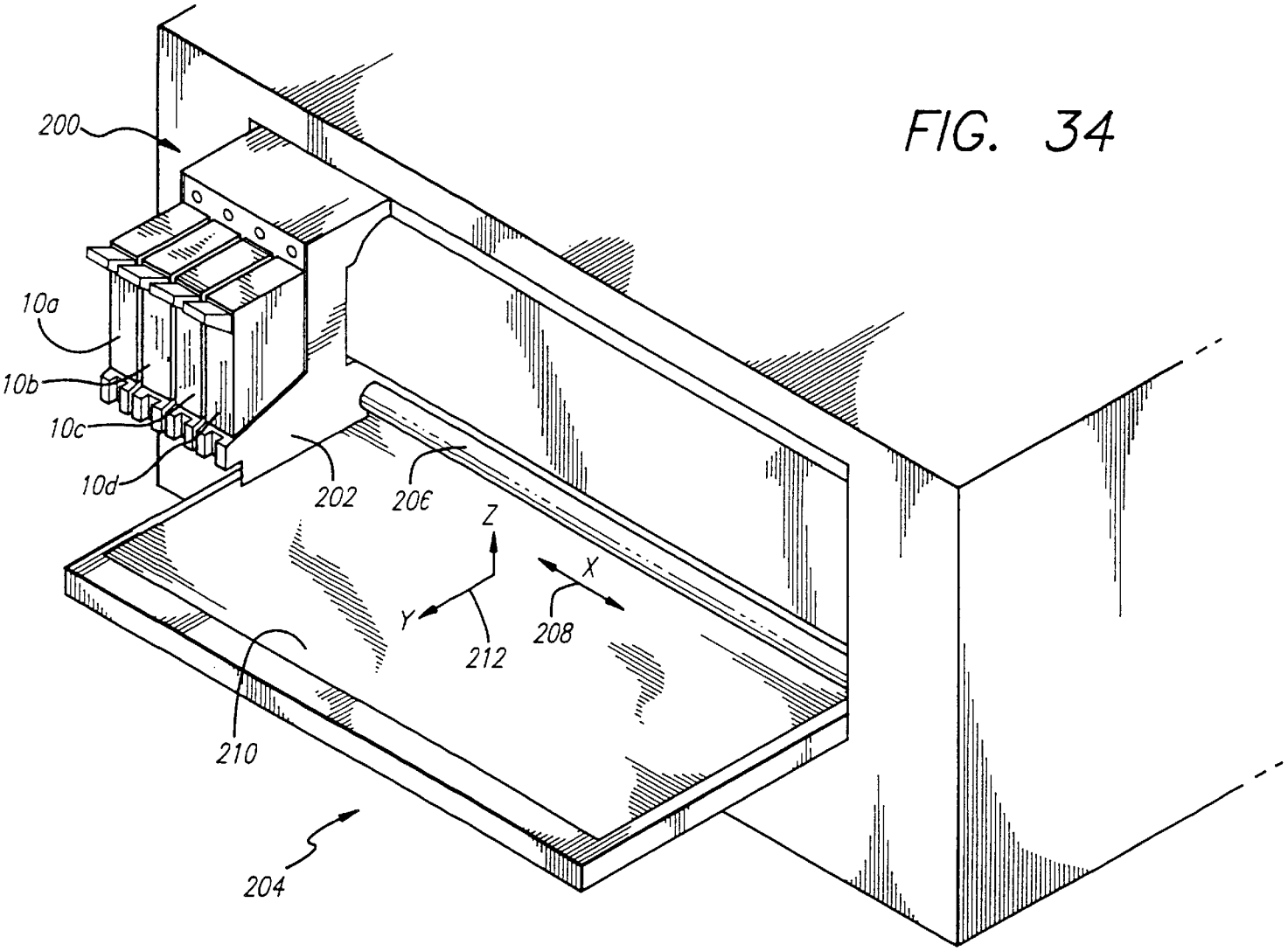
FIG. 34 is a perspective view of a portion of a printer, including a cartridge holder for moving a plurality of print cartridges across a print medium.

FIG. 34 depicts a set 200 of print cartridges 10*a–d* mounted in a carriage 202 for a small format printer 204; a large format printer could just as easily have been used in this illustration. The carriage 202 is supported by and moves along a carriage rod 206 in the X-direction 208, which is the carriage scan axis. The print medium 210 advances in the Y-direction 212.

The printer prints a swath, and then the print medium (e.g., paper) 210 advances for the next swath. This discussion concerns the printing of one swath (which is done as the carriage 202 moves along the "scan axis" direction 208).

Figure 35:
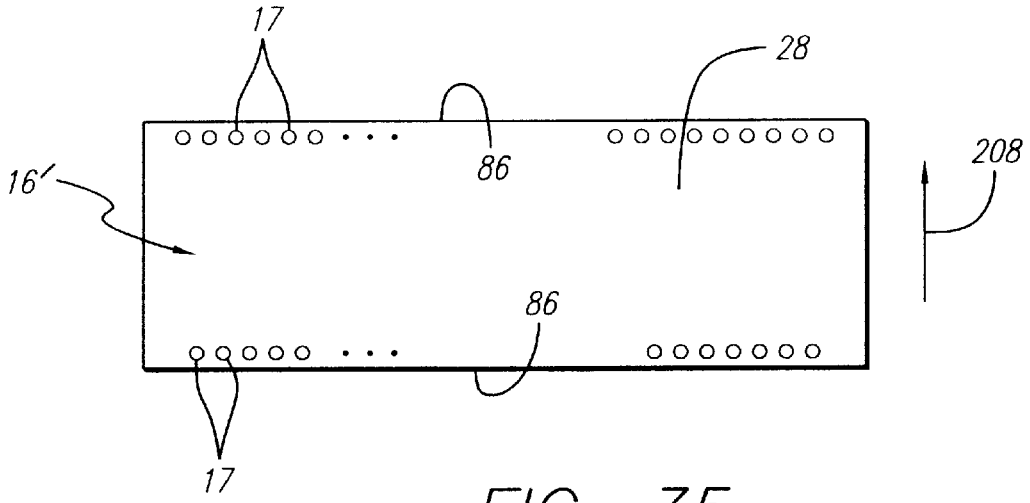
FIG. 35 is a top plan view of a printhead nozzle array with a straight line of nozzles, with the array perpendicular to the scan direction of the printhead.

For a number of reasons, all of the nozzles 17 cannot be fired simultaneously. Thus, as described above, firings are staggered within a primitive. That is, two adjacent nozzles are fired at slightly different times. FIG. 35 illustrates a printhead nozzle array 16' with a straight line of nozzles 17.

The objective is to obtain a rectangular array of dots printed on the print medium 210. However, if the timing of two nozzles is off (by the normal delay), then a placement error of v*t will occur, where v is the scan velocity and t is the delay between firing two adjacent nozzles. If v*t is equal to an integral number of dot spacings, then that can be corrected by firing an extra initial dot for the "late" nozzle. However, v*t is normally some fraction of the dot spacing. Thus, the correction is made by staggering the nozzles as shown in FIG. 22. The stagger distance D between two nozzles is equal to v*t, as illustrated in FIG. 22*a*.

Figure 36A:
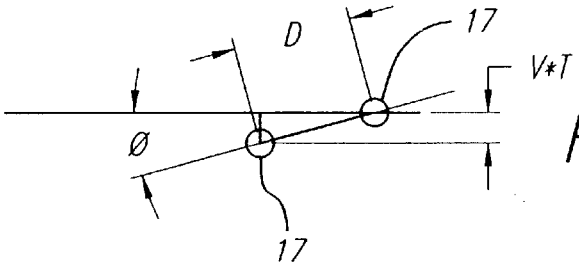
FIG. 36*a* is an enlargement of a portion of FIG. 36.
Figure 36:
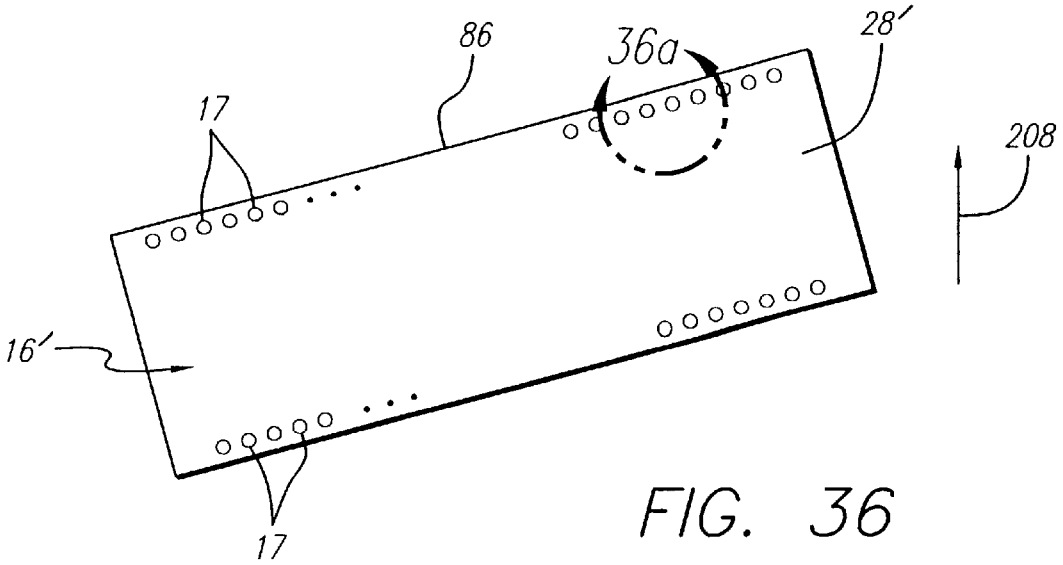
FIG. 36 is a top plan view similar to that of FIG. 35, but with the array rotated at a given angle with respect to the scan direction of the printhead.

In order for nozzles 17 to have maximum performance, the distance from resistor to die edge needs to be minimized. This can only be accomplished by having a straight line of nozzles. However, this re-creates the timing problem. The way to solve this is to rotate the entire printhead, as shown in FIG. 36 (slant design). The rotational angle $\phi$ of the die 28 is equal to the angle $\phi$ defined by the nozzle stagger. If the nozzle spacing is D, then the sine of the angle $\phi$ is equal to (v*t)/D. The angle of the cartridge rotation is shown in FIG. 37; again, the angle $\phi$ is arcsine((v*t)/D).

There are at least two ways to provide this rotation. One is to rotate the die 28 in the print cartridge 10. This has the disadvantage that a special printhead assembly line must be provided to manufacture a cartridge with a rotated die.

Figure 37:
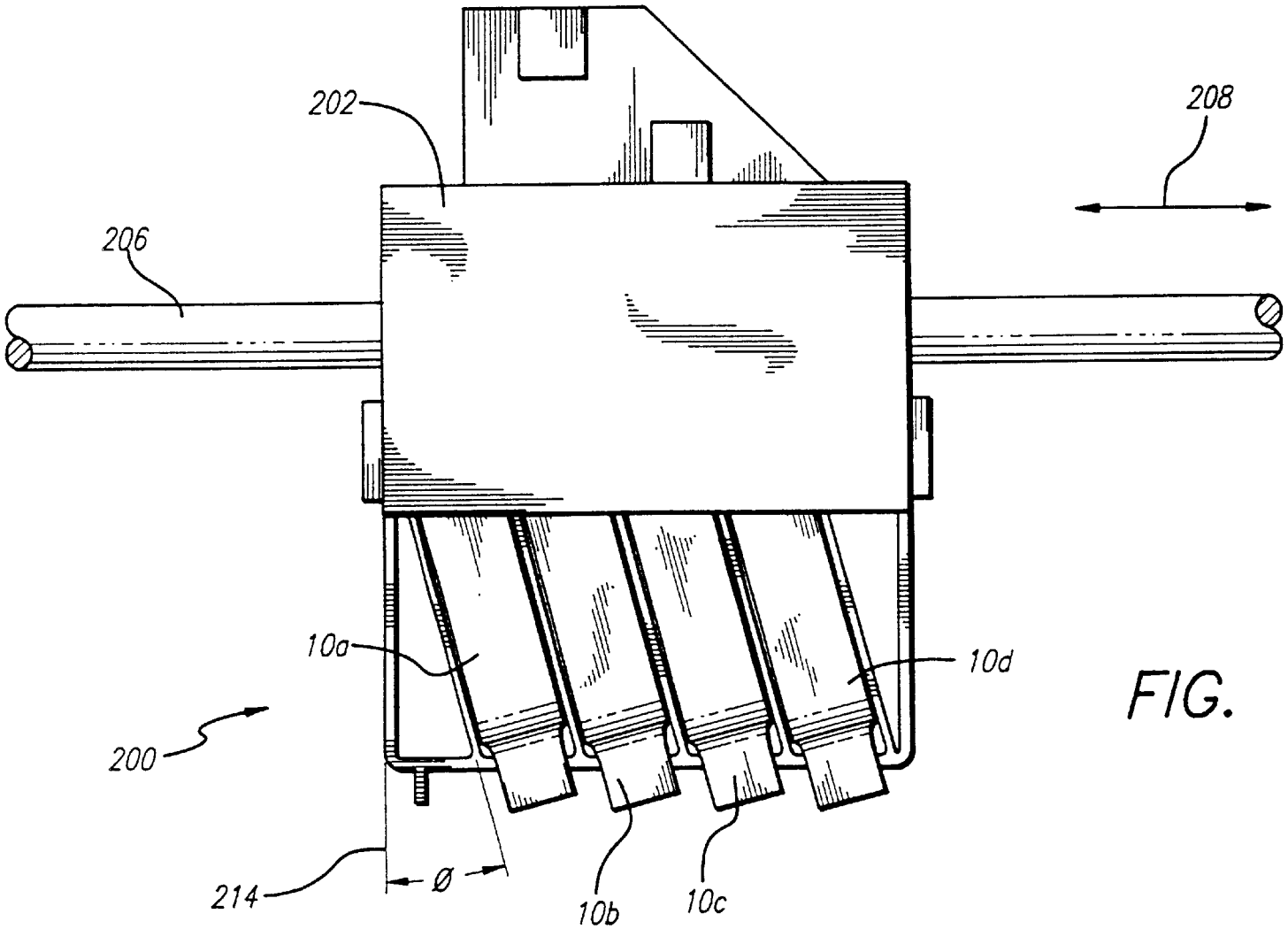
FIG. 37 is a top plan view of a cartridge holder, configured to contain a plurality of print cartridges at the given angle depicted in FIG. 36.

An easier method to implement is simply to rotate the entire cartridge 10 by reconfiguring the carriage 202 to hold the cartridges 10*a–d* in the proper angular orientation, as shown in FIG. 37, with the cartridges 10*a–d* rotated about an axis of rotation from the side 214 of the carriage 202 equal to the angle $\phi$.

In the architecture described with reference to FIGS. 17–23, the pinch point gap 145 (channel width N) is nominally 30 microns. With regard to the shorter shelf shown in FIG. 33, the pinch point gap 145 is about 35 microns.

Finally, the thickness of the barrier layer 134 of the pen design depicted in FIGS. 17–23 is about 25 microns. In the above-described shorter shelf design, shown in FIGS. 33 and 36, the thickness of the barrier layer 134 is about 19 microns.

B. Ink Compositions

The ink compositions employed in the practice of the invention comprise a vehicle and a colorant. The vehicle contains water and at least one cosolvent. The colorant may comprise one or more pigment dispersions or one or more water-miscible dyes.

1. Pigment-Based Inks

The pigment dispersion comprises a pigment and usually a dispersant. Preferably, the dispersant is a polymeric dispersant. In addition to, or in place of a polymeric dispersant, one or more surfactant compounds may be used as dispersants. These may be anionic, cationic, non-ionic, or amphoteric. A detailed list of non-polymeric as well as some polymer dispersants are listed in the section on dispersants, pages 110–129, 1990 McCutcheon's Functional Materials, North American Edition, Manufacturing Confectioner Publishing Co., Glen Rock, N.J. 07452.

1a. Dispersants

The purpose of the dispersant is to keep the pigment particles in a stable suspension. As described in U.S. Pat. No. 5,169,438, issued Dec. 8, 1992, to Howard Matrick, polymeric dispersants suitable in the practice of the invention include AB or BAB block copolymers wherein the A block is hydrophobic and serves to link with the pigment, and the B block is hydrophilic and serves to disperse the pigment in the aqueous medium. In general, the A segment is a hydrophobic homopolymer or copolymer of an acrylic monomer having the formula $$CH_2{=}C(X)(Y)$$

wherein X is H or $CH_3$ and Y is $C(O)OR_1$, $C(O)NR_2R_3$, or CN, wherein $R_1$ is an alkyl, aryl, or alkylaryl group having 1 to 20 carbon atoms, and $R_2$ and $R_3$ are hydrogen or an alkyl, aryl, or alkylaryl group having 1 to 9 carbon atoms, the A segment having an average molecular weight of at least about 300 and being water-insoluble. In general, the B segment is a hydrophilic polymer, or salt thereof, of (1) an acrylic monomer having the formula $$CH_2{=}C(X)(Y1)$$

wherein X is H or $CH_3$ and Y1 is C(O)OH, $C(O)NR_2R_3$, $C(O)OR_4NR_2R_3$, or $C(OR_5)$, wherein $R_2$ and $R_3$ are hydrogen or an alkyl, aryl, or alkylaryl group having 1 to 9 carbon atoms, $R_4$ is an alkyl diradical having 1 to 5 carbon atoms, and $R_5$ is an alkyl group having 1 to 20 carbon atoms and optionally containing one or more hydroxyl or ether groups; or (2) an acrylic monomer having the formula $$CH_2{=}C(X)(Y)$$

where X and Y are the substituent groups defined for the A segment, the B segment having an average molecular weight of at least about 300 and being water-soluble. The B block(s) generally constitute 10 to 90 wt %, preferably 25 to 65 wt % of the entire block polymer.

The A block is a polymer or copolymer prepared from at least one acrylic monomer having the formula set forth above. The $R_1$, $R_2$, and $R_3$ groups optionally may contain hydroxy, ether, $OSi(CH_3)_3$ groups, and similar substituent groups. Representative monomers that may be selected include, but are not limited to, the following: methyl methacrylate (MMA), ethyl methacrylate (EMA), propyl methacrylate, n-butyl methacrylate (BMA or NBMA), hexyl methacrylate, 2-ethylhexyl methacrylate (EHMA), octyl methacrylate, lacryl methacrylate (LMA), stearyl methacrylate, phenyl methacrylate, benzyl methacrylate (BiMA), hydroxyethyl methacrylate (HEMA), hydroxypropyl methacrylate, 2-ethoxyethyl methacrylate, methacrylonitrile, 2-trimethylsiloxyethyl methacrylate, glycidyl methacrylate (GMA), p-tolyl methacrylate, sorbyl methacrylate, methyl acrylate, ethyl acrylate, propyl acrylate, butyl acrylate, hexyl acrylate, 2-ethylhexyl acrylate, octyl acrylate, lauryl acrylate, stearyl acrylate, phenyl acrylate, benzyl acrylate, hydroxyethyl acrylate, hydroxypropyl acrylate, acrylonitrile, 2-trimethylsiloxyethyl acrylate, glycidyl acrylate, p-tolyl acrylate, sorbyl acrylate, and $\beta$-ethoxytriethylene glycol methacrylate (ETEGMA). Preferred A blocks are homopolymers and copolymers prepared from methyl methacrylate, butyl methacrylate, 2-ethylhexyl methacrylate, or copolymers of methyl methacrylate with butyl methacrylate.

The A block also may contain a hydrophilic monomer, such as $CH_2{=}C(X)(Y')$, wherein X is H or $CH_3$ and Y' Is C(O)OH, $C(O)NR_2R_3$, $C(O)OR_4NR_2R_3$, $C(OR_5)$, or their salts, wherein $R_2$ and $R_3$ may be H or C1 to C9 alkyl, aryl, or alkylaryl, $R_4$ is a C1 to C5 alkyl diradical, and $R_5$ is a C1 to C20 alkyl diradical which may contain hydroxy or ether groups to provide some changes in solubility. However, there should not be enough hydrophilic monomer present in the A block to render it, or its salt, completely water soluble.

The B block is a polymer prepared from at least one acrylic monomer having the formula provided above. Representative monomers include methacrylic acid (MAA), acrylic acid, dimethylaminoethyl methacrylate (DMAEMA), diethylaminoethyl methacrylate, t-butylaminoethyl methacrylate, dimethylaminoethyl acrylate, diethylaminoethyl acrylate, dimethylaminopropyl methacrylamide, acrylamide, and dimethylacrylamide. Homopolymers or copolymers of methacrylate acid or dimethylaminoethyl methacrylate are preferred.

The acid-containing polymer may be made directly or may be made from a blocked monomer with the blocking group being removed after polymerization. Examples of blocked monomers that generate acrylic or methacrylic acid after removal of the blocking group include: trimethylsilyl methacrylate (TMS-MAA), trimethylsilyl acrylate, 1-butoxyethyl methacrylate, 1-ethoxyethyl methacrylate, 1-butoxyethyl acrylate, 1-ethoxyethyl acrylate, 2-tetrahydropyranyl acrylate, and 2-tetrahydropyranyl methacrylate.

The B block may be a copolymer of an acid or amino-containing monomer with other monomers, such as those used in the A block. The acid or amino monomer may be used in a range of 10 to 100%, preferable in a range of 20 to 100% of the B block composition.

Block copolymers that are useful in practicing the invention have a number average molecular weight below 20,000, preferably below 15,000, and typically in the range of 1,000 to 3,000. Preferred block copolymers have number average molecular weights in the range of 500 to 1,500 for each A and B block.

Representative AB and BAB block polymers that may be selected include the polymers listed in Table VII below, wherein the values recited represent the degree of polymerization of each monomer. A double slash indicates a separation between blocks and a single slash indicates a random copolymer. For example, MMA//MMA/MAA 10//5/7.5 is an AB block polymer with an A block of MMA that is 10 monomer units long (molecular weight of 1,000) and a B block that is a copolymer of MMA and MAA with 5 monomer units of MMA and 7.5 units of MAA (molecular weight of the B block is 1,145).

TABLE VII

EXAMPLES OF BLOCK POLYMERS

| | Molecular Weight |
|---|---|
| **AB BLOCK POLYMER** | |
| EHMA//EHMA/MAA | |
| 3//3/5 | 1,618 |
| 5//2.5/2.5 | 1,700 |
| 5//5/10 | 2,840 |
| 20//10/10 | 6,800 |
| 15//11/22 | 7,020 |

TABLE VII-continued

EXAMPLES OF BLOCK POLYMERS

| | Molecular Weight |
|---|---|
| EHMA//LMA/MAA | |
| 10//10/12 | 3,552 |
| EHMA//MMA/EHMA/MAA | |
| 10//5/5/12 | 4,502 |
| EHMA//MMA/MAA | |
| 5//5/10 | 2,350 |
| 5//10/10 | 2,850 |
| EHMA//MAA | |
| 15//5 | 3,400 |
| BMA//EMA/MAA | |
| 5//2.5/2.5 | 1,280 |
| 10//5/10 | 3,000 |
| 20//10/20 | 6,000 |
| 15//7.5/3 | 3,450 |
| 5//5/10 | 2,300 |
| 5//10/5 | 2,560 |
| BMA//MMA/MAA | |
| 15//15/5 | 4,060 |
| 15//7.5/3 | 3,140 |
| 10//5/10 | 2,780 |
| MMA//MMA/MAA | |
| 10//5/10 | 2,360 |
| 10//5/5 | 1,930 |
| 10//5/7.5 | 2,150 |
| 20//5/7.5 | 3.150 |
| 15/7.5/3 | 2,720 |
| MMA//EHMA/MAA | |
| 5//5/10 | 2,350 |
| 10//5/10 | 2,850 |
| BMA/MMA//EMA/MAA | |
| 5/5//5/10 | 7,780 |
| BMA//MAA | |
| 10//10 | 2,260 |
| BMA//HEMA/MAA | |
| 15//7.5/3 | 3,360 |
| 7.5//7.5/3 | 2,300 |
| 15//7.5/7.5 | 3,750 |
| EMA//BMA/DMA/EMA | |
| 10//5/10 | 3,700 |
| BMA//BMA/DMA/EMA/MAA | |
| 10//5/5/5 | 2,635 |
| **BAB BLOCK POLYMER** | |
| BMA/MAA//BMA//BMA/MAA | |
| 5/10//10//5/10 | 4,560 |
| MMA/MAA//MMA//MMA/MAA | |
| 5/7.5//10//5/7.5 | 3,290 |

Preferred block polymers are methyl methacrylate//methyl methacrylate/methacrylic acid (10//5/7.5), 2-ethylhexyl methacrylate//2-ethylhexyl methacrylate/methacrylic acid (5//5/10), n-butyl methacrylate//n-butyl methacrylate/methacrylic acid (10//5/10), n-butyl methacrylate//methacrylic acid (10//10), ethylhexyl methacrylate//methyl methacrylate/methacrylic acid (5//10/10), n-butyl-methacrylate//2-hydroxy-ethyl methacrylate/methacrylic acid (5//10/10), n-butyl-methacrylate//2-hydroxyethyl methacrylate/methacrylic acid (15//7.5/3), methyl methacrylate//ethylhexyl methacrylate/methacrylic acid (5//5/10), and butyl methacrylate//butyl methacrylate/dimethylaminoethyl methacrylate (10//5/10).

Yet another, and preferred, dispersant is an ABC triblock copolymer, such as MAA//BzMA//ETEGMA, disclosed in U.S. Pat. No. 5,302,197. Preparation of this copolymer is given in the patent.

Other alternatives are possible for the dispersant structure, such as graft polymers, random polymers, and star polymers. These tend to be less preferable than the triblock copolymer described above.

Finally, one or more charged hydrophilic molecules may be covalently bonded to the pigment particle. This eliminates the need for a dispersant or surfactant acting as dispersant.

Yet additional dispersants include polyvinylpyrrolidone (PVP), polyethylene oxide, and other agents, such as discussed in the above-referenced U.S. Pat. No. 5,169,438.

1b. Pigments

A wide variety of organic and inorganic pigments, alone or in combination, may be used to make the ink. The term "pigment" as used herein means an insoluble colorant. The pigment particles are sufficiently small to permit free flow of the ink through the ink jet printhead, especially at the ejecting nozzles that usually have a diameter ranging from about 40 to 70 microns. The particle size also has an influence on the pigment dispersion stability, which is critical throughout the life of the ink. Brownian motion of minute particles will help prevent the particles from settling. It is also desirable to use small particles for maximum color strength. The range of useful particle size is about 20 to 200 nm and preferably within the ranges of (a) about 20 to 99 nm, (b) about 100 to 125 nm, or (c) about 126 to 200 nm.

The selected pigment may be used in dry or wet form. For example, pigments are usually manufactured in aqueous media and the resulting pigment is obtained as water wet presscake. In presscake form, the pigment is not aggregated to the extent that it is in dry form. Thus, pigments in water wet presscake form do not require as much deaggregation in the process of preparing the inks from dry pigments. Representative commercial dry pigments that may be used in the practice of the invention are listed in Table VIII, below.

TABLE VIII

REPRESENTATIVE DRY PIGMENTS

| Pigment Brand Name | Manufacturer | Color Index Pigment |
|---|---|---|
| Permanent Yellow DHG | Hoechst | Yellow 12 |
| Permanent Yellow Gr | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow-X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Permanent Yellow G3R-01 | Hoechst | Yellow 114 |
| Chromophtal ® Yellow 8G | Ciba-Geigy | Yellow 128 |
| Igrazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |

TABLE VIII-continued

REPRESENTATIVE DRY PIGMENTS

| Pigment Brand Name | Manufacturer | Color Index Pigment |
|---|---|---|
| L75-2577 Yellow | Sun Chem. | |
| Hostaperm ® Orange GR | Hoechst | Orange 43 |
| Paliogen ® Orange | BASF | Orange 51 |
| Igralite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heucophthal ® Blue G XBT-583D | Heubach | Blue 15:3 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | Violet 19 |
| Indofast ® Violet | Mobay | Violet 23 |
| Monastral ® Violet Maroon B | Ciba-Geigy | Violet 42 |
| Monarch ® 1400 | Cabot | Black 7 |
| Monarch ® 1300 | Cabot | Black 7 |
| Monarch ® 1100 | Cabot | Black 7 |
| Monarch ® 1000 | Cabot | Black 7 |
| Monarch ® 900 | Cabot | Black 7 |
| Monarch ® 880 | Cabot | Black 7 |
| Monarch ® 800 | Cabot | Black 7 |
| Monarch ® 700 | Cabot | Black 7 |
| Raven 7000 | Columbian | Black 7 |
| Raven 5750 | Columbian | Black 7 |
| Raven 5250 | Columbian | Black 7 |
| Raven 5000 | Columbian | Black 7 |
| Raven 3500 | Columbian | Black 7 |
| Color Black FW 200 | Degussa | Black 7 |
| Color Black FW 2 | Degussa | Black 7 |
| Color Black FW 2V | Degussa | Black 7 |
| Color Black FW 1 | Degussa | Black 7 |
| Color Black FW 18 | Degussa | Black 7 |
| Color Black S 160 | Degussa | Black 7 |
| Color Black S 170 | Degussa | Black 7 |
| Special Black 6 | Degussa | Black 7 |
| Special Black 5 | Degussa | Black 7 |
| Special Black 4A | Degussa | Black 7 |
| Special Black 4 | Degussa | Black 7 |
| Printex U | Degussa | Black 7 |
| Printex V | Degussa | Black 7 |
| Printex 140U | Degussa | Black 7 |
| Printex 140V | Degussa | Black 7 |
| Tipure ® R-101 | DuPont | White 6 |

Representative commercial pigments that can be used in the form of a water wet presscake include: Heucophthal® Blue BT-585-P, Toluidine Red Y (C.I. Pigment Red 3), Quindo® Magenta Pigment Red 122), Magenta RV-6831 prsscake (Mobay Chemical, Harmon Division, Haledon, N.J.), Sunfast® Magenta 122 (Sun Chemical Corp., Cincinnati, Ohio), Indo® Brilliant Scarlet pigment Red 123, C.I. No. 71145) Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow YT-839-P (Pigment Yellow 74, C.I. No. 11741), Sunbrite® Yellow 17 (Sun Chemical Corp., Cincinnati, Ohio), Toluidine Yellow G (C.I. Pigment Yellow 1), Pigment Scarlet (C.I. Pigment Red 60), Auric Brown (C.I. Pigment Brown 6), etc. Black pigments, such as carbon black, generally are not available in the form of aqueous presscakes.

1c. Preparation of Pigment-Based Inks

The pigmented ink is prepared by premixing the selected pigment(s) and dispersant in water. Cosolvents may be present during the dispersion. The dispersing step may be accomplished by any of the well-known techniques, such as disclosed in U.S. Pat. Nos. 5,026,427 and 5,302,197.

2. Dye-Based Inks

The dyes commonly used in aqueous inkjet inks may be anionic, cationic, amphoteric, or non-ionic. Such dyes are well-known in the art. Anionic dyes yield colored anions, and cationic dyes yield colored cations in aqueous solution. Typical anionic dyes contain carboxylic or sulfonic acid groups as the ionic moiety, and encompass all acid dyes. Cationic dyes usually contain quaternary nitrogen groups, and encompass all basic dyes.

Although sodium cations are ordinarily associated with the anionic moieties on the acid dyes, substitutions of the sodium cation may be made, such as with lithium, potassium, and tetramethylammonium cations, as is well-known; see, e.g., U.S. Pat. Nos. 4,994,110, 5,069,718, and 4,761,180, respectively.

Anionic dyes most useful in the practice of the present invention are Acid, Direct, Food, Mordant, and Reactive dyes. Anionic dyes typically are nitroso compound, nitro compounds, azo compounds, stilbene compounds, triarylmethane compounds, xanthene compounds, quinoline compounds, thiazole compounds, azine compounds, oxazine compounds, thiazine compounds, aminoketone compounds, anthraquinone compounds, indigoid compounds, and phthalocyanine compounds.

Some dyes useful in the practice of the invention include:

C.I. Food Blacks 1 and 2;
C.I. Acid Blacks 7, 24, 26, 48, 52, 58, 60, 107, 109, 118, 65, 119, 131, 140, 155, 156, and 187;
C.I. Direct Blacks 17, 19, 32, 38, 51, 71, 74, 75, 112, 117, 154, 163, and 168;
C.I. Reactive Black 31;
C.I. Sulfur Black 1;
Projet Fast Black 2;
Mobay Special Direct Black (SP);
C.I. Acid Reds 1, 8, 17, 32, 35, 37, 42, 57, 92, 115, 119, 131, 133, 134, 154, 186, 249, 254, and 256;
C.I. Direct Reds 37, 63, 75, 79, 80, 83, 99, 220, 224, and 227;
C.I. Acid Violets 11, 34, and 75;
C.I. Direct Violets 47, 48, 51, 90, and 94;
C.I. Reactive Reds 4, 23, 24, 31, 56, 180;
C.I. Acid Blues 9, 29, 62, 102, 104, 113, 117, 120, 175, and 183;
C.I. Direct Blues 1, 6, 8, 15, 25, 71, 76, 78, 80, 86, 90, 106, 108, 123, 163, 165, 199, and 226;
C.I. Reactive Blues 7 and 13;
C.I. Acid Yellows 3, 17, 19, 23, 25, 29, 38, 49, 59, 61, and 72;
C.I. Direct Yellows 27, 28, 33, 39, 58, 86, 100, 132 and 142; and
C.I. Reactive Yellow 2.

3. Aqueous Carrier Medium

The aqueous carrier medium comprises water or a mixture of water and at least one water-miscible organic solvent.

Deionized water is commonly used. Selection of a suitable mixture of water and water-miscible organic solvent depends on requirements of the specific application, such as the desired surface tension and viscosity, the selected colorant, drying time of the ink jet ink, and the type of paper onto which the ink will be printed. The surface tension, viscosity, and dry time are discussed in greater detail below.

Representative examples of water-miscible organic solvents that may be employed in the practice of the invention include (1) alcohols, such as methyl alcohol, ethyl alcohol, n-propyl alcohol, iso-propyl alcohol, n-butyl alcohol, sec-butyl alcohol, t-butyl alcohol, iso-butyl alcohol, neo-pentyl alcohol, furfuryl alcohol, and tetrahydrofurfuryl alcohol; (2) ketones or ketoalcohols, such as acetone, methyl ethyl ketone, and diacetone ether; (3) ethers, such as tetrahydrofuran and dioxane; (4) esters, such as ethyl acetate, ethyl lactate, ethylene carbonate, and propylene carbonate; (5) diols, such as 1,4-butanediol, 1,2-pentanediol, 1,5-pentanediol, 1,2-hexanediol, and 2-methyl-2,4-pentanediol; (6) polyhydric alcohols, such as ethylene glycol, diethylene glycol, triethylene glycol, tetraethylene glycol, polyethylene glycol, propylene glycol, dipropylene glycol, tripropylene glycol, glycerol, 1,2,6-hexanetriol, ethyl hydroxymethyl 1,3-propane diol, and thiodiglycol; (7) lower alkyl mono- or di-ethers derived from alkylene glycols, such as ethylene mono-methyl (or -ethyl) ether, diethylene glycol mono-methyl (or -ethyl) ether, propylene glycol mono-methyl (or -ethyl) ether, triethylene glycol mono-methyl (or -ethyl) ether, tetraethylene glycol mono-methyl (or -ethyl) ether, diethylene glycol di-methyl (or -ethyl) ether, triethylene glycol di-methyl (or -ethyl) ether, tetraethylene glycol di-methyl (or -ethyl) ether; (8) nitrogen-containing cyclic compounds, such as 2-pyrrolidone, N-methyl-2-pyrrolidone, 2-imidazolidinone, and 1,3-dimethyl-2-imidazolidinone; and (9) sulfur-containing compounds such as dimethyl sulfoxide and tetramethylene sulfone.

The total amount of cosolvent is in the range of about 2 to 60 wt % of the total ink composition.

Preferably, the cosolvent comprises at least one member selected from the group consisting of diethylene glycol, glycerol, triethylene glycol N-methyl-2-pyrrolidone, tetraethylene glycol, 1,4-butanediol, 1,2-pentanediol, and 1,5-pentanediol, in the range of about 3 to 15 wt % of the ink.

Also preferred as the cosolvent is 2-pyrrolidone (a) in the range of about 3 up to 8 wt % of the ink, which provides good print quality and good dry time, and, alternatively, (b) in the range of 8 up to about 10 wt % of the ink, which also reduces paper curl.

4. Other Ingredients

The ink may contain other ingredients. For example, surfactants may be used to alter surface tension as well as promote penetration. However, they may also destabilize pigmented inks. Surfactants may be anionic, cationic, amphoteric, or non-ionic. The choice of surfactant depends on the type of paper to be printed. It is expected that one skilled in the art can select the appropriate surfactant for the specific paper to be used in printing.

The following surfactants, listed in Table IX below, are useful in printing on Gilbert Bond paper (25% cotton), designated style 1057, manufactured by Mead Company, Dayton, Ohio.

TABLE IX

REPRESENTATIVE SURFACTANTS

| Supplier and Tradename | Description |
|---|---|
| Air Products | |
| Surfynol ® 440 | Ethoxylated Tetramethyl Decynediol |
| Surfynol ® 465H | Ethoxylated Tetramethyl Decynediol |
| Surfynol ® CT-136 | Acetylenic Diol, Anionic Surfactant |

TABLE IX-continued

| REPRESENTATIVE SURFACTANTS | |
|---|---|
| Supplier and Tradename | Description |
| | Blend |
| Surfynol ® GA | Acetylenic Diol Blend |
| Surfynol ® TG | Acetylenic Diol Blend in Ethylene Glycol |
| Cyanamid | |
| Aerosol ® OT | Dioctyl Ester of Sodium Sulfosuccinic Acid |
| Aerosol ® MA-80 | Dihexyl Ester of Sodium Sulfosuccinic Acid Mixture of Aerosol ® MA-80/Aerosol OT 2/1 |
| Dupont ™ | |
| Dupanol ® RA | Fortified Sodium Ether-Alcohol Sulfate |
| Merpol ® A | Ethylene Oxide, Ester Condensate |
| Merpol ® LF-H | Polyether |
| Merpol ® SE | Alcohol Ethoxylate |
| Merpol ® SH | Ethylene Oxide Condensate |
| Zelec ® NK | Alcohol Phosphate Composition |
| Fisher Scientific | |
| Polyethylene Glycol 3350 | |
| Polyethylene Glycol 400 | |
| Polyethylene Glycol 600 | |
| ICI | |
| Renex ® 30 | Polyoxyethylene (12) Tridecyl Ether |
| Synthrapol ® KB | Polyoxyethylene (12) Alkyl Alcohol |
| Rohm & Haas | |
| Triton ® CF 10 | Alkylaryl Polyether |
| Triton ® CF 21 | Alkylaryl Polyether |
| Triton ® N 111 | Nonylphenoxy |
| Triton ® X-100 | Polyethoxy Ethanol Octylphenoxy |
| Triton ® X-102 | Polyethoxy Ethanol Octylphenoxy |
| Triton ® X-114 | Polyethoxy Ethanol |
| Union Carbide | |
| Silwet ® L-7600 | Polyalkylenoxide Modified Polydimethylsiloxane |
| Silwet ® L-7607 | Polyalkylenoxide Modified Polydimethylsiloxane |
| Silwet ® L-77 | Polyalkylenoxide Modified Polydimethylsiloxane |
| UCON ® ML 1281 | Polyalkylene Glycol |
| W. R. Grace | |
| Hampshire Div., Hamposyl ® Lida | Lauroyl Iminodiacetic Acid |

Additional ingredients that may be employed include (1) biocides to inhibit growth of microorganisms, such as Proxel GXL (available from ICI America), Nuosept (available from Hüls America) and Ucarcide (available from Union Carbide); (2) sequestering agents, such as EDTA, to eliminate deleterious effects of heavy metal impurities; and (3) humectants, viscosity modifiers, and polymers to improve various properties of the ink compositions, as is known in this art.

5. Dry Time

The current best mode for dry time on typical office copier papers is about 15 to 45 seconds. The maximum acceptable dry time is about 90 seconds.

A dry time within the above-indicated range is achieved by including a mixture of alcohols, preferably two alcohols, in the ink. Most preferably, the mixture of alcohols comprises about 0.5 to 3 wt % (based on the total ink composition) of iso-propyl alcohol and at least one additional alcohol having a boiling point of less than 130° C. and present in an amount sufficient to provide the alcohol mixture with a surface tension within the range of about 45 to 55 dynes/cm. The additional alcohol preferably has from four to five carbon atoms. Most preferably, the additional alcohol comprises at least one of the following alcohols: neopentyl alcohol, n-butyl alcohol, 3-pentanol, and 2-buten-1-ol.

Alternative approaches to providing the desired dry time include employing a mixture of at least one alcohol and at least one surfactant. Examples of dry time mixtures comprising an alcohol and a surfactant include: (a) 2 wt % iso-propyl alcohol and 0.2 wt % Surfynol® 440; and (b) 2 wt % iso-propyl alcohol and 0.1 wt % Silwet® L-77.

6. Additional Considerations

The viscosity of the ink employed in the practice of the invention ranges from about 1 to 20 cp. Preferably, the ink viscosity may fall into one of the following ranges: 1.2 to 2.5 cp, 2.6 to 3.4 cp, or 3.5 to 8 cp. For one pigmented black ink formulation, wherein the shelf length of the pen architecture is staggered and ranges from about 90 to 130 microns, the viscosity is preferably within the range of about 2.6 to 3.4 cp, and most preferably about 3. For another pigmented black ink formulation, wherein the shelf length of the pen architecture is not staggered and is about 55 microns, the viscosity is preferably within the range of about 3.5 to 8 cp, and most preferably about 4.5.

The viscosity is determined using a Brookfield® viscometer, with measurements being made at room temperature.

The surface tension of the ink employed in the practice of the present invention ranges from about 15 to 72 dyne/cm. Preferably, the surface tension of the ink may fall into one of the following ranges: 30 to 49 dyne/cm, 50 to 58 dyne/cm, or 59 to 65 dyne/cm. For one pigmented black ink formulation, wherein the shelf length of the pen architecture is staggered and ranges from about 90 to 130 microns, the surface tension is preferably within the range of about 30 to 49 dyne/cm, and most preferably about 34 dyne/cm. For another pigmented black ink formulation, wherein the shelf length of the pen architecture is also staggered and ranges from about 90 to 130 microns, the surface tension is within the range of about 50 to 58 dyne/cm, and most preferably about 54 dyne/cm.

For surface tension measurements, a ring tensiometer, such as from Fisher Scientific, may be employed. The measurements are made at room temperature.

The pH of the pigment-based inks is typically within the range of about 7 to 9, and preferably about 7.8 to 8.4; the pH of the dye-based inks is typically within the range of about 5 to 9, and preferably about 7.8 to 8.4.

7. Ink Formulations

7a. Composition of Pigment-Based Inks

The pigment-based inks typically comprise the following components:

| | |
|---|---|
| pigment | 0.1 to 8 wt % |
| pigment dispersion | 0.1 to 8 wt % |
| cosolvent | 5 to 40 wt % |
| water | balance. |

The ratio of pigment to pigment dispersion (P/D) is in the range of 8:1 to 0.5:1.

If added, the dry time component described above comprises 0.5 to 3 wt % of the total ink composition.

A preferred composition for a black pigment-based ink comprises the following formulation (water comprises the balance):

| | |
|---|---|
| black pigment | 35 to 4.0 wt % |
| pigment dispersant | 1.8 to 2.2 P/D |
| 2-pyrrolidone | 5 to 10 wt % |
| EG-1[1] | 3 to 7 wt % |
| *iso*-propyl alcohol | 1 to 3 wt % |
| *neo*-pentyl alcohol | <0.5 wt % |
| Proxel GXL[2] | <0.25 wt %. |

Notes:
[1]EG-1 is an ethoxylated glycerin, available from Liponics.
[2]Proxel GXL, available from ICI America, is a biocide and comprises a 19% solution of 1, 2-benzisothiazolin-3-one (BIT) in sodium hydroxide (~6%), dipropylene glycol (~3%) and water. BIT is metabolized directly by many types of microbes.

The physical and chemical parameters of the foregoing ink are:

| | |
|---|---|
| pH | 7.8 to 8.4 |
| surface tension | 50 to 58 dyne/cm |
| viscosity | 2.6 to 3.4 cp |
| conductivity | 0.7 to 3 mSiemens/cm |
| particle size | <125 nm |

7b. Composition of Dye-Based Inks

One color inkjet set of inks comprises the following set of dyes:

| | |
|---|---|
| Black | Food Black 2 |
| Cyan | Acid Blue 9 |
| Yellow | Direct Yellow 86 |
| Magenta | Acid Red 52 (mixture of $Na^+$ and $Li^+$ forms). |

The vehicle for this set comprises a mixture of diethylene glycol and water. This set of dye-based inks is disclosed in U.S. Pat. No. 5,145,519, which is incorporated herein by reference.

Other patents which disclose dye-based inks and their formulations include the following U.S. Pat. Nos.: 4,853,037; 4,963,189; 5,062,893; 5,111,302; 5,143,547; 5,185,034; and 5,273,573, all of which are incorporated herein by reference.

C. Combination of Pen Architecture and Ink

Use of a short shelf, on the order of 55 microns, provides a very high speed refill. However, it is a characteristic of high speed refill that it has a tendency for being overdamped. To provide the requisite damping, the ink should have a viscosity greater than about 2 cp. However, slower refill speeds set the high limit on acceptable ink viscosities. Thus, viscosities above about 8 cp become impractical in the previously-described architectures. In this way, the ink and architecture work together to provide a tuned system that enables stable operation at high frequencies. One advantage of the combination of a pigment and a dispersant is the resultant higher viscosity provided. With dye-based inks, other additives are required, such as binders and viscosity builders, to achieve the higher viscosities.

The high speed would be of little value if the ink did not have a fast enough rate of drying. This is accomplished by the addition of alcohols or at least one alcohol and at least one surfactant to the ink, as described above.

The use of pigments that lend themselves to high frequency operation can have the effect of destabilizing the inks. A combination of dispersants and ethoxylated glycerin are added to prevent stability problems.

The preferred embodiment of a short shelf (90 to 130 microns), ink viscosity of about 3 cp, and surface tension of about 54 provides a high speed drop generator capable of operating at a maximum frequency of about 12 KHz. Reducing the shelf length to about 55 microns (slant design) permits drop generator operation at a maximum frequency of as high as about 20 KHz.

Fast dry times are achieved with a combination of alcohols, such as iso-propyl alcohol with a 4 or 5 carbon alcohol or with iso-propyl alcohol plus surfactant(s).

As a consequence of employing pigment-based inks, high optical densities are realized, along with excellent permanence (no fade and better waterfastness), and good stability.

The combination of preferred ink and pen architecture provides good drop generator stability.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An inkjet drop ejection system comprising:

(a) a substantially rectangular substrate having a top surface and an opposing bottom surface, and having a first outer edge along a periphery of said substrate and a second outer edge along said opposite periphery of said substrate;

(b) a nozzle member having a plurality of ink orifices formed therein, said nozzle member being positioned to overlie said top surface of said substrate;

(c) first and second pluralities of ink ejection elements formed on said top surface of said substrate, each of said ink ejection elements comprising a firing element in a vaporization chamber and being located approximate to an associated one of said orifices for causing a portion of ink to be expelled from said associated orifice as said inkjet drop ejection system is moved along a scan direction, said first plurality of ink ejection elements arranged in a first array along said first outer edge and said second plurality of ink ejection elements arranged in a second array along said second outer edge, each said vaporization chamber and associated orifice being offset from adjacent vaporization chambers and orifices along a direction perpendicular to said scan direction;

(d) an ink reservoir for holding a quantity of ink;

(e) a fluid channel, communicating with said reservoir, leading to each of said orifices and said ink ejection elements, said fluid channel allowing ink to flow from said ink reservoir, around said first outer edge of said substrate and to said top edge of said substrate so as to be proximate to said orifices and said ink ejection elements;

(f) a separate inlet passage defined by a barrier layer for each vaporization chamber connecting said fluid channel with said vaporization chamber for allowing high frequency refill of said vaporization chamber;

(g) a group of said firing elements in adjacent relationship forming a primitive in which only one firing element in said primitive is activated at a time by a combination of a primitive select signal and a firing element address signal, said address signals associated with each firing element in a primitive being sequentially generated in time in a fixed sequence, the timing of the firing of offset firing elements in a said primitive by said sequence address signals being such that later-occurring address signals in said fixed sequence control the firing of offset firing elements that are located downstream from other firing elements in each of said first array and said second array with respect to said scan direction, the combination of the firing of one firing element in a primitive at a time and the firing of offset firing elements by later-occurring address signals in said fixed sequence thereby reducing cross-talk between vaporization chambers;

(h) circuit means for transmitting firing signals to said ink firing elements at a maximum frequency greater than 9 KHz; and (i) said inkjet drop ejection system forming a part of a color set comprising at least one ink, said ink comprising at least one colorant in an aqueous vehicle.

2. The inkjet drop ejection system of claim 1, wherein said firing elements are arranged in a staggered configuration along said substrate such that adjacent firing elements are located at different shelf lengths along said edge thereof.

3. The inkjet drop ejection system of claim 2, wherein said separate inlet passage for each vaporization chamber additionally has peninsulas.

4. The inkjet drop ejection system of claim 2, wherein every other one of said separate inlet passages has a peninsula.

5. The inkjet drop ejection system of claim 1, wherein said firing elements are arranged along said substrate at substantially identical shelf lengths along said edge thereof, said substrate rotated with respect to said scan direction to compensate for timing delays between adjacent nozzles.

6. The inkjet drop ejection system of claim 1, wherein said substrate is rotated by an amount given by $\phi=\text{arcsine}((v*t)/D)$, where v is scan velocity of said inkjet drop ejection system, t is time delay between firing two adjacent ink ejection elements, and D is distance between adjacent nozzles.

7. The inkjet drop ejection system of claim 1, wherein said vaporization chambers are substantially rectangular.

8. The inkjet drop ejection system of claim 1, wherein said vaporization chambers are substantially circular.

9. The inkjet drop ejection system of claim 1, wherein a group of said vaporization chambers in adjacent relationship form a primitive in which only one vaporization chamber in said primitive is activated at a time.

10. The inkjet drop ejection system of claim 1, wherein said colorant comprises a pigment.

11. The inkjet drop ejection system of claim 10, wherein said pigment is black.

12. The inkjet drop ejection system of claim 10, wherein said pigment is selected from the group consisting of cyan, yellow, and magenta pigments.

13. The inkjet drop ejection system of claim 10, wherein said pigment has a particle size within the range of about 20 to 99 nm.

14. The inkjet drop ejection system of claim 10, wherein said pigment has a particle size within the range of about 100 to 125 nm.

15. The inkjet drop ejection system of claim 10, wherein said pigment has a particle size within the range of about 126 to 200 nm.

16. The inkjet drop ejection system of claim 10, wherein said ink further includes a pigment dispersant.

17. The inkjet drop ejection system of claim 16, wherein said pigment dispersant is an acrylic.

18. The inkjet drop ejection system of claim 16, wherein said pigment dispersant is a non-acrylic.

19. The inkjet drop ejection system of claim 16, wherein said pigment dispersant is a block polymer.

20. The inkjet drop ejection system of claim 16, wherein said pigment dispersant is a non-block polymer.

21. The inkjet drop ejection system of claim 20, wherein said pigment dispersant is selected from the group consisting of random, star, and graft polymers.

22. The inkjet drop ejection system of claim 16, wherein said dispersant comprises at least one hydrophilic molecule covalently bonded to said pigment.

23. The inkjet drop ejection system of claim 16, wherein said vehicle includes a dry time component.

24. The inkjet drop ejection system of claim 23, wherein said dry time component comprises at least two alcohols in an amount sufficient to provide said ink with a dry time of about 15 to 45 seconds on typical office copier papers.

25. The inkjet drop ejection system of claim 23, wherein said dry time component comprises at least one alcohol and at least one surfactant in amounts sufficient to provide said ink with a dry time of about 15 to 45 seconds on typical office copier papers.

26. The inkjet drop ejection system of claim 1, wherein said colorant comprises a dye.

27. The inkjet drop ejection system of claim 26, wherein said dye is Reactive Black 31.

28. The inkjet drop ejection system of claim 26, wherein said dye is Projet Fast Black 2.

29. The inkjet drop ejection system of claim 26, wherein said dye is selected from the group consisting of Food Black 2, Direct Black 168, Direct Black 19, and Mobay Special Direct Black (SP).

30. The inkjet drop ejection system of claim 26, wherein said dye is selected from the group consisting of cyan, yellow, and magenta dyes.

31. The inkjet drop ejection system in claim 1, wherein said vehicle contains at least one cosolvent in an amount of about 2 to 60 wt % of said ink.

32. The inkjet drop ejection system of claim 31, wherein said cosolvent is a polyethylene glycol.

33. The inkjet drop ejection system of claim 31, wherein said cosolvent is selected from the group consisting of diethylene glycol, glycerol, triethylene glycol, N-methyl pyrrolidone, tetraethylene glycol, 1,4-butanediol, 1,2-pentanediol, and 1,5-pentanediol, present in an amount of about 3 to 15 wt % of said ink.

34. The inkjet drop ejection system of claim 31, wherein said vehicle includes 2-pyrrolidone in the range of 8 to about 10 wt % of said ink.

35. The inkjet drop ejection system of claim 31, wherein said vehicle comprises 2-pyrrolidone in the range of about 3 to up to 8 wt % of said ink.

36. The inkjet drop ejection system of claim 1, wherein said ink has a viscosity within the range of about 1.2 to 2.5 cp.

37. The inkjet drop ejection system of claim 1, wherein said ink has a viscosity within the range of about 2.6 to 3.4 cp.

38. The inkjet drop ejection system of claim 1, wherein said ink has a viscosity within the range of about 3.5 to 8 cp.

39. The inkjet drop ejection system of claim 1, wherein said ink has a surface tension within the range of about 30 to 49 cp.

40. The inkjet drop ejection system of claim 1, wherein said ink has a surface tension within the range of about 50 to 58 cp.

41. The inkjet drop ejection system of claim 1, wherein said ink has a surface tension within the range of about 59 to 65 cp.

42. The inkjet drop ejection system of claim 26, wherein said dye is a black dye.

43. The inkjet drop ejection system of claim 30 wherein:

said cyan dye is at least one of Direct Blue 86 and Direct Blue 199;

said magenta dye is Acid Red 249; and said yellow dye is Direct Yellow 86.

44. The inkjet drop ejection system of claim 1 wherein said separate inlet passage for each vaporization chamber has pinch points formed in said barrier layer to prevent cross-talk and overshoot during high frequency operation.

* * * * *

UNITED STATES PATENT AND TRADEMARK OFFICE

CERTIFICATE OF CORRECTION

PATENT NO. : 5,946,012
DATED : August 31, 1999
INVENTOR(S) : Courian, et al.

It is certified that error appears in the above-identified patent and that said Letters Patent is hereby corrected as shown below:

At column 7, line 35, after "assembly" insert --taken along line 12-12 of FIG.10,-.

At column 7, line 39, after "line" delete "B-B" and insert in lieu thereof --13-13--.

At column 7, line 39 after "of" delete "FIG.10" and insert in lieu thereof --FIG. 12--.

At column 11, line 1, after "line", delete "B-B" and insert in lieu thereof --13-13--.

At column 12, line 27, after "line" delete "B-B" and insert in lieu thereof --13-13--.

At column 27, line 65, after "pages" delete "110-129,1990" and insert in lieu thereof --117-137, 1992--.

At column 37, line 39, after "5,062,893;" delete "5,111,302" and insert in lieu thereof --5,428,383--.

At column 10, line 1, "A-A" should be --6-6--.

At column 13, line 13, " Be" should be --By--.

Signed and Sealed this

Fifth Day of December, 2000

*Attest:*

*Attesting Officer*

Q. TODD DICKINSON

*Director of Patents and Trademarks*